US009377733B2

(12) United States Patent
Nishizawa et al.

(10) Patent No.: US 9,377,733 B2
(45) Date of Patent: Jun. 28, 2016

(54) IMAGE FIXING DEVICE

(71) Applicant: CANON KABUSHIKI KAISHA, Tokyo (JP)

(72) Inventors: Yuki Nishizawa, Yokohama (JP); Hiroshi Mano, Numanzu (JP); Minoru Hayasaki, Mishima (JP); Aoji Isono, Naga-gun (JP); Akira Kuroda, Numazu (JP); Toshio Miyamoto, Numazu (JP); Michio Uchida, Mishima (JP); Seiji Uchiyama, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/408,524

(22) PCT Filed: Jun. 13, 2013

(86) PCT No.: PCT/JP2013/066901

§ 371 (c)(1),
(2) Date: Dec. 16, 2014

(87) PCT Pub. No.: WO2013/191229

PCT Pub. Date: Dec. 27, 2013

(65) Prior Publication Data

US 2015/0132035 A1 May 14, 2015

(30) Foreign Application Priority Data

Jun. 19, 2012 (JP) ..... 2012-137892
Jun. 10, 2013 (JP) ..... 2013-122216

(51) Int. Cl.
*G03G 15/20* (2006.01)
*H05B 6/14* (2006.01)
*H05B 6/36* (2006.01)

(52) U.S. Cl.
CPC ..... *G03G 15/206* (2013.01); *G03G 15/2017* (2013.01); *G03G 15/2042* (2013.01); *H05B 6/14* (2013.01); *H05B 6/365* (2013.01); *G03G 2215/2035* (2013.01)

(58) Field of Classification Search
CPC ..... G03G 15/2053; G03G 15/2064; G03G 15/206
USPC ..... 399/329; 219/216
See application file for complete search history.

(56) References Cited

U.S. PATENT DOCUMENTS 5,752,150 A * 5/1998 Kato ..... G03G 15/2053 219/619
6,320,168 B1 * 11/2001 Kimata ..... G03G 15/2053 219/619

(Continued)

FOREIGN PATENT DOCUMENTS

JP S58-184973 A 10/1983
JP S58-184974 A 10/1983

(Continued)

*Primary Examiner* — Francis Gray
(74) *Attorney, Agent, or Firm* — Canon USA Inc. IP Division

(57) ABSTRACT

A fixing device configured to fix an image on a recording material, includes: a rotary member including an electroconductive layer; a coil which has a spiral shaped portion and is disposed in the inside of the rotary member; and a core disposed in the spiral shaped portion; with magnetic resistance of the core being, with an area from one end to the other end of the maximum passage region of the image on the recording material regarding the generatrix direction, equal to or smaller than 30% of combined magnetic resistance made up of magnetic resistance of the electroconductive layer and magnetic resistance of a region between the electroconductive layer and the core.

52 Claims, 35 Drawing Sheets

(56) References Cited

U.S. PATENT DOCUMENTS

| | | | | |
|---|---|---|---|---|
| 6,459,878 | B1 * | 10/2002 | Tomoyuki | G03G 15/206 29/895.32 |
| 2002/0103614 | A1 * | 8/2002 | Naito | H05B 6/145 702/130 |
| 2015/0168880 | A1 * | 6/2015 | Jota | G03G 15/2053 399/333 |

FOREIGN PATENT DOCUMENTS

| | | | | |
|---|---|---|---|---|
| JP | H07-287471 | A | | 10/1995 |
| JP | H08-76622 | A | | 3/1996 |
| JP | H09-102385 | A | | 4/1997 |
| JP | H09-160414 | A | | 6/1997 |
| JP | H09-160415 | A | | 6/1997 |
| JP | 10319748 | A | * | 12/1998 |
| JP | H10-319748 | A | | 12/1998 |
| JP | 2000-081806 | A | | 3/2000 |
| JP | 2001-051528 | A | | 2/2001 |
| JP | 2002-287539 | A | | 10/2002 |
| JP | 2003-330291 | A | | 11/2003 |
| JP | 2004-341164 | A | | 12/2004 |
| JP | 2005-166524 | A | | 6/2005 |
| JP | 2006-268026 | A | | 10/2006 |
| JP | 2006-301106 | A | | 11/2006 |
| JP | 2007-034157 | A | | 2/2007 |
| JP | 2007-256986 | A | | 10/2007 |
| JP | 2009-063863 | A | | 3/2009 |
| JP | 2011-039397 | A | | 2/2011 |
| JP | 2012-083620 | A | | 4/2012 |
| JP | 2015106135 | A | * | 6/2015 |
| RU | 2176600 | C2 | | 12/2001 |

* cited by examiner $$Pc \cdot Vm = \phi c = \phi a_in + \phi cy + \phi a_out$$
$$= Pa_in \cdot Vm + Pcy \cdot Vm + Pa_out \cdot Vm$$
$$= (Pa_in + Pcy + Pa_out) \cdot Vm$$
$$\therefore Pc - Pa_in - Pcy - Pa_out = 0$$

$$Pc = \mu 1 \cdot S1$$
$$Pa_in = \mu 0 \cdot (S2 - S1)$$
$$Pcy = \mu 2 \cdot (S3 - S2)$$
$$Pa_out = Pc - Pa_in - Pcy$$

R1 IS EQUIVALENT TO LOSS OF COIL.
R2 IS RESISTANCE VALUE OF SLEEVE.

LEFT DRAWING IS REWRITTEN IN RIGHT DRAWING WITH EQUIVALENT CIRCUIT.
Rx IS REAL PART (RESISTANCE WORTH) OF MEASURED VALUE OF IMPEDANCE ANALYZER AT THE TIME OF SLEEVE BEING LOADED.
Lx IS IMAGINARY PART (INDUCTANCE WORTH).

IMAGE FIXING DEVICE

TECHNICAL FIELD

The present invention relates to a fixing device to be installed in an image forming apparatus such as an electrophotographing system copying machine, printer, or the like.

BACKGROUND ART

In general, a fixing device to be installed in an image forming apparatus such as an electrophotographing system copying machine, printer, or the like, is configured to heat a recording material where an unfixed toner image is carried to fix the toner image on the recording material while transporting the recording material by a nip portion formed of a heating rotary member and a pressure roller which is in contact therewith.

In recent years, an electromagnetic induction heating system fixing device whereby an electroconductive layer of a heating rotary member can directly be heated has been developed and put into practice. The electromagnetic induction heating system fixing device has an advantage in that warm-up time is short.

With fixing devices disclosed in PTL 1, PTL 2, and PTL 3, according to an eddy current induced in an electroconductive layer of a heating rotary member with a magnetic field generated from a magnetic field generator, the electroconductive layer is heated. With such fixing devices, as the electroconductive layer of the heating rotary member, magnetic metal which readily passes magnetic flux such as iron or nickel or the like of which the thickness is 200 μm to 1 mm, or an alloy primarily made up of these, is employed.

Incidentally, in order to attempt to reduce warm-up time of a fixing device, heat capacity of the heating rotary member has to be reduced, and accordingly, it is advantageous that the thickness of the electroconductive layer of the heating rotary member be small. However, with the fixing devices disclosed in the above-mentioned literatures, reducing the thickness of the heating rotary member being reduced, results in deterioration of heat efficiency. Further, with regard to the fixing devices disclosed in the above-mentioned literatures, even in the event of employing a material of which the relative permeability is low, heat efficiency deteriorates. Therefore, with the fixing devices disclosed in the above-mentioned literatures, a thick material having high relative permeability has to be selected as the material of the heating rotary member.

Accordingly, the fixing devices disclosed in the above-mentioned literatures have a problem in that a material to be used as the electroconductive layer of the heating rotary member is restricted to a material having high relative permeability, and restraints are imposed on costs, material processing method, and device configuration.

CITATION LIST

Patent Literature

PTL 1 Japanese Patent Laid-Open No. 2000-81806
PTL 2 Japanese Patent Laid-Open No. 2004-341164
PTL 3 Japanese Patent Laid-Open No. 9-102385

SUMMARY OF INVENTION

The present invention provides a fixing device wherein restraints regarding the thickness and material of an electroconductive layer are small, and the electroconductive layer can be heated with high efficiency.

According to a first embodiment of the invention, a fixing device configured to fix an image on a recording material by heating the recording material where the image is formed, including: a cylindrical rotary member including an electroconductive layer; a coil configured to form an alternating magnetic field which subjects the electroconductive layer to electromagnetic induction heating, which has a spiral shaped portion which is disposed in the rotary member so that a spiral axis of the spiral shaped portion is positioned substantially in parallel with a generatrix direction of the rotary member; and a core configured to induce a magnetic force line of the alternating magnetic field, which is disposed in the spiral shaped portion; with reluctance of the core being, with an area from one end to the other end of the maximum passage region of the image on a recording material in the generatrix direction, equal to or smaller than 30% of combined magnetic resistance made up of magnetic resistance of the electroconductive layer and magnetic resistance of a region between the electroconductive layer and the core.

According to a second embodiment of the invention, a fixing device configured to fix an image on a recording material by heating the recording material where the image is formed, including: a cylindrical rotary member including an electroconductive layer; a coil configured to form an alternating magnetic field which subjects the electroconductive layer to electromagnetic induction heating, which has a spiral shaped portion which is disposed in the rotary member so that a spiral axis of the spiral shaped portion is positioned substantially in parallel with a generatrix direction of the rotary member; and a core configured to induce magnetic force lines of the alternating magnetic field, which has a shape where a loop is not formed outside the rotary member and is disposed in the spiral shaped portion; with 70% or more of magnetic force lines output from one end in the generatrix direction of the core passing over the outside of the electroconductive layer and returning to the other end of the core.

According to a third embodiment of the invention, a fixing device configured to fix an image on a recording material by heating the recording material where the image is formed, including: a cylindrical rotary member including an electroconductive layer; a coil configured to form an alternating magnetic field which subjects the electroconductive layer to electromagnetic induction heating, which has a spiral shaped portion which is disposed in the rotary member so that a spiral axis of the spiral shaped portion is positioned substantially in parallel with a generatrix direction of the rotary member; and a core configured to induce magnetic force lines of the alternating magnetic field, which is disposed in the spiral shaped portion; with relative permeability of the electroconductive layer and relative permeability of a member in the area between the electroconductive layer and the core, in an area from one end to the other end of the maximum passage region of the image on a recording material in the generatrix direction, being smaller than 1.1; and wherein the fixing device satisfies a following relational expression (1) with a cross section perpendicular to the generatrix direction throughout the area: $0.06 \times \mu c \times Sc \geq Ss + Sa$ (1) where Ss represents a cross-sectional area of the electroconductive layer, Sa represents a cross-sectional area of a region between the electroconductive layer and the core, Sc represents a cross-sectional area of the core, and μc represents a relative permeability of the core.

According to a fourth embodiment of the invention, a fixing device configured to fix an image on a recording material by heating the recording material where the image is formed, including: a cylindrical rotary member including an electroconductive layer; a coil configured to form an alternating magnetic field which subjects the electroconductive layer to electromagnetic induction heating, which has a spiral shaped portion which is disposed in the rotary member so that a spiral axis of the spiral shaped portion is positioned substantially in parallel with a generatrix direction of the rotary member; and a core configured to induce magnetic force lines of the alternating magnetic field, which is disposed in the spiral shaped portion; with the electroconductive layer being formed of a non-magnetic material, and the core having a shape where a loop is not formed outside the rotary member.

According to a fifth embodiment of the invention, a fixing device configured to fix an image on a recording material by heating the recording material where the image is formed, including: a cylindrical rotary member including an electroconductive layer; a coil configured to form an alternating magnetic field which subjects the electroconductive layer to electromagnetic induction heating, which has a spiral shaped portion which is disposed in the rotary member so that a spiral axis of the spiral shaped portion is positioned substantially in parallel with a generatrix direction of the rotary member; and a core configured to induce magnetic force lines of the alternating magnetic field, which is disposed in the spiral shaped portion; with the electroconductive layer being formed of a non-magnetic material, and thickness of the electroconductive layer being equal to or thinner than 75 μm.

DESCRIPTION OF EMBODIMENTS

First Embodiment (1) Image Forming Apparatus Example

Figure 2:
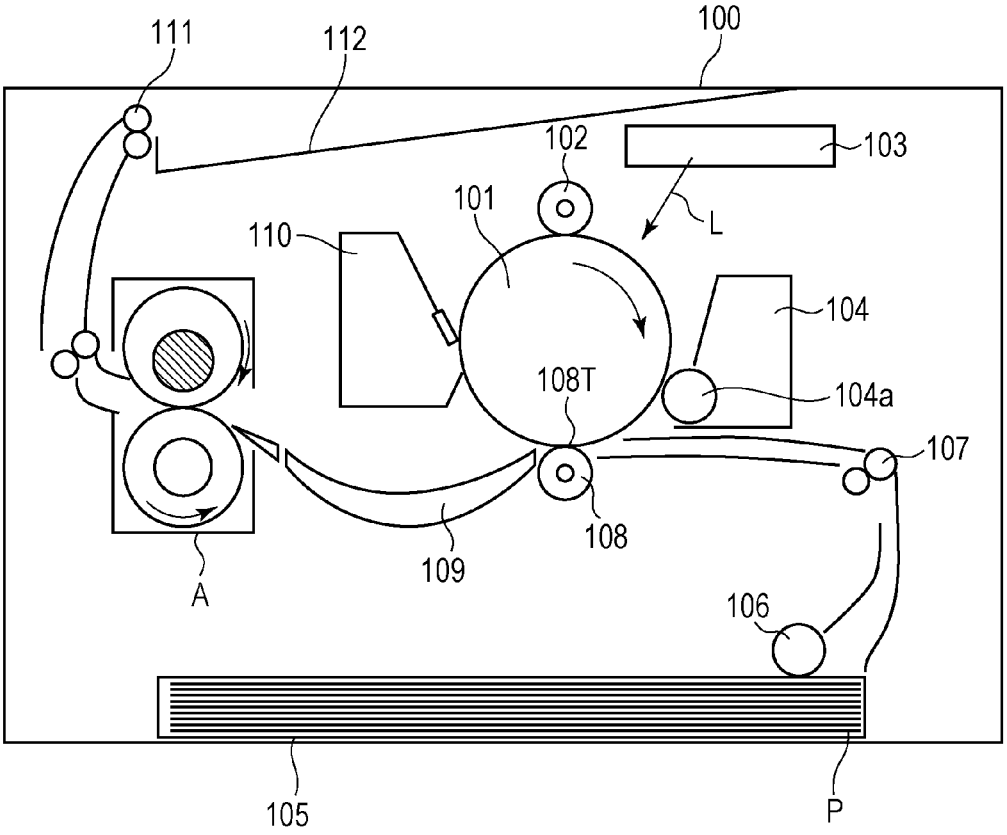
FIG. 2 is a schematic configuration diagram of an image forming apparatus according to a first embodiment.

Hereinafter, an embodiment of the present invention will be described based on the drawings. FIG. 2 is a schematic configuration diagram of an image forming apparatus 100 according to the present embodiment. The image forming apparatus 100 according to the present embodiment is a laser-beam printer using an electrophotographic process. 101 denotes a rotating drum type electrophotographic photosensitive member (hereinafter, referred to as photosensitive drum) serving as an image supporting member, and is driven by rotation with predetermined peripheral velocity. The photosensitive drum 101 is evenly charged with a predetermined polarity and a predetermined potential by a charging roller 102 in the process of rotating. 103 denotes a laser beam scanner serving as an exposure unit. The scanner 103 outputs a laser beam L modulated according to image information to be input from an external device such as an unillustrated image scanner or computer or the like, and exposes a charged face of the photosensitive drum 101 by scanning. According to this scanning exposure, charge on the surface of the photosensitive drum 101 is removed, an electrostatic latent image according to image information is formed on the surface of the photosensitive drum 101. 104 denotes a developing apparatus, toner is supplied from a developing roller 104*a* to the photosensitive drum 101 surface, and an electrostatic latent image is formed as a toner image. 105 denotes a paper feed cassette in which recording material P is loaded which is housed. A paper feed roller 106 is driven based on a paper feed start signal, and the recording material P within the paper feed cassette 105 is fed by being separated one sheet at a time. The recording material P is introduced into a transfer portion 108T formed of the photosensitive drum 101 and a transfer roller 108 via a registration roller 107 at predetermined timing. Specifically, at timing when a leading end portion of a toner image on the photosensitive drum 101 reaches the transfer portion 108T, transportation of the recording material P is controlled by the registration roller 107 so that the leading end portion of the recording material P reaches the transfer portion 108T. While the recording material P introduced into the transfer portion 108T is transported to this transfer portion 108T, transfer bias voltage is applied to the transfer roller 108 by transfer bias applied power which is not illustrated. Transfer bias voltage having the opposite polarity of the toner is applied to the transfer roller 108, and accordingly, a toner image on the surface side of the photosensitive drum 101 is transferred to the surface of the recording material P at the transfer portion 108T. The recording material P where the toner image has been transferred at the transfer portion 108T is separated from the surface of the photosensitive drum 101 and is subjected to fixing processing at a fixing device A via a conveyance guide 109. The fixing device A will be described later. On the other hand, the surface of the photosensitive drum 101 after the recording material is separated from the photosensitive drum 101 is subjected to cleaning at a cleaning device 110, and is repeatedly used for image formation operation. The recording material P passing through the fixing device A is discharged onto a paper output tray 112 from an paper output port 111.

(2) Fixing Device 2-1. Schematic Configuration

Figure 3:
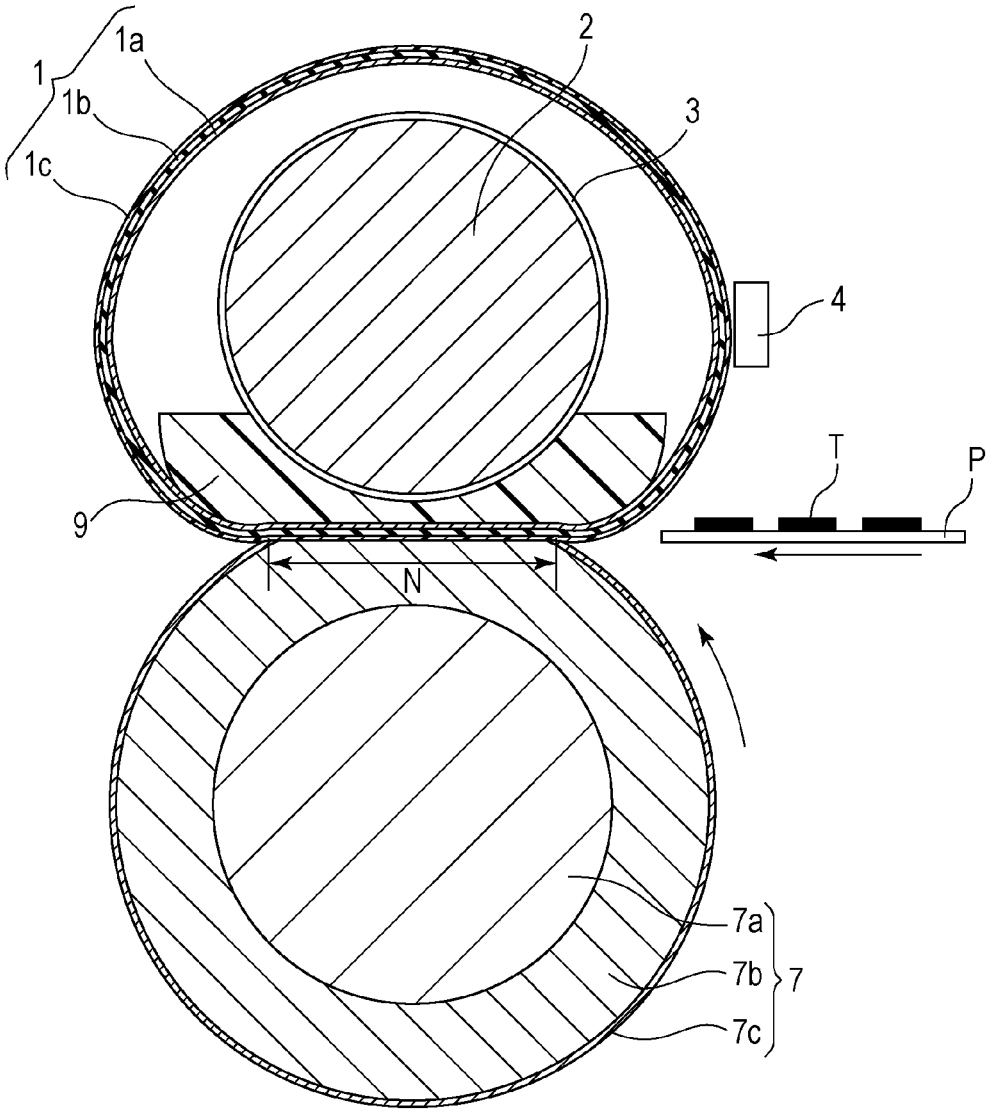
FIG. 3 is a cross-sectional schematic view of a fixing device according to the first embodiment.

FIG. 3 is a schematic cross-sectional view of the fixing device According to the first embodiment. The fixing device A includes a fixing film serving as a cylindrical heating rotary member, a film guide 9 (belt guide) serving as a nip portion forming member which is in contact with the inner face of the fixing film 1, and a pressure roller 7 serving as an opposing member. The pressure roller 7 forms a nip portion N along with the nip portion forming member via the fixing film 1. The recording material P where a toner image T is supported is heated while being transported by the nip portion N to fix the toner image T on the recording material P.

The nip portion forming member 9 is pressed against the pressure roller 7 sandwiching the fixing film 1 therebetween by pressing force of around total pressure 50 N to 100 N (around 5 kgf to around 10 kgf) using an unillustrated bearing unit and a pressing unit. The pressure roller 7 is driven by rotation in an arrow direction using an unillustrated driving source, rotation force works on the fixing film 1 according to frictional force at the nip portion N, and the fixing film 1 is driven by the pressure roller 7 to rotate. The nip portion forming member 9 also has a function serving as a film guide configured to guide the inner face of the fixing film 1, and is configured of polyphenylene sulfide (PPS) which is a heat-resistant resin, or the like.

The fixing film 1 (fixing belt) includes an electroconductive layer 1*a* (base layer) made of metal of which the diameter (outer diameter) is 10 to 100 mm, an elastic layer 1*b* formed on the outer side of the electroconductive layer 1*a*, and a surface layer 1*c* (release layer) formed on the outer side of the elastic layer 1*b*. Hereinafter, the electroconductive layer 1*a* will be referred to as "cylindrical rotary member" or "cylindrical member". The fixing film 1 has flexibility.

With the first embodiment, as the cylindrical rotary member 1*a*, aluminum of which the relative permeability is 1.0, and the thickness is 20 μm is employed. As the material of the cylindrical rotary member 1*a*, copper (Cu) or Ag (silver) which is a nonmagnetic member may be employed, or austenitic stainless steel (SUS) may be employed. As one of features of the present embodiment, it is cited that there are many material options to be employed as the cylindrical rotary member 1*a*. Thus, there is an advantage wherein a material which excels in workability, or a cheap material may be employed.

The thickness of the cylindrical rotary member 1*a* is equal to or thinner than 75 μm, and preferably equal to or thinner than 50 μm. This is because it is desirable to provide suitable flexibility to the cylindrical rotary member 1*a*, and also to reduce heat quantity thereof. A small diameter is advantageous for reducing heat quantity. Another advantage by reducing the thickness to 75 μm or preferably equal to or thinner than 50 μm is improvement in flexibility performance. The fixing film 1 is driven by rotation in a state pressed by the nip portion forming member 9 and pressure roller 7. The fixing film 1 is pressed and deformed at the nip portion N and receives stress for each rotation thereof. Even if this repetition bending is continuously applied to the fixing film 1 until endurance life of the fixing device, the electroconductive layer 1*a* made of metal of the fixing film 1 has to be designed so as not to cause fatigue breakdown. Upon the thickness of the electroconductive layer 1*a* being reduced, tolerability against fatigue breakdown of the electroconductive layer 1*a* made of metal is significantly improved. This is because, when the electroconductive layer 1*a* is pressed and deformed in accordance with the shape of the curved surface of the nip portion forming member 9, the thinner the electroconductive layer 1*a* is, the smaller internal stress which works on the electroconductive layer 1*a* decreases. In general, when the thickness of a metal layer to be used for the fixing film reaches equal to or thinner than 50 μm, this effect becomes marked, and it is apt to obtain sufficient tolerability against fatigue breakdown. According to the above-mentioned reasons, in order to realize minimization of heat quantity, and improvement in tolerability against fatigue breakdown, it is important to make full use of the electroconductive layer 1*a* so as to suppress the thickness thereof to 50 μm or thinner. The present embodiment has an advantage wherein the thickness of the electroconductive layer 1*a* can be suppressed to 50 μm or thinner even with an electromagnetic induction heating system fixing device.

The elastic layer 1*b* is formed of silicon rubber of which the hardness is 20 degrees (JIS-A, 1 kg loaded), and has thickness of 0.1 to 0.3 mm. Additionally, fluorocarbon resin tube of which the thickness is 10 to 50 μm is covered on the elastic layer 1*b* as the surface layer 1*c* (release layer). A magnetic core 2 is inserted into a hollow portion of the fixing film 1 in the generatrix direction of the fixing film 1. An exciting coil 3 is wound around the outer circumference of the magnetic core 2 thereof.

2-2. Magnetic Core

Figure 1:
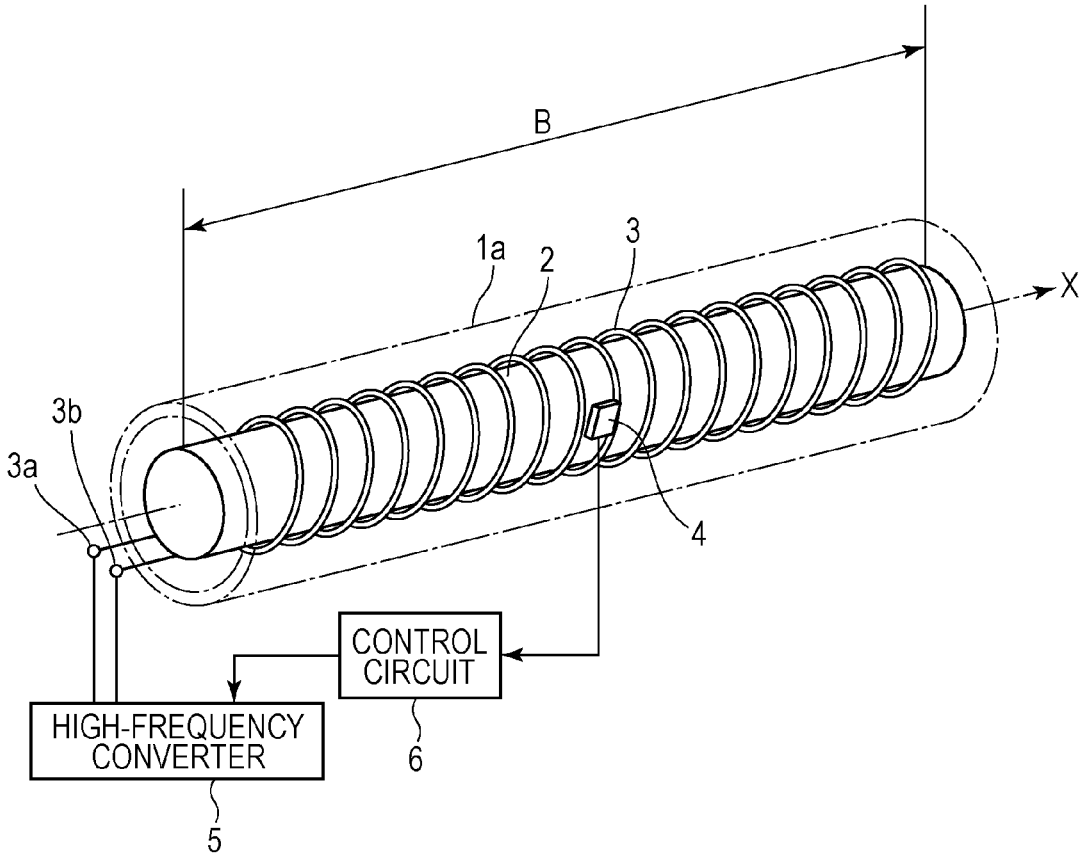
FIG. 1 is a perspective view of a fixing film, a magnetic core, and a coil.

FIG. 1 is a perspective view of the cylindrical rotary member 1*a* (electroconductive layer), magnetic core 2, and exciting coil 3. The magnetic core 2 has a cylindrical shape, and is disposed substantially in the center of the fixing film 1 by an unillustrated fixing unit. The magnetic core 2 has a role configured to induce magnetic force lines (magnetic flux) of an alternating magnetic field generated at the exciting coil 3 into the cylindrical rotary member 1*a* (a region between the cylindrical rotary member 1*a* and magnetic core 2) and to form a path (magnetic path) for a magnetic filed line. It is desirable that the material of this magnetic core 2 is ferromagnetic made up of oxide or alloy material having low hysteresis loss and high magnetic permeability, for example, such as baking ferrite, ferrite resin, amorphous alloy, permalloy and so forth. In particular, in the event of applying a high-frequency alternating current of a 21 kHz to 100 kHz band to the exciting coil, baking ferrite having small loss in a high-frequency alternating current is desirable. It is desirable to increase the cross-sectional area of the magnetic core 2 as much as possible within a range storable in the hollow portion of the cylindrical rotary member 1*a*. With the present embodiment, let us say that the diameter of the magnetic core is 5 to 40 mm, and the length in the longitudinal direction is 230 to 300 mm. Note that the shape of the magnetic core 2 is not restricted to a cylindrical shape, and may be a prismatic shape. Also, an arrangement may be made wherein the magnetic core is divided into more than one in the longitudinal direction, and a gap is provided between the cores, but in such a case, it is desirable that a gap between the divided magnetic cores is configured as small as possible according to a later-described reason.

2-3. Exciting Coil

The exciting coil 3 is formed by winding a copper wire-material (single lead wire) of which the diameter is 1 to 2 mm covered with heat-resistant polyamide imide around the magnetic core 2 in a spiral shape with around 10 turns to 100 turns. With the present embodiment, let us say that the number of turns of the exciting coil 3 is 18 turns. The exciting coil 3 is wound around the magnetic core 2 in a direction orthogonal to the generatrix direction of the fixing film 1, and accordingly, in the event of applying a high-frequency current to this exciting coil, an alternating magnetic field can be generated in a direction parallel with the generatrix direction of the fixing film 1.

Note that the exciting coil 3 does not necessarily have to be wound around the magnetic core 2. It is desirable that the exciting coil 3 has a spiral-shaped portion, the spiral-shaped portion is disposed within the cylindrical rotary member so that the spiral axis of the spiral-shaped portion thereof is in parallel with the generatrix direction of the cylindrical rotary member, and the magnetic core is disposed in the spiral-shaped portion. For example, an arrangement may be made wherein a bobbin on which the exciting coil 3 is wound in a spiral shape is provided into the cylindrical rotary member, and the magnetic core 2 is disposed within the bobbin thereof.

Also, from the perspective of heat generation, when the spiral axis and the generatrix direction of the cylindrical rotary member are parallel, heat efficiency becomes the highest. However, in the event that the parallelism of the spiral axis against the generatrix direction of the cylindrical rotary member is shifted, "the amount of magnetic flux penetrating a circuit in parallel" slightly decreases, and heat efficiency thereof decreases, but in the event that the shift amount is inclination of several degrees alone, there is no practical issue at all.

2-4. Temperature Control Unit

A temperature detecting member 4 in FIG. 1 is provided for detecting surface temperature of the fixing film 1. With the present embodiment, a non-contacting type thermistor is employed as the temperature detecting member 4. A high-frequency converter 5 supplies a high-frequency current to the exciting coil 3 via electric supply contact portions 3*a* and 3*b*. Note that a use frequency of electromagnetic induction heating has been determined to be a range of 20.05 kHz to 100 kHz by radio law enforcement regulations within the country of Japan. Also, the frequency is preferably low for component cost of the power source, and accordingly, with the first embodiment, frequency modulation control is performed in a region of 21 kHz to 40 kHz around the lower limit of an available frequency band. A control circuit 6 controls the high-frequency converter 5 based on the temperature detected by the temperature detecting member 4. Thus, control is performed so that the fixing film 1 is subjected to electromagnetic induction heating, and the temperature of the surface becomes predetermined target temperature (around 150 degrees Centigrade to 200 degrees Centigrade).

Figure 4A:
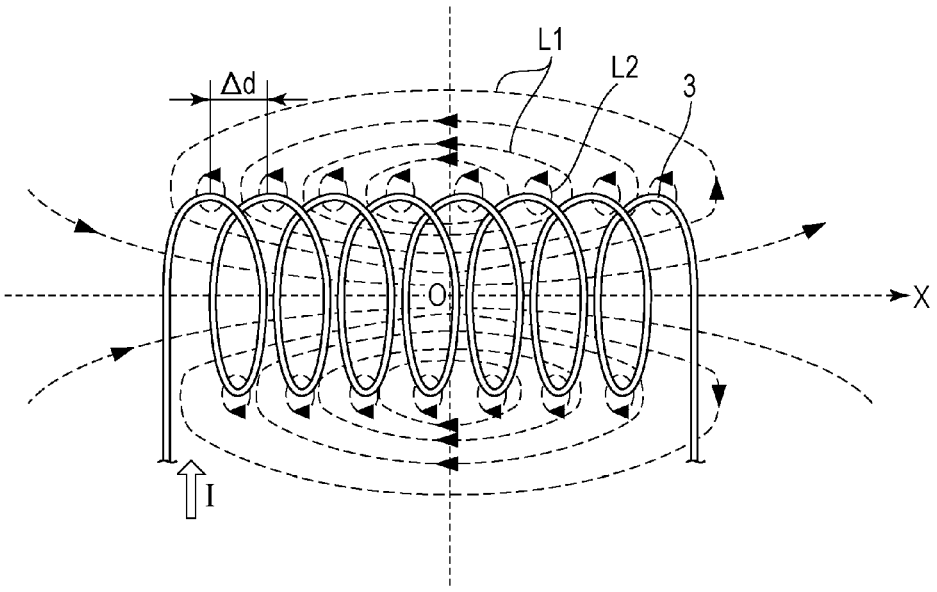
FIG. 4A is a schematic view of a magnetic field in the vicinity of a solenoid coil.
Figure 4B:
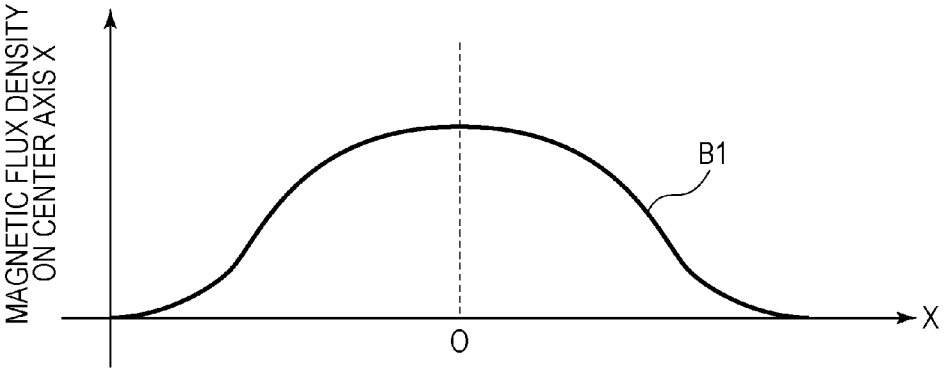
FIG. 4B is a schematic diagram of a magnetic flux density distribution at a solenoid center axis.

(3) Heat Generation Principle 3-1. Shape of Magnetic Force Line and Induced Electromotive Force First, the shape of a magnetic force line will be described. Note that, first, description will be made using a magnetic field shape in a common air-core solenoid coil. FIG. 4A is a schematic view of the air-core solenoid coil 3 serving as an exciting coil (in order to improve visibility, in FIGS. 4A and 4B, the number of turns is decreased, the shape is simplified), and of a magnetic field. The solenoid coil 3 has a shape with limited length and also a gap Δd, and a high-frequency current is applied to this coil. The direction of the present magnetic force line is a moment when current increases in a direction of arrow I. With the magnetic force line, the major portions pass through the center of the solenoid coil 3, and are connected at outer circumference while being leaked from the gap Δd. FIG. 4B illustrates a magnetic flux density distribution at the solenoid center axis X. As illustrated in a curve B1 of the graph, the magnetic flux density is the highest at a portion of central 0, and is low at the solenoid end portions. As a reason thereof, this is because there are leakages L1 and L2 of a magnetic force line from the gap Δd of the coil. The circumference magnetic field L2 near the coil is formed so as to go around the exciting coil 3. It is said that this circumference magnetic field L2 near the coil passes through a path unsuitable for effectively heating the cylindrical rotary member.

Figure 5A:
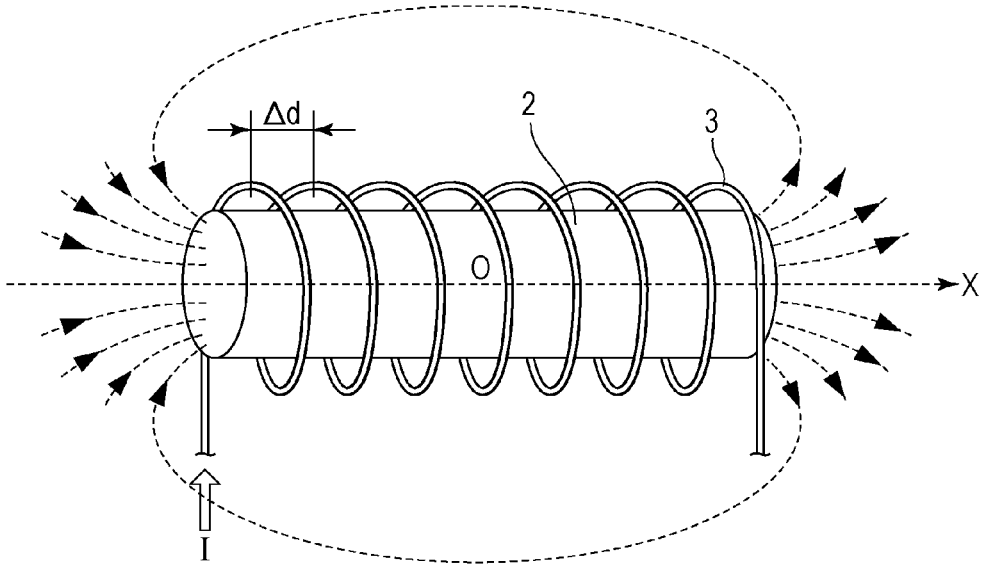
FIG. 5A is a schematic view of a magnetic field in the vicinity of a solenoid coil and a magnetic core.
Figure 5B:
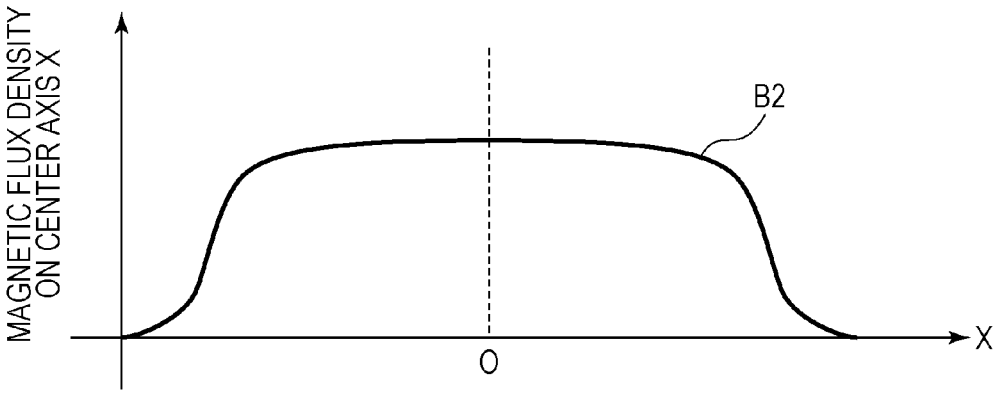
FIG. 5B is a schematic diagram of a magnetic flux density distribution at a solenoid center axis.

FIG. 5A is a correspondence diagram between the coil shape and a magnetic field in the event that a magnetic path is formed by inserting the magnetic core 2 in the center of the solenoid coil 3 having the same shape. In the same way as with FIGS. 4A and 4B, this is a moment when current increases in the direction of arrow I. The magnetic core 2 serves as a member configured to internally induce a magnetic force line generated at the solenoid coil 3 to form a magnetic path. The magnetic core 2 according to the first embodiment does not have circularity but has an end portion each of the longitudinal direction. Therefore, of magnetic force lines, the majority thereof becomes an opened magnetic path in a shape passing through the magnetic path in the solenoid coil center in a concentrated manner, and diffusing at the end portions in the longitudinal direction of the magnetic core 2. As compared to FIG. 4A, leakages of magnetic force lines at gaps Δd of the coil significantly decrease, the magnetic force lines output from both polarities become opened magnetic paths in a shape where they are connected far away at the outer circumference (disconnected at the end portions on the drawing). FIG. 5B illustrates a magnetic flux density distribution at a solenoid center axis X. With the magnetic flux density, as illustrated in a curve B2 on the graph, attenuation of the magnetic flux density decreases at the end portions of the solenoid coil 3 as compared to the B1, and the B2 has a shape approximate to a trapezoid.

3-2. Induced Electromotive Force

Figure 6A:
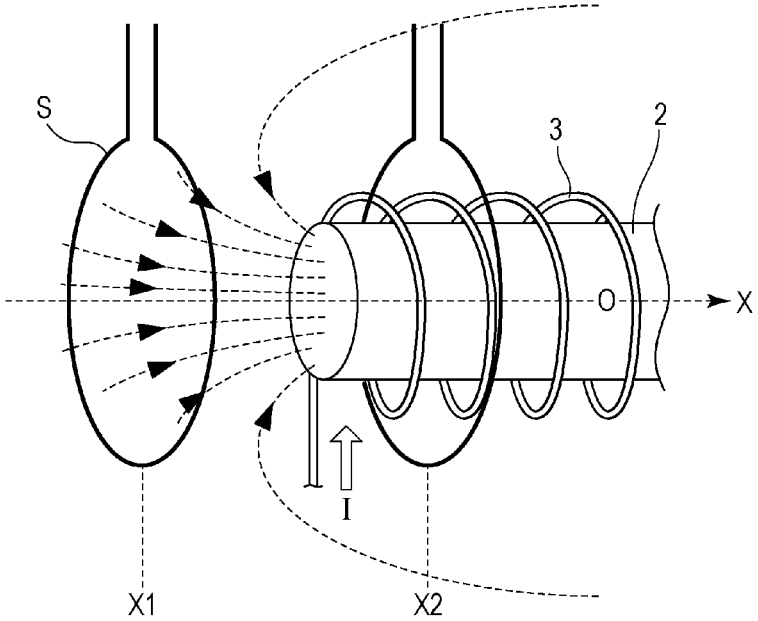
FIG. 6A is a schematic view of neighborhood of an end portion of a magnetic core of a solenoid coil.

The heat generation principle follows Faraday's law. Faraday's law is "When changing a magnetic field within a circuit, induced electromotive force which attempts to apply current to the circuit occurs, and the induced electromotive force is proportional to temporal change of a magnetic flux vertically penetrating the circuit." Let us consider a case where a circuit S of which the diameter is greater than the coil and magnetic core is disposed near an end portion of the magnetic core 2 of the solenoid core 3 illustrated in FIG. 6A, and a high-frequency alternating current is applied to the coil 3. In the event of having applied a high-frequency alternating current thereto, an alternating magnetic field (magnetic field where the size and direction repeatedly change over time) is formed around the solenoid coil. At that time, induced electromotive force generated at the circuit S is, in accordance with the following Expression (1), proportional to temporal change of a magnetic flux vertically penetrating the inside of the circuit S according to Faraday's law.

[Math. 1]

$$V = -N\frac{\Delta\Phi}{\Delta t} \tag{1}$$

V: induced electromotive force

N: the number of turns of the coil

ΔΦ/Δt: charge in a magnetic flux vertically penetrating the circuit at minute time Δt Specifically, in a state in which a direct current is applied to the exciting coil to form a static magnetic field, in the event that many more vertical components of magnetic force lines pass through the circuit S, temporal change in the vertical components of magnetic force lines at the time of applying a high-frequency alternating current to generate an alternating magnetic field also increases. As a result thereof, induced electromotive force to be generated also increases, and a current flows in a direction where change in a magnetic flux thereof is cancelled out. That is to say, as a result of having generated an alternating magnetic field, upon a current flowing, change in a magnetic flux is cancelled out, and forming a magnetic force line shape different from at the time of forming a static magnetic field. Also, the higher frequency of an alternating current is (i.e., the smaller the Δt is), this induced electromotive force V is apt to increase. Accordingly, electromotive force which can be generated with predetermined amount of magnetic fluxes significantly differs between a case where an alternating current with a low frequency of 50 to 60 Hz is applied to the exciting coil, and a case where an alternating current with a high frequency of 21 to 100 kHz is applied to the exciting coil. When changing the frequency of an alternating current to a high frequency, high electromotive force can be generated even with a few magnetic fluxes. Accordingly, when changing the frequency of an alternating current to a high frequency, the great amount of heat can be generated with a magnetic core of which the cross-sectional area is small, and accordingly, this is advantageous in the case of attempting to generate the great amount of head at a small fixing device. This is similar to a case where a transformer can be reduced in size by increasing the frequency of an alternating current. For example, with a transformer to be used for a low-frequency band (50 to 60 Hz), a magnetic flux Φ has to be increased by increase equivalent to Δt, and the cross-sectional area of the magnetic core has to be increased. On the other hand, with a transformer to be used for a high-frequency band (kHz), the magnetic flux Φ can be decreased by decrease equivalent to Δt, and the cross-sectional area of the magnetic core can be designed small.

As a conclusion of the above description, a high-frequency band of 21 to 100 kHz is used as the frequency of an alternating current, and accordingly, reduction in size of an image forming apparatus can be realized by reducing the cross-sectional area of the magnetic core.

In order to generate induced electromotive force at the circuit S with high efficiency by an alternating magnetic field, there has to be designed a state in which many more vertical components of magnetic force lines pass through the circuit S. However, with an alternating magnetic field, influence of a demagnetizing field at the time of induced electromotive force being generated at the coil, and so forth have to be taken into consideration, a phenomenon becomes complicated. The fixing device according to the present embodiment will be described later, but in order to design the fixing device according to the present embodiment, an argument is advanced with the shape of magnetic force lines in a state of a static magnetic field where no induced electromotive force has been generated, and accordingly, designing can be advanced with a simpler physics model. That is to say, the shape of magnetic force lines in a static magnetic field is optimized, whereby a fixing device can be designed wherein induced electromotive force is generated with high efficiency in an alternating magnetic field.

Figure 6B:
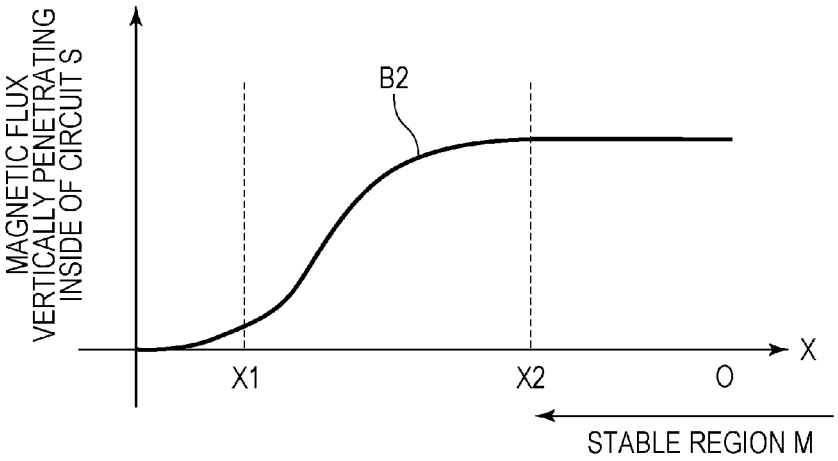
FIG. 6B is a schematic diagram of a magnetic flux density distribution at a solenoid center axis.
Figure 7A:
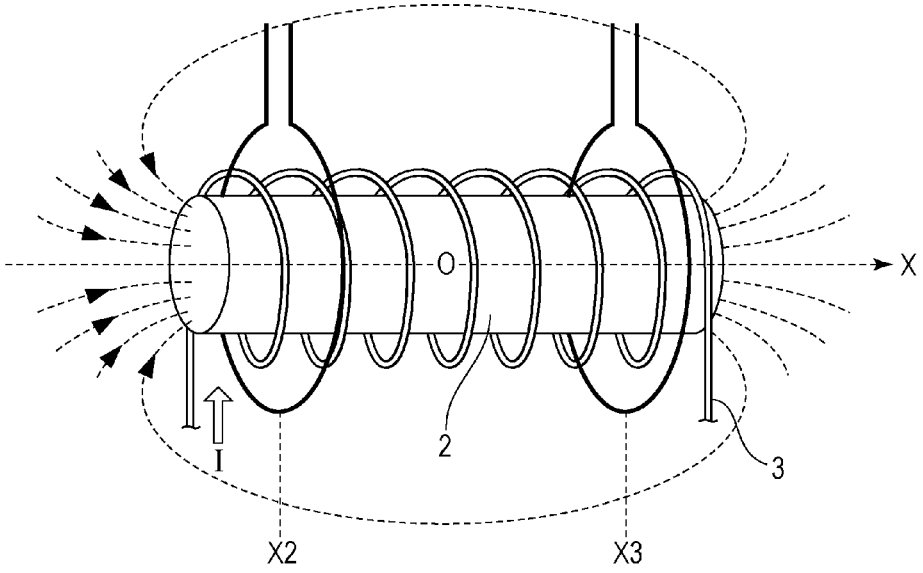
FIG. 7A is a schematic view of a coil shape and a magnetic field.
Figure 7B:
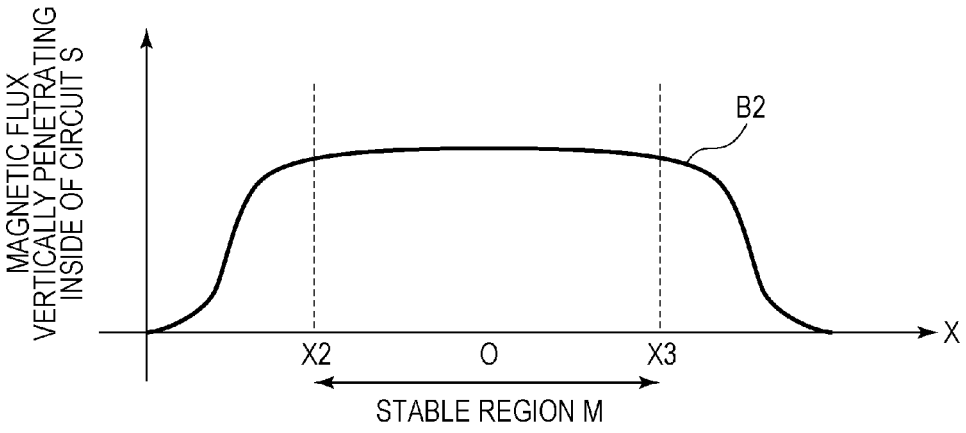
FIG. 7B is a schematic diagram of a region where a magnetic flux penetrating a circuit is stabilized.

FIG. 6B illustrates a magnetic flux density distribution at the solenoid center axis X. In the event of considering a case where a direct current has been applied to the coil to form a static magnetic field (magnetic field without temporal fluctuation), as compared to a magnetic flux when disposing the circuit S in a position X1, when the circuit S is disposed in a position X2, a magnetic flux which vertically penetrates the circuit S increases as illustrated in B2. In the position X2 thereof, almost all of magnetic force lines restrained by the magnetic core 2 are housed in the circuit S, and with a stable region M in a more positive direction in the X axis than the position X2, a magnetic flux which vertically penetrates the circuit is saturated to constantly become the maximum. The same can be applied to the end portion on the opposite side, as illustrated in a magnetic flux distribution in FIG. 7B, with a stable region M from the position X2 to X3 on the end portion on the opposite side, magnetic flux density which vertically penetrates the inside of the circuit S is saturated and stabilized. As illustrated in FIG. 7A, this stable region M exists within a region including the magnetic core 2.

Figure 8A:
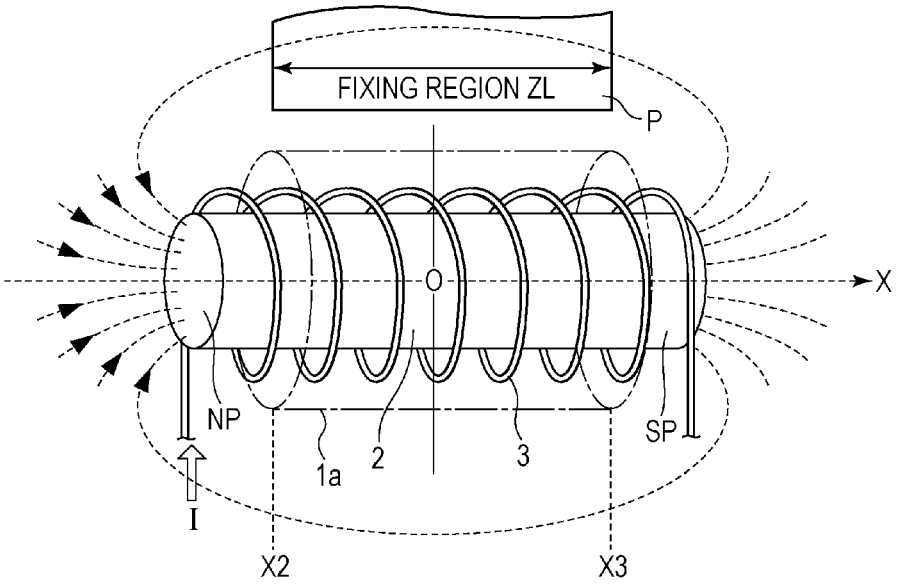
FIG. 8A is a schematic view of a coil shape and a magnetic field.
Figure 8B:
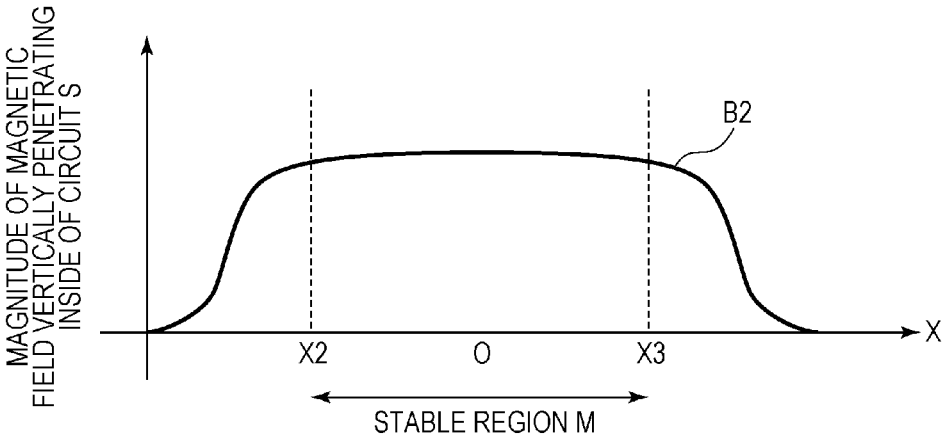
FIG. 8B is a schematic diagram of a region where a magnetic flux is stabilized.

As illustrated in FIG. 8A, with regard to magnetic force lines (magnetic flux) configuration in the present embodiment, in the case of having formed a static magnetic field, the cylindrical rotary member 1*a* is covered with a region from the X2 to X3. Next, there is designed the shape of magnetic force lines where magnetic force lines pass over the outside of the cylindrical rotary member from one end (magnetic polarity NP) to the other end (magnetic polarity SP) of the magnetic core 2. Next, an image on a recording material is heated using the stable region M. Accordingly, with the first embodiment, at least length in the longitudinal direction of the magnetic core 2 for forming a magnetic path has to be configured so as to be longer than the maximum image heating region ZL of the recording material P. As a further preferable configuration, it is desirable that lengths in the longitudinal directions of both of the magnetic core 2 and exciting coil 3 are configured so as to be longer than the maximum image heating region ZL. Thus, the toner image on the recording material P may be heated evenly up to the end portions. Also, length in the longitudinal direction of the cylindrical rotary member 1*a* has to be configured so as to be longer than the maximum image heating region ZL. With the present embodiment, in the event of having formed a solenoid magnetic field illustrated in FIG. 8A, it is important that the two magnetic polarities NP and SP protrude on an outer side than the maximum image heating region ZL. Thus, even heat can be generated in a range of the ZL.

Note that the maximum conveyance region of a recording material may be employed instead of the maximum image heating region.

With the present embodiment, both end portions in the longitudinal direction of the magnetic core 2 each protrude to the outside from an end face in the generatrix direction of the fixing film 1. Thus, heat quantity of the entire region in the generatrix direction of the fixing film 1 can be stabilized.

An electromagnetic induction heating system fixing device according to the related art has been designed with technical thought such that a magnetic force line is injected into the material of a cylindrical rotary member. On the other hand, the electromagnetic induction heating system according to the first embodiment heats the entire region of the cylindrical rotary member in a state in which a magnetic flux which vertically penetrates the circuit S becomes the maximum, that is, has been designed with technical thought such that magnetic force lines pass over the outside the cylindrical rotary member.

Figure 9A:
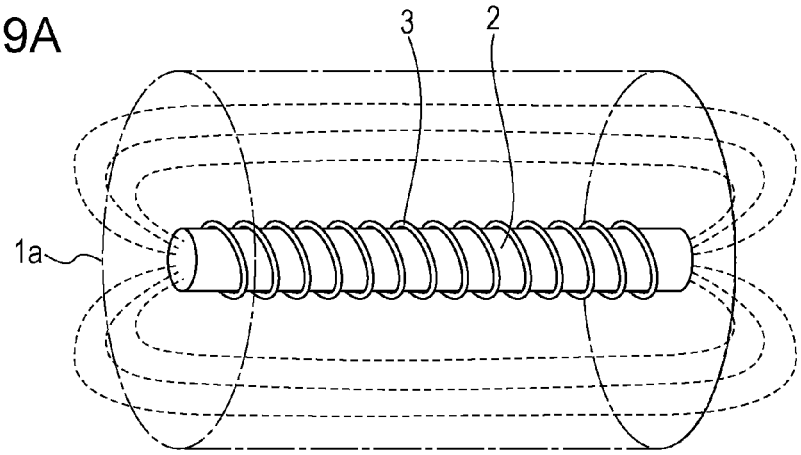
FIG. 9A is a diagram illustrating an example of a magnetic force lines defeat a purpose of a first embodiment.
Figure 9B:
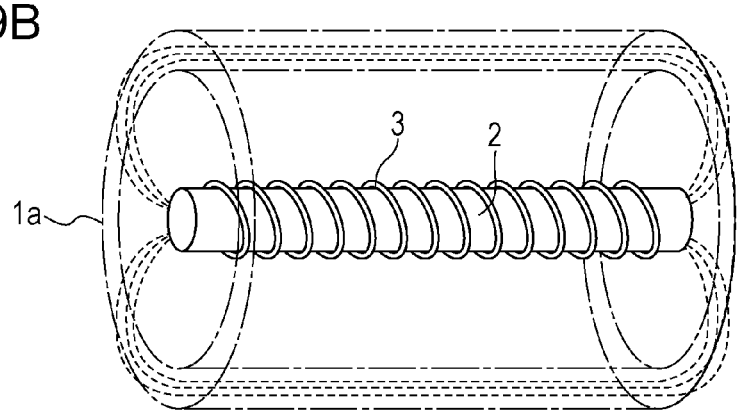
FIG. 9B is a diagram illustrating an example of a magnetic force lines defeat the purpose of the first embodiment.

Hereinafter, there will be illustrated three examples of a magnetic force line shape unsuitable for a purpose of the present embodiment. FIG. 9A illustrates an example wherein magnetic force lines pass through the inside of the cylindrical rotary member (region between the cylindrical rotary member and magnetic core). In this case, with magnetic force lines passing through the inner side of the cylindrical rotary member, magnetic force lines which go leftward and magnetic force lines which go rightward in the drawing are intermingled, and accordingly, both are cancelled out each other, and according to Faraday's law, the integration value of Φ decreases, heat efficiency decreases, and accordingly which is undesirable. Such a magnetic force line shape is caused in the event that the cross-sectional area of the magnetic core is small, in the event that the relative permeability of the magnetic core is small, in the event that the magnetic core is divided in the longitudinal direction to form a great gap, and in the event that the diameter of the cylindrical rotary member is great. FIG. 9B illustrates an example wherein magnetic force lines pass through the inside of the material of cylindrical rotary member. Such a state is readily caused in the event that the material of the cylindrical rotary member is a material having high relative permeability such as nickel, iron, or the like.

As a conclusion of the above description, a magnetic force line shape unsuitable for a purpose of the present embodiment is formed in the following cases of (I) to (V), and this is a fixing device according to the related art wherein heat is generated with Joule's heat due to eddy current loss which occurs within the material of the cylindrical rotary member.

Figure 9C:
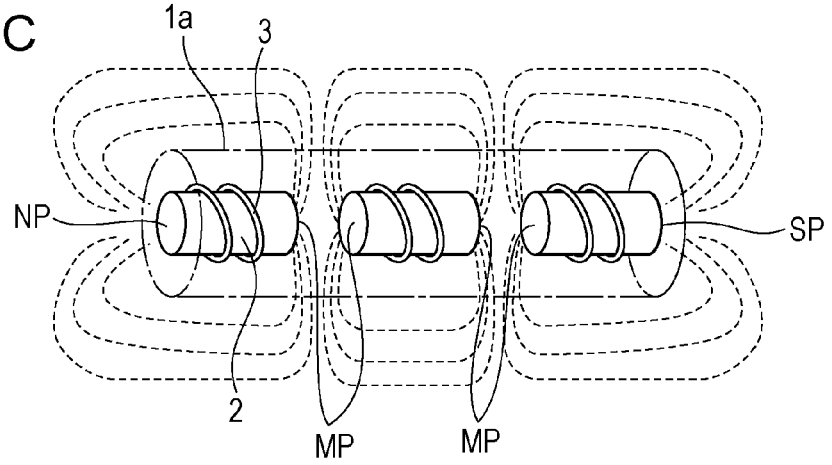
FIG. 9C is a diagram illustrating an example of a magnetic force lines defeat the purpose of the first embodiment.

(I) The relative permeability of the material of the cylindrical rotary member is great (II) The cross-sectional area of the cylindrical rotary member is great (III) The cross-section area of the magnetic core is small (IV) The relative permeability of the magnetic core is small (V) The magnetic core is divided in the longitudinal direction to form a great gap FIG. 9C is a case where the magnetic core is divided into a plurality in the longitudinal direction, and a magnetic polarity is formed in a location MP other than both end portions NP and SP of the magnetic core. In order to achieve a purpose of the present embodiment, it is desirable to form a magnetic path so as to take only two of the NP and SP as magnetic polarities, and it is undesirable to divide the magnetic core into two or more in the longitudinal direction to form a magnetic polarity MP. According to a later-described reason in 3-3, there may be a case where magnetic resistance of the entire magnetic core is increased to prevent a magnetic path from being formed, and a case where heat quantity in the vicinity of the magnetic polarity MP portion decreases to prevent an image from being evenly heated. In the event of dividing the magnetic core, a range (will be described later in 3-6) is restricted where magnetic resistance is reduced and permeance is kept in great so that the magnetic core sufficiently serves as a magnetic path.

3-3. Magnetic Circuit and Permeance

Next, description will be made regarding a specific design guide for achieving the heat generation principle described in 3-2 which is an essential feature of the present embodiment. To that end, ease of passage of magnetism to the generatrix direction of the cylindrical rotary member of the components of the fixing device has to be expressed with a shape coefficient. The shape coefficient thereof uses "permeance" of "a magnetic circuit model in a static magnetic field". First, description will be made regarding the way of thinking for a common magnetic circuit. A closed circuit of a magnetic path where magnetic force lines principally pass will be referred to as a magnetic circuit against an electric circuit. At the time of calculating a magnetic flux in a magnetic circuit, this may be performed in accordance with calculation of a current of an electric circuit. A basic formula of a magnetic circuit is the same as with the Ohm's law regarding electric circuits, and let us say that all magnetic force lines are Φ, electromotive force is V, and magnetic resistance is R, these three elements have a relation of $$\text{All magnetic force lines } \Phi = \text{electromotive force } V / \text{magnetic resistance } R \tag{2}$$

(accordingly, a current in an electric circuit corresponds to all of magnetic force lines Φ in a magnetic circuit, electromotive force in an electric circuit corresponds to electromotive force V in a magnetic circuit, and electric resistance in an electric circuit corresponds to magnetic resistance in a magnetic circuit). However, in order to comprehensively describe the principle, description will be made using permeance P which is an inverse number of the magnetic resistance R. Accordingly, the above Expression (2) is replaced with $$\text{All magnetic force lines } \Phi = \text{electromotive force } V \times \text{permeance } P \tag{3}$$

When assuming that length of a magnetic path is B, the cross-sectional area of the magnetic path is S, and permeability of the magnetic path is μ, this permeance P is represented with $$\text{permeance } P = \text{permeability } \mu \times \text{magnetic path cross-sectional area } S / \text{magnetic path length } B \tag{4}$$

The permeance P indicates that the shorter the magnetic path length B, and the greater the magnetic path cross-sectional area S and permeability μ, the greater the permeance P, and many more magnetic force lines Φ are formed in a portion where the permeance P is great.

As illustrated in FIG. 8A, designing is made so that the majority of magnetic force lines output from one end in the longitudinal direction of the magnetic core in a static magnetic field passes over the outside of the cylindrical rotary member to return to the other end of the magnetic core. At the time of designing thereof, it is desirable that the fixing device is regarded as a magnetic circuit, and permeance of the magnetic core 2 is set sufficiently great, and also, permeance of the cylindrical rotary member and the inner side of the cylindrical rotary member is set sufficiently small.

Figure 10A:
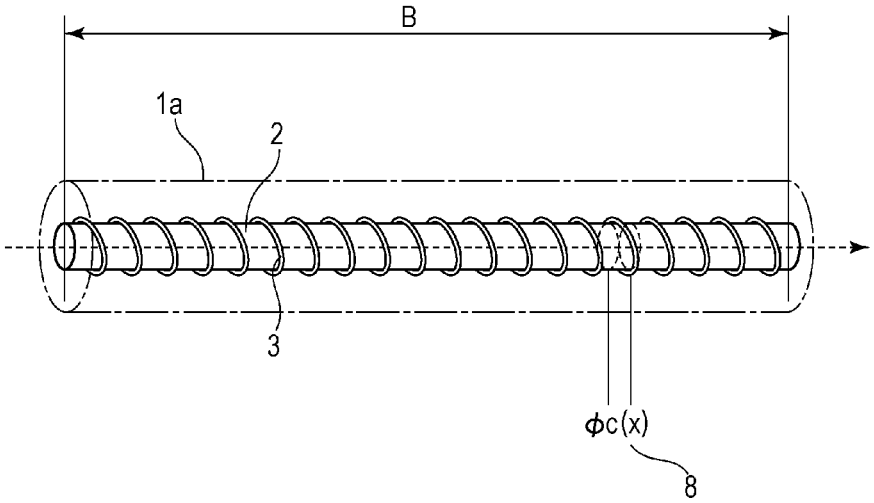
FIG. 10A is a schematic view of a structure where a finite-length solenoid is disposed.
Figure 10B:
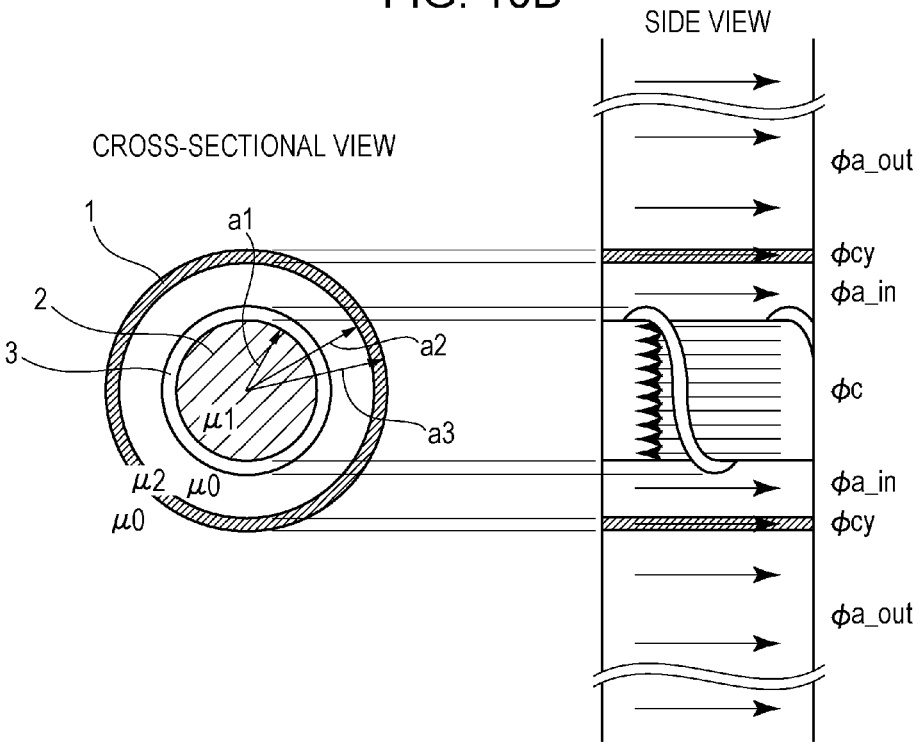
FIG. 10B is a cross-sectional view and a side view of the structure.

In FIGS. 10A and 10B, the cylindrical rotary member (electroconductive layer) will be referred to as cylinder body. FIG. 10A is a structure where the magnetic core 2 where the radius is a1 m and the length is B m and the relative permeability is μ1, and a limited-length solenoid where the exciting coil 3 of which the number of turns is N times are disposed within the cylinder body 1*a*. Here, the cylinder body is a conductor where the length is B m, the cylinder body inner side radius is a2 m, and the cylinder body outer side radius is a3 m, and the relative permeability is μ2. Let us say that the vacuum permeability on the inner side and outer side of the cylinder body is $\mu_0$ H/m. When applying a current I A to the solenoid coil, a magnetic flux 8 to be generated per unit length of an optional position of the magnetic core is ϕc (x).

FIG. 10B is an enlarged view of a cross section perpendicular to the longitudinal direction of the magnetic core 2. Arrows in the drawing represent, when applying a current I to the solenoid coil, the air inside the magnetic core, the air inside and outside the cylinder body, and magnetic force lines parallel to the longitudinal direction of the magnetic core passing through the cylinder body. A magnetic flux passing through the magnetic core is ϕc (=ϕc (x)), a magnetic flux passing through the air on the inner side of the cylinder body is ϕa_in, a magnetic flux passing through the cylinder body is ϕcy, and a magnetic flux passing through the air on the outer side of the cylinder body is ϕa_out.

Figure 11A:
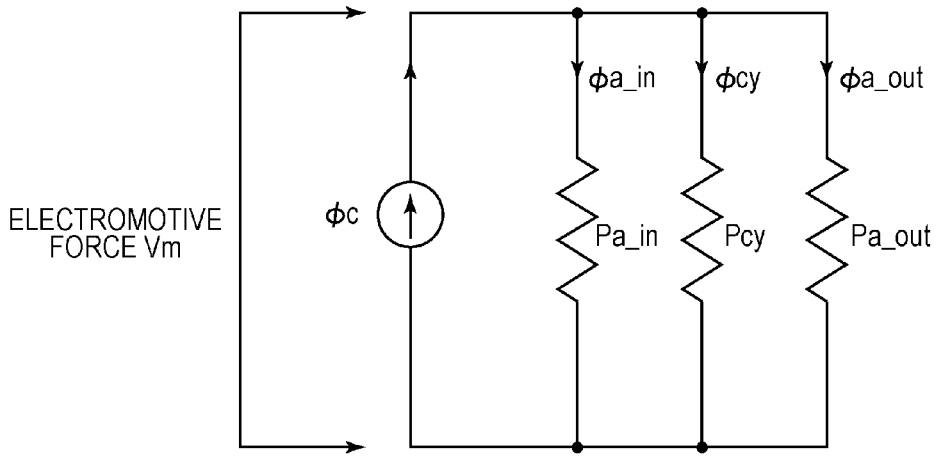
FIG. 11A is a magnetic equivalent circuit diagram of space including a core, a coil, and a cylinder body per unit length.

FIG. 11A illustrates a magnetic equivalent circuit in space including the core, coil, and cylinder body per unit length illustrated in FIG. 10B. Electromotive force to be generated by the magnetic flux ϕc of the magnetic core is Vm, the permeance of the magnetic core is Pc, the permeance within the air on the inner side of the cylinder body is Pa_in, the permeance within the cylinder body is Pcy, and the permeance of the air on the outer side of the cylinder body is Pa_out. When the permeance Pc of the magnetic core is sufficiently great as compared to the permeance Pa_in within the cylinder body or the permeance Pcy of the cylinder body, the following relation holds.

$$\phi c = \phi a_\text{in} + \phi cy + \phi a_\text{out} \tag{5}$$

That is to say, this means that a magnetic flux passing through the inside of the magnetic core necessarily passes through one of ϕa_in, ϕcy, and ϕa_out and returns to the magnetic core.

$$\phi c = Pc \cdot Vm \tag{6}$$

$$\phi a_\text{in} = Pa_\text{in} \cdot Vm \tag{7}$$

$$\phi cy = Pcy \cdot Vm \tag{8}$$

$$\phi a_\text{out} = Pa_\text{out} \cdot Vm \tag{9}$$

Accordingly, when substituting (6) to (9) for (5), Expression (5) becomes as follows.

$$Pc \cdot Vm = Pa_\text{in} \cdot Vm + Pcy \cdot Vm + Pa_\text{out} \cdot Vm = (Pa_\text{in} + Pcy + Pa_\text{out}) \cdot Vm \quad Pc - Pa_\text{in} - Pcy - Pa_\text{out} = 0 \tag{10}$$

According to FIG. 10B, if we say that the cross-sectional area of the magnetic coil is Sc, the cross-sectional area of the air inside that cylinder body is Sa_in, and the cross-sectional area of the cylinder body is Scy, permeance per unit length of each region can be represented with "permeability×cross-sectional area" as follows, and unit thereof is H·m.

$$Pc = \mu 1 \cdot Sc = \mu 1 \cdot \pi (a1)^2 \tag{11}$$

$$Pa_\text{in} = \mu 0 \cdot Sa_\text{in} = \mu 0 \cdot \pi ((a2)^2 - (a1)^2) \tag{12}$$

$$Pcy = \mu 2 \cdot Scy = \mu 2 \cdot \pi \cdot ((a3)^2 - (a2)^2) \tag{13}$$

Further, Pc−Pa_in−Pcy−Pa_out=0 holds, and accordingly, permeance within the air outside the cylinder body can be represented as follows.

$$Pa_\text{out} = Pc - Pa_\text{in} - \text{Pcy} = \mu 1 \cdot Sc - \mu 0 \cdot Sa_\text{in} - \mu 2 \cdot Scy = \pi \cdot \mu 1 \cdot (a1)^2 - \pi \cdot \mu 0 \cdot ((a2)^2 - (a1)^2) - \pi \cdot \mu 2 \cdot ((a3)^2 - (a2)^2) \tag{14}$$

A magnetic flux passing through each region is, as illustrated in Expression (5) to Expression (10), proportional to permeance of each region. When employing Expressions (5) to (10), a ratio of a magnetic flux passing through each region can be calculated as with later-described Table 1. Note that, in the event that a material other than the air exists in the hollow portion of the cylinder body as well, permeance can be obtained from a cross-sectional area and permeability thereof in the same method as with the air within the cylinder body. Description will be made later regarding how to calculate permeance in this case.

With the present embodiment, as "a shape coefficient for expressing ease of passage of magnetism to the longitudinal direction of the cylindrical rotary member", "permeance per unit length" is used. Table 1 calculates, with the configuration of the present embodiment, permeance per unit length from a cross-sectional area and permeability for the magnetic core, film guide (nip portion forming member), air within the cylinder body, and cylinder body using Expressions (5) to (10). Finally, permeance of the air outside the cylinder body is calculated using Expression (14). With the present calculation, all of "members which can be included in the cylinder body and serve as a magnetic path" are taken into consideration. The present calculation indicates what percentage a ratio of the permeance of each portion is with the value of permeance of the magnetic core as 100%. According to this, regarding in which portion a magnetic path is readily formed, and which portion a magnetic flux passes through, digitalization can be made using a magnetic circuit.

Magnetic resistance R (inverse number of permeance P) may be employed instead of permeance. Note that, in the event of arguing using magnetic resistance, magnetic resistance is simply an inverse number of permeance, and accordingly, the magnetic resistance R per unit length can be represented with "1/(permeability×cross-sectional area)", and unit thereof is "1/(H·m)".

Hereinafter, details (material and numeric values) of the configuration of the first embodiment to be used for digitization will be listed.

Magnetic core 2: ferrite (relative permeability 1800), diameter 14 mm (cross-sectional area $1.5\times10^{-4}$ $m^2$)

Film guide: PPS (relative permeability 1), cross-sectional area $1.0\times10^{-4}$ $m^2$ Cylindrical rotary member (electroconductive layer) 1*a*: aluminum (relative permeability 1), diameter 24 mm, thickness 20 μm (cross-sectional area $1.5\times10^{-6}$ $m^2$)

The elastic layer 1*b* of the fixing film, and the surface layer 1*c* of the fixing film are in an outer side than the cylindrical rotary member (electroconductive layer) 1*a* which is an exothermic layer, and also do not contribute to generation of heat. Accordingly, permeance (or magnetic resistance) does not have to be calculated, and with the present magnetic circuit model, the elastic layer 1*b* of the fixing film, and the surface layer 1*c* of the fixing film can be handled by being included in "air outside the cylinder body".

"Permeance and magnetic resistance per unit length" of the components of the fixing device calculated from the above dimensions and relative permeability will be summarized in the following Table 1.

TABLE 1

Magnetic Permeance in First Embodiment

| ITEM | UNIT | MAGNETIC CORE C | FILM GUIDE | AIR INSIDE CYLINDER BODY a_in | CYLINDER BODY Cy | AIR OUTSIDE CYLINDER BODY a_out |
|---|---|---|---|---|---|---|
| CROSS-SECTIONAL AREA | m^2 | 1.5E−04 | 1.0E−04 | 2.0E−04 | 1.5E−08 | |
| RELATIVE PERMEABILITY | | 1800 | 1 | 1 | 1 | |
| PERMEABILITY | H/m | 2.3E−3 | 1.3E−6 | 1.3E−6 | 1.3E−6 | |
| PERMEANCE PER UNIT LENGTH | H · m | 3.5E−07 | 1.3E−10 | 2.5E−10 | 1.9E−12 | 3.5E−07 |
| MAGNETIC RESISTANCE PER UNIT LENGTH | 1/(H · m) | 2.9E+06 | 8.0E+09 | 4.0E+09 | 5.3E+11 | 2.9E+06 |
| RATIO OF MAGNETIC FLUX | % | 100.0% | 0.0% | 0.1% | 0.0% | 99.9% |

With regard to "permeance per unit length", description will be made regarding correspondence relations between a magnetic equivalent circuit diagram in FIG. 11A and actual numeric values. Permeance Pc per unit length of the magnetic core is represented as follows (Table 1).

$$Pc=3.5\times10^{-7}\ \mathrm{H\cdot m}$$

Permeance Pa_in per unit length of a region between the electroconductive layer and magnetic core is composition with permeance per unit length of the film guide and permeance per unit length of the air within the cylinder body, and accordingly represented as follows (Table 1).

$$Pa_in=1.3\times10^{-10}+2.5\times10^{-10}\ \mathrm{H\cdot m}$$

Permeance Pcy per unit length of the electroconductive layer is a cylinder body described in Table 1, and is represented as follows.

$$Pcy=1.9\times10^{-12}\ \mathrm{H\cdot m}$$

Pa_out is the air outside the cylinder body described in Table 1, and is represented as follows.

$$Pa_out=Pc-Pa_in-Pcy,=3.5\times10^{-7}\ \mathrm{H\cdot m}$$

Next, description will be made regarding a case where magnetic resistance which is an inverse number of permeance. Magnetic resistance per unit length of the magnetic core is as follows.

$$Rc=2.9\times10^{6}\ 1/(\mathrm{H\cdot m})$$

Magnetic resistance of a region between the electroconductive layer and magnetic core is as follows.

$$Ra_in=1/Pa_in=2.7\times10^{9}\ 1/(H\cdot m)$$

Note that, in the event of directly calculating magnetic resistance from reluctance Rf of the film guide=$8.0\times10^{9}$ 1/(H·m) and reluctance Ra of the air inside the cylinder body=$4.0\times10^{9}$ 1/(H·m), expressions of combined reluctance of parallel circuits have to be used.

$$\frac{1}{R_{a_{in}}}=\frac{1}{R_f}+\frac{1}{R_a}$$

$$\frac{1}{R_{a_{in}}}=\frac{R_a\times R_f}{R_a+R_f}$$

It is the cylinder body described in Table 1 which corresponds to Rcy, and Rcy=$5.3\times10^{11}$ H·m holds. Also, the cross-sectional area of the air of a region between the cylinder body and the magnetic core is calculated by subtracting the cross-sectional area of the magnetic core and the cross-sectional area of the film guide from the cross-sectional area of the hollow portion of which the diameter is 24 mm. In general, a standard of a permeance value at the time of using the present embodiment as a fixing device is substantially as follows.

With regard to the magnetic core, in the event of using sintering ferrite, the relative permeability is substantially around 500 to 10000, and the cross section becomes around 5 mm to 20 mm. Accordingly, permeance per unit length of the magnetic core becomes $1.2\times10^{-8}$ to $3.9\times10^{-6}$ H·m. In the event of employing another ferromagnetic, substantially around 100 to 10000 can be selected as the relative permeability.

In the event of employing a resin as the material of the film guide, the relative permeability is substantially 1.0, and the cross-sectional area becomes around 10 $mm^2$ to 200 $mm^2$. Accordingly, permeance per unit length becomes $1.3\times10^{-11}$ to $2.5\times10^{-10}$ H·m.

With regard to the air inside the cylinder body, the relative permeability of the air is substantially 1, and an approximate cross-sectional area becomes difference between the cross-sectional area of the cylindrical rotary member and the cross-sectional area of the core, and accordingly becomes a cross-sectional area equivalent to 10 mm to 50 mm. Accordingly, permeance per unit length becomes $1.0\times10^{-11}$ to $1.0\times10^{-10}$ H·m. The air inside the cylinder body mentioned here is a region between the cylindrical rotary member (electroconductive layer) and the magnetic core.

With regard to the cylindrical rotary member (electroconductive layer), in order to reduce warm-up time, it is desirable that heat capacity is smaller. Accordingly, it is desirable that the thickness is 1 to 50 μm, and the diameter is around 10 to 100 mm. Permeance per unit length in the event of employing nickel (relative permeability 600) which is a magnetic material as the material becomes $4.7\times10^{-12}$ to $1.2\times10^{-9}$ H·m. Permeance per unit length in the event of employing a nonmagnetic material as the material becomes $8.0\times10^{-15}$ to $2.0\times10^{-12}$ H·m. The above is a range of approximate "permeance per unit length" of the fixing device according to the present embodiment.

Here, in the event of replacing the above permeance values with a magnetic resistance value, the results thereof become as follows. The range of magnetic resistance of each of the magnetic core, film guide, and the air inside the cylinder body is $2.5\times10^{5}$ to $8.1\times10^{7}$ 1/(H·m), $4.0\times10^{9}$ to $8.0\times10^{10}$ 1/(H·m), and $1.0\times10^{8}$ to $1.0\times10^{10}$ 1/(H·m).

With regard to the cylindrical rotary member, magnetic resistance per unit length in the event of employing nickel (relative permeability 600) which is a magnetic material as the material becomes $8.3\times10^{8}$ to $2.1\times10^{11}$ 1/(H·m), and magnetic resistance per unit length in the event of employing a nonmagnetic material as the material becomes $5.0\times10^{11}$ to $1.3\times10^{14}$ 1/(H·m).

The above is a range of approximate "magnetic resistance per unit length" of the fixing device according to the present embodiment.

Figure 11B:
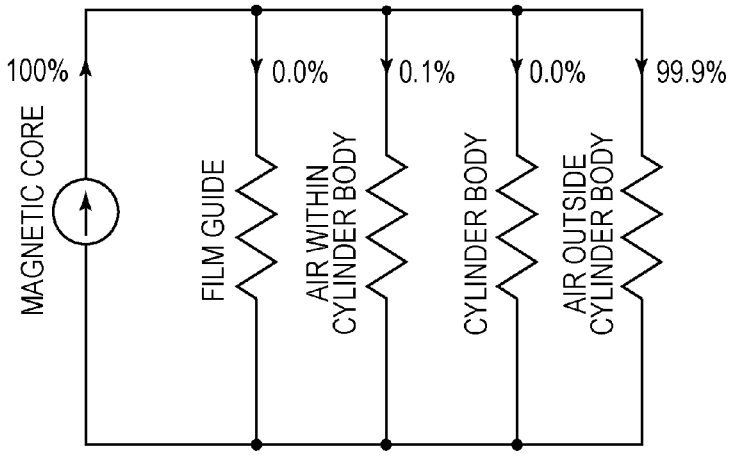
FIG. 11B is a magnetic equivalent circuit diagram of a configuration according to the first embodiment.

Next, the magnetic equivalent circuit will be described with reference to "ratio of magnetic flux" in Table 1 and FIG. 11B. With the present embodiment, on a magnetic circuit model in a static magnetic field, a path where 100% of magnetic force lines output from one end of the magnetic core passing through the inside of the magnetic core pass has the following contents. Of 100% of magnetic force lines output from one end of the magnetic core passing through the magnetic core, 0.0% passes through the film guide, 0.1% passes through the air inside the cylinder body, 0.0% passes through the cylinder body, and 99.9% passes through the air outside the cylinder body. Hereinafter, this state will be represented as "ratio of magnetic flux outside the cylinder body: 99.9%". Note that, though a reason will be described later, in order to achieve a purpose of the present embodiment, it is desirable that the value of "a ratio of magnetic force lines passing over the outside the cylinder member, on a magnetic circuit model in a static magnetic field" approximates to 100% as much as possible.

"A ratio of magnetic force lines passing over the outside the cylinder member" is, at the time of applying a direct current to the exciting coil to form a static magnetic field, of magnetic force lines which pass through the inside of the magnetic core in the generatrix direction of the film and output from one end in the longitudinal direction of the magnetic core, a ratio of magnetic force lines pass over the outside the cylindrical rotary member and return to the other end of the magnetic core.

When representing with parameters described in Expressions (5) to (10), "a ratio of magnetic force lines passing over the outside the cylinder member" is a ratio of Pa_out against Pc (=Pa_out/Pc).

In order to create a configuration having a high "ratio of magnetic force lines outside the cylinder body", specifically, the following designing techniques are desirable.

Technique 1: Increase permeance of the magnetic core (increase the cross-sectional area of the magnetic core, increase the relative permeability of the material)

Technique 2: Reduce permeance within the cylinder body (decrease the cross-sectional area of the air portion)

Technique 3: Prevent a member having great permeance from being disposed within the cylinder body, such as iron or the like Technique 4: Reduce the permeance of the cylinder body (reduce the cross-sectional area of the cylinder body, reduce the relative permeability of the material to be used for the cylinder body)

According to Technique 4, it is desirable that the material of the cylinder body is low in relative permeability μ. At the time of employing a material having high relative permeability μ as the cylinder body, the cross-sectional area of the cylinder body has to be reduced as small as possible. This is opposite of a fixing device according to the related art wherein the greater the cross-sectional area of the cylinder body, the more the number of magnetic force lines which penetrate the cylinder body increase, the higher heat efficiency becomes. Also, though it is desirable to prevent a member having great permeance from being disposed within the cylinder body, in the event that iron or the like has no choice but to be disposed, "a ratio of magnetic force lines passing over the outside the cylinder member" has to be controlled by reducing the cross-sectional area, or the like.

Note that there may also be a case where the magnetic core is divided into two or more in the longitudinal direction, and a gap is provided between the divided magnetic cores. In such a case, in the event that this gap is filled with air or a medium having smaller relative permeability than the relative permeability of the magnetic core such as a medium of which the relative permeability is regarded as 1.0, the magnetic resistance of the entire magnetic core increases to decrease magnetic path forming capability. Accordingly, in order to achieve the present embodiment, the gaps of the magnetic core have to be severely managed. A method for calculating the permeance of the magnetic core becomes complicated. Hereinafter, description will be made regarding a method for calculating permeance of the entire magnetic core in the event of dividing the magnetic core into two or more and arraying these with an equal interval sandwiching a gap or sheet-shaped nonmagnetic material therebetween. In this case, it is necessary to derive magnetic resistance of the entirety in the longitudinal direction, to obtain magnetic resistance per unit length by dividing the derived magnetic resistance by the entire length, and to obtain permeance per unit length by taking an inverse number thereof.

Figure 12:
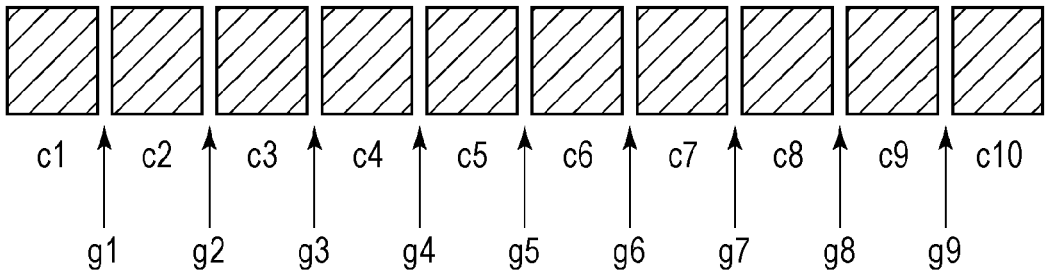
FIG. 12 is a schematic view of a magnetic core and a gap.

First, a longitudinal configuration diagram of the magnetic core is illustrated in FIG. 12. With magnetic cores c1 to c10, the cross-sectional area is Sc, permeability is μc, and longitudinal dimension per a divided magnetic core is Lc, and with gaps g1 to g9, the cross-sectional area is Sg, permeability is μg, and longitudinal dimension per one gap is Lg. At this time, magnetic resistance Rm_all of the longitudinal entirety is give by the following expressions.

$$Rm_\text{all}=(Rm_c1+Rm_c2++\ldots Rm_c10)+(Rm_g1+Rm_g2+\ldots+Rm_g9) \quad (15)$$

In the case of the present configuration, the shape and material of the magnetic core and gap width are even, and accordingly, if we say that a total of addition of Rm_c is ΣRm_c, and a total of addition of Rm_g is ΣRm_g, Expression (15) is represented as follows.

$$Rm_\text{all}=(\Sigma Rm_c)+(\Sigma Rm_g) \quad (16)$$

If we say that the longitudinal dimension of the magnetic core is Lc, permeability is μc, cross-sectional area is Sc, longitudinal dimension of the gap is Lg, permeability is μg, and cross-sectional area is Sg, $$Rm_c=Lc/(\mu c\cdot Sc) \quad (17)$$

$$Rm_g=Lg/(\mu g\cdot Sg) \quad (18)$$

These are substituted for Expression (16), and accordingly, magnetic resistance Rm_all of the entire longitudinal dimension becomes $$Rm_\text{all}=(\Sigma Rm_c)+(\Sigma Rm_g)=(Lg/(\mu c\cdot Sc))\times 10+(Lg/(\mu g\cdot Sg))\times 9 \quad (19)$$

If we say that a total of addition of Lc is ΣLc, and a total of addition of Lg is ΣLg, magnetic resistance Rm per unit length becomes $$Rm=Rm_\text{all}/(\Sigma Lc+\Sigma Lg)=Rm_\text{all}/(L\times 10+Lg\times 9) \quad (20)$$

Permeance Pm per unit length is obtained as follows.

$$Pm=1/Rm=(\Sigma Lc+\Sigma Lg)/Rm_\text{all}=(\Sigma Lc+\Sigma Lg)/[\{\Sigma Lc/(\mu c+Sc)\}+\{\Sigma Lg/(\mu g+Sg)\}] \quad (21)$$

ΣLc: total of lengths of divided magnetic cores
μc: permeability of magnetic core
Sc: cross-sectional area of magnetic core
ΣLg: total of lengths of gaps
μg: permeability of gap
Sg: cross-sectional area of gap According to Expression (21), increasing the gap Lg leads to increase in magnetic resistance of the magnetic core (deterioration in permeance). In order to configure the fixing device according to the present embodiment, designing is desirable so as to reduce the magnetic resistance of the magnetic core (so as to increase permeance) from the perspective of heat generation, and accordingly, it is not so desirable to provide gaps. However, there may be a case where in order to prevent the magnetic core from being readily broken, the magnetic core is divided into two or more to provide gaps. In this case, designing is performed so as to reduce the gaps Lg as small as possible (preferably around 50 μm or smaller), and so as not to deviate from design conditions for permeance and magnetic resistance described later, whereby a purpose of the present invention can be achieved.

3-4. Circumference Direction Current within Cylindrical Rotary Member

In FIG. 8A, the magnetic core 2, exciting coil 3, and cylindrical rotary member (electroconductive layer) 1*a* are concentrically disposed from the center, and when a current increases in arrow I direction within the exciting coil 3, eight magnetic force lines pass through the magnetic core 2 in a conceptual diagram.

Figure 13A:
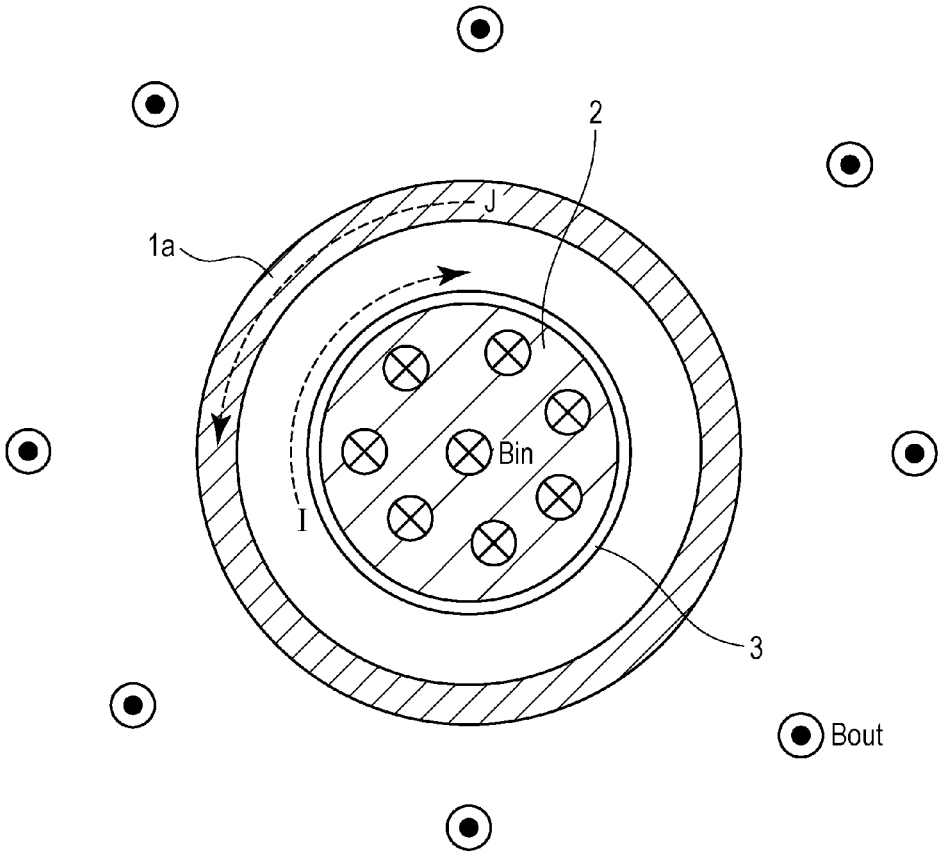
FIG. 13A is a cross-sectional schematic view of current and magnetic field within a cylindrical rotary member.

FIG. 13A illustrates a conceptual diagram of a cross-sectional configuration in the position O in FIG. 8A. Magnetic force lines Bin which pass through the magnetic path are illustrated with arrows (eight x-marks) toward the depth direction in the drawing. Arrows Bout (eight dot marks) toward the front side in the drawing represent magnetic force lines returning outside the magnetic path at the time of forming a static magnetic field. According to this, the number of the magnetic force lines Bin heading in the depth direction in the drawing within the cylindrical rotary member 1*a* is eight, and the number of magnetic force lines Bout returning to the front side in the drawing outside the cylindrical rotary member 1*a* is also eight. At a moment when a current increases in the direction of arrow I within the exciting coil 3, magnetic force lines are formed like an arrow (an x-mark within a circle) toward the depth direction in the drawing within the magnetic path. In the event of having actually formed an alternating magnetic field, induced electromotive force is applied to the entire region in the circumference direction of the cylindrical rotary member 1*a* so as to cancel out a magnetic force line to be formed in this manner, and a current flows in a direction of arrow J. When a current flows into the cylindrical rotary member 1*a*, the cylindrical rotary member 1*a* is metal, and accordingly, Joule's heating is caused due to electrical resistance.

Figure 13B:
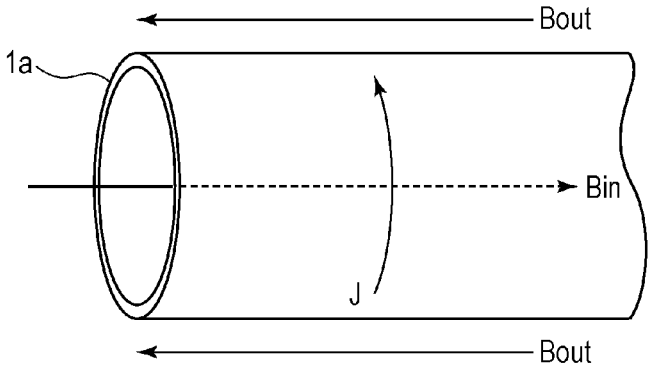
FIG. 13B is a longitudinal perspective view of the cylindrical rotary member.
Figure 31:
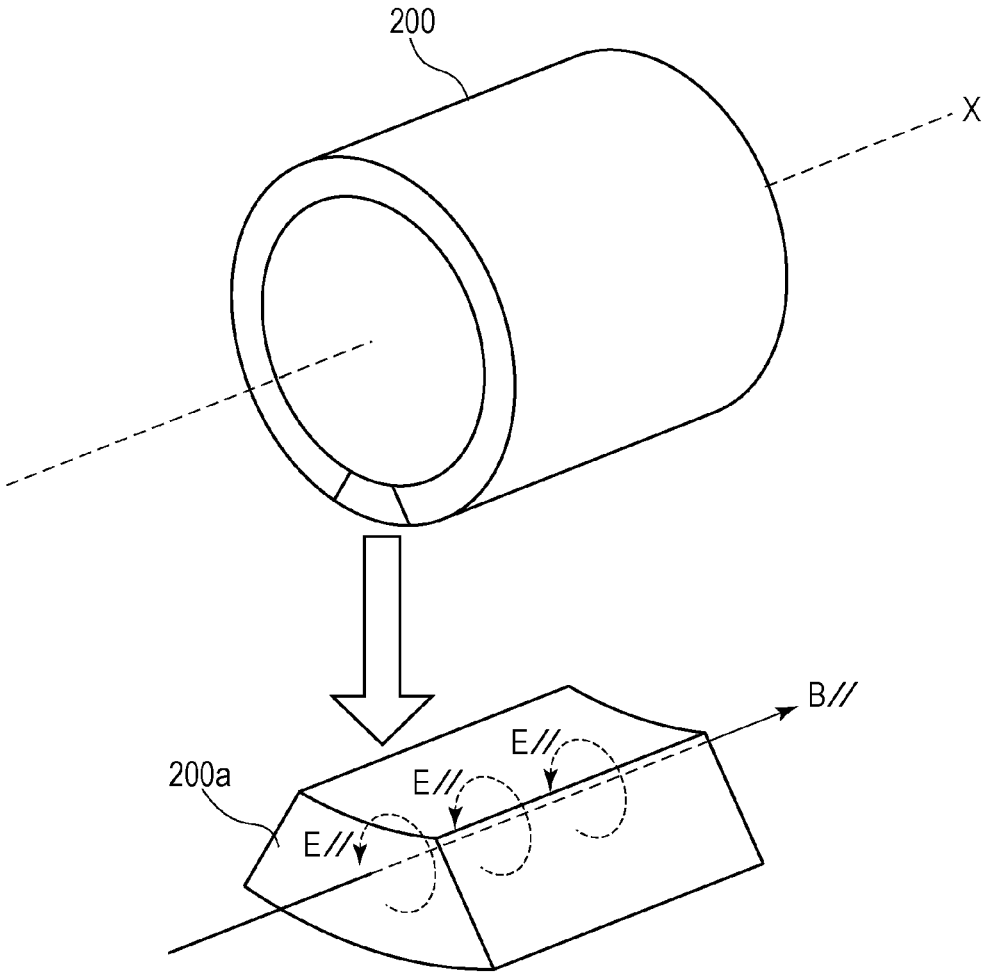
FIG. 31 is an explanatory diagram of an eddy current E//.

It is an important feature of the present embodiment that this current J flows in the circulating direction of the cylindrical rotary member 1*a*. With the configuration of the present embodiment, the magnetic force lines Bin passing through the inside of the magnetic core in a static magnetic field pass through the hollow portion of the cylindrical rotary member 1*a*, and the magnetic force lines Bout output from one end of the magnetic core and returning to the other end of the magnetic core pass over the outside of the cylindrical rotary member 1*a*. This is because, in an alternating magnetic field, the circumference direction current becomes dominant within the cylindrical rotary member 1*a*, an eddy current E// where magnetic force lines as illustrated in FIG. 31 are generated penetrating the inside of the material of the electroconductive layer is prevented from being generated. Note that, hereinafter, in order to distinguish from "eddy current" (later described in comparative examples 3 and 4) substantially used for description of induction heating, a current to evenly flow into the cylindrical rotary member in the direction of the arrow J (or inverse direction thereof) in the configuration of the present embodiment will be referred to as "circumference direction current". Induced electromotive force in accordance with Faraday's law has been generated in the circulating direction of the cylindrical rotary member 1*a*, and accordingly, this circumference direction current J evenly flows into the cylindrical rotary member 1*a*. The magnetic filed lines repeat generation/elimination and direction changing according to a high-frequency current, the circumference direction current J repeats generation/elimination and direction changing in sync with the high-frequency current, and Joule's heating is caused according to the reluctance value of the entire region in the thickness direction of the material of the cylindrical rotary member. FIG. 13B is a longitudinal perspective view illustrating the magnetic force lines Bin to pass through the magnetic path of the magnetic core, the magnetic filed lines Bout to return from the outside of the magnetic path, and the direction of the circumference direction current J flowing into the cylindrical rotary member 1*a*.

Figure 34:
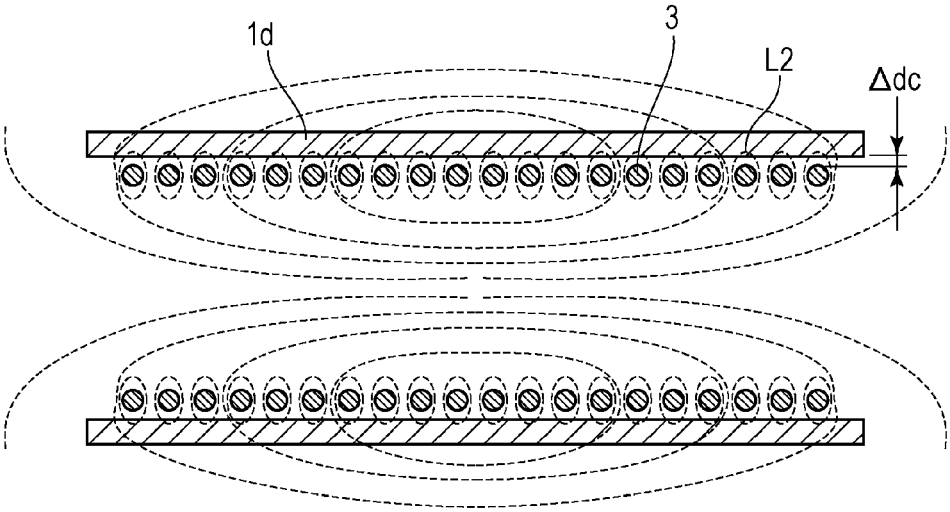
FIG. 34 is a diagram illustrating an air-core fixing device.

It is another advantage that there are a few restraints regarding an interval in the radial direction of the cylindrical rotary member between the cylindrical rotary member and the exciting coil 3. Here, FIG. 34 illustrates the longitudinal cross section of the fixing device wherein no magnetic coil is provided, and there is provided the exciting coil 3 having a spiral portion of which the spiral axis is parallel with the generatrix direction of the cylinder body 1*d* to the hollow portion of the cylinder body 1*a*. With this fixing device, when the magnetic flux L2 generated in the vicinity of the exciting coil 3 penetrates the cylindrical rotary member 1*a*, an eddy current is generated at the cylindrical rotary member 1*a*, and heat is generated. Accordingly, in order to have the L2 contribute to heating, designing has to be performed so as to reduce an interval Δdc between the exciting coil 3 and cylindrical rotary member 1*d*.

However, in the event that flexibility has been given to the cylindrical rotary member by thinning the thickness of the cylindrical rotary member 1*d*, the fixing film 1 is deformed, and accordingly, it is difficult to maintain the interval Δdc between the exciting coil 3 and cylindrical rotary member 1*d* over the entire circumference with high precision.

On the other hand, with the fixing device according to the present embodiment, the circumference direction current is proportional to temporal change of magnetic force lines penetrating the hollow portion of the cylindrical rotary member 1*a* in the generatrix direction of the cylindrical rotary member 1*a*. In this case, even when positional relations of the exciting coil, magnetic core, and cylindrical rotary member 1*a* are shifted several millimeters to tens of millimeters, electromotive force to work on the cylindrical rotary member 1*a* does not readily fluctuate. Therefore, the fixing device according to the present embodiment excels in an application for heating the cylindrical rotary member having flexibility such as a film. Accordingly, as illustrated in FIG. 3, even when the cylindrical rotary member 1*a* is deformed elliptically, the circumference direction current can effectively be applied to the cylindrical rotary member 1*a*. Further, the cross-sectional shapes of the magnetic core 2 and exciting coil 3 may be any shape (square, pentagon, etc.), and accordingly, designing flexibility is also high.

3-5. Efficiency of Power Conversion

At the time of heating the cylindrical rotary member (electroconductive layer) of the fixing film, a high-frequency alternating current is applied to the exciting coil to form an alternating magnetic field. This alternating magnetic field induces the current to the cylindrical rotary member. As a physics model, this is very similar to magnetic coupling of a transformer. Therefore, at the time of considering conversion efficiency of power, an equivalent circuit of magnetic coupling of a transformer can be employed. According to the alternating magnetic field thereof, the exciting coil and the cylindrical rotary member are magnetically coupled, power supplied to the exciting coil is propagated to the cylindrical rotary member. "conversion efficiency of power" mentioned here is a ration between power to be supplied to the exciting coil serving as a magnetic field generator, and power to be consumed by the cylindrical rotary member, and in the case of the present embodiment, is a ratio between power to be supplied to a high-frequency converter 5 for the exiting coil 3 illustrated in FIG. 1, and power to be consumed as heat generated at the cylindrical rotary member 1*a*. This efficiency of power conversion can be represented with the following expression.

Efficiency of power conversion=power to be consumed as heat at the cylindrical rotary member/power to be supplied to the exciting coil Examples of power to be consumed by other than the cylindrical rotary member after supply to the exciting coil include loss due to reluctance of the exciting coil, and loss due to magnetic properties of the magnetic core material.

Figure 14A:
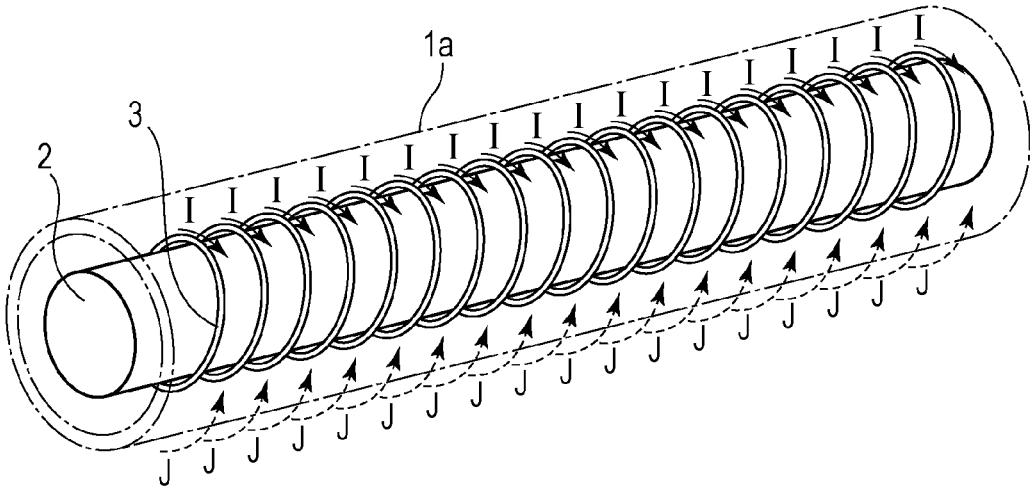
FIG. 14A is a diagram illustrating conversion from high-frequency current of an exciting coil to sleeve circumference current.
Figure 14B:
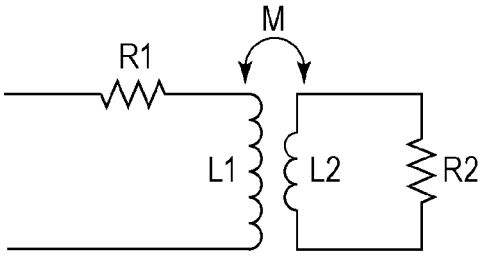
FIG. 14B is an equivalent circuit of an exciting coil and a sleeve.

FIGS. 14A and 14B illustrate explanatory diagrams regarding circuit efficiency. In FIG. 14A, 1*a* denotes a cylindrical rotary member, 2 denotes a magnetic core, and 3 denotes an exciting coil, and the circumference direction current J flows into the cylindrical rotary member 1*a*. FIG. 14B is an equivalent circuit of the fixing device illustrated in FIG. 14A.

Figure 15A:
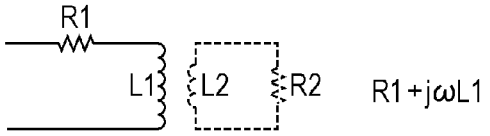
FIG. 15A is an explanatory diagram regarding circuit efficiency.

$R_1$ denotes the amount of loss of the exciting coil and magnetic core, $L_1$ denotes inductance of the exciting coil circulated around the magnetic core, M denotes mutual inductance between a winding wire and the cylindrical rotary member, $L_2$ denotes inductance of the cylindrical rotary member, and $R_2$ denotes resistance of the cylindrical rotary member. An equivalent circuit when removing the cylindrical rotary member is illustrated in FIG. 15A. When measuring resistance $R_1$ from both ends of the exciting coil, and equivalent inductance $L_1$ using a device such as an impedance analyzer or LCR meter, impedance $Z_A$ as viewed from both ends of the exciting coil is represented as $$Z_A=R_1+j\omega L_1 \tag{23}$$

A current flowing into this circuit is lost by the $R_1$. That is to say, $R_1$ represents loss due to the coil and magnetic core.

Figure 15B:
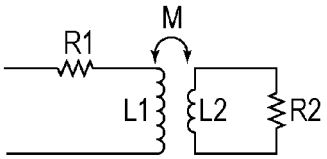
FIG. 15B is an explanatory diagram regarding circuit efficiency.
Figure 15C:
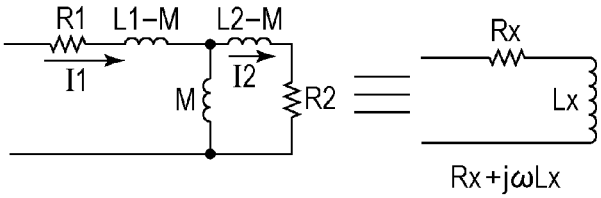
FIG. 15C is an explanatory diagram regarding circuit efficiency.

An equivalent circuit when loading the cylindrical rotary member is illustrated in FIG. 15B. In the event of resistance Rx and Lx at this time being measured, the following relational expression can be obtained by performing equivalent conversion as illustrated in FIG. 15C.

[Math. 2]

$$Z = R1 + j\omega(L1 - M) + \frac{j\omega M(j\omega(L2 - M) + R2)}{j\omega M + j\omega(L2 - M) + R2)}$$
$$= R1 + \frac{\omega^2 M^2 R_2}{R_2^2 + \omega^2 L_2^2} + j(\omega(L_1 - M) + \frac{M \cdot R_2^2 + \omega^2 M L_2(L_2 - M)}{R_2^2 + \omega^2 L_2^2}$$

[Math. 3]

$$Rx = R_1 + \frac{\omega^2 M^2 R_2}{R_2^2 + \omega^2 L_2^2} \quad (23)$$

[Math. 4]

$$Lx = \omega(L_1 - M) + \frac{M \cdot R_2^2 + \omega^2 M L_2(L_2 - M)}{R_2^2 + \omega^2 L_2^2}\Bigg) \quad (24)$$

where M represents mutual inductance between the exciting coil and cylindrical rotary member.

As illustrated in FIG. 15C, when a current flowing into the $R_1$ is $I_1$, and a current flowing into the $R_2$ is $I_2$,

[Math. 5]

$$j\omega M(I_1 - I_2) = (R_2 + j\omega(L_2 - M))I_2 \quad (25)$$

holds, and consequently,

[Math. 6]

$$I_1 = \frac{R_2 + j\omega L_2}{j\omega M} I_2 \quad (26)$$

holds.

Efficiency is represented with power consumption of resistance $R_2$/(power consumption of resistance $R_1$+power consumption of resistance $R_2$), and accordingly,

[Math. 7]

$$\text{Efficiency} = \frac{R_2 \times |I_2^2|}{R_1 \times |I_1^2| + R_2 \times |I_2^2|} = \frac{\omega^2 M^2 R_2}{\omega^2 L_2^2 R_1 + R_1 R_2^2 + \omega^2 M^2 R_2} = \frac{Rx - R_1}{Rx} \quad (27)$$

holds, in the event of measuring the resistance $R_1$ before loading the cylindrical rotary member, and the resistance Rx after loading the cylindrical rotary member, there can be obtained efficiency of power conversion that indicates of power supplied to the exciting coil, how much power is consumed as heat to be generated at the cylindrical rotary member. Note that, with the configuration of the first embodiment, Impedance Analyzer 4294A manufactured by Agilent Technologies Inc. has been employed for measuring the efficiency power conversion. First, in a state in which there is no cylindrical rotary member, the resistance $R_1$ has been measured from both ends of a winding wire, next, in a state in which the magnetic core has been inserted into the cylindrical rotary member, the resistance $R_x$ has been measured from both ends of the winding wire. Consequently, $R_1$=103 mΩ and Rx=2.2Ω hold, efficiency power conversion at this time can be obtained as 95.3% by Expression (27). Hereinafter, performance of the electromagnetic induction heating system fixing device will be evaluated using this efficiency of power conversion.

3-6. Conditions for "Ratio of Magnetic Flux Outside Cylinder Body"

With the fixing device according to the present embodiment, there is a correlation between a ratio of magnetic force lines passing through outside the cylindrical rotary member in a static magnetic field, and conversion efficiency of power supplied to the existing coil to be propagated to the cylindrical rotary member in an alternating magnetic field (efficiency of power conversion). The more the ratio of magnetic force lines passing over the outside of the cylinder body increases, the higher efficiency of power conversion is. A reason thereof depends on the same principle as with a case of a transformer wherein when the number of leakage magnetic force lines is sufficiently small, and the number of magnetic force lines passing through the primary turns and the number of magnetic force lines passing through secondary turns are equal, efficiency of power conversion becomes high. That is to say, the closer the number of magnetic force lines passing through the inside of the magnetic core, and the number of magnetic force lines passing over the outside of the cylindrical rotary member, the higher conversion efficiency of power into a circumference direction current becomes. This means that a ratio for magnetic force lines output from one end in the longitudinal direction of the magnetic core and returning to the other end (magnetic force lines having the inverse direction of magnetic force lines passing through the inside of the magnetic core) cancelling out magnetic force lines passing through the hollow portion of the cylindrical rotary member and passing through the inside of the magnetic core is small. That is to say, as illustrated in a magnetic equivalent circuit in FIG. 11B, magnetic force lines output from one end in the longitudinal direction of the magnetic core and returning to the other end pass over the outside of the cylindrical rotary member (air outside the cylinder body). Accordingly, the essential feature of the present embodiment is to effectively induce a high-frequency current applied to the exciting coil as a circumference direction current within the cylindrical rotary member by increasing a ratio of magnetic force lines outside the cylinder body. Specific examples include to decrease magnetic force lines passing through the film guide, air within the cylinder body, and cylinder body.

Figure 16:
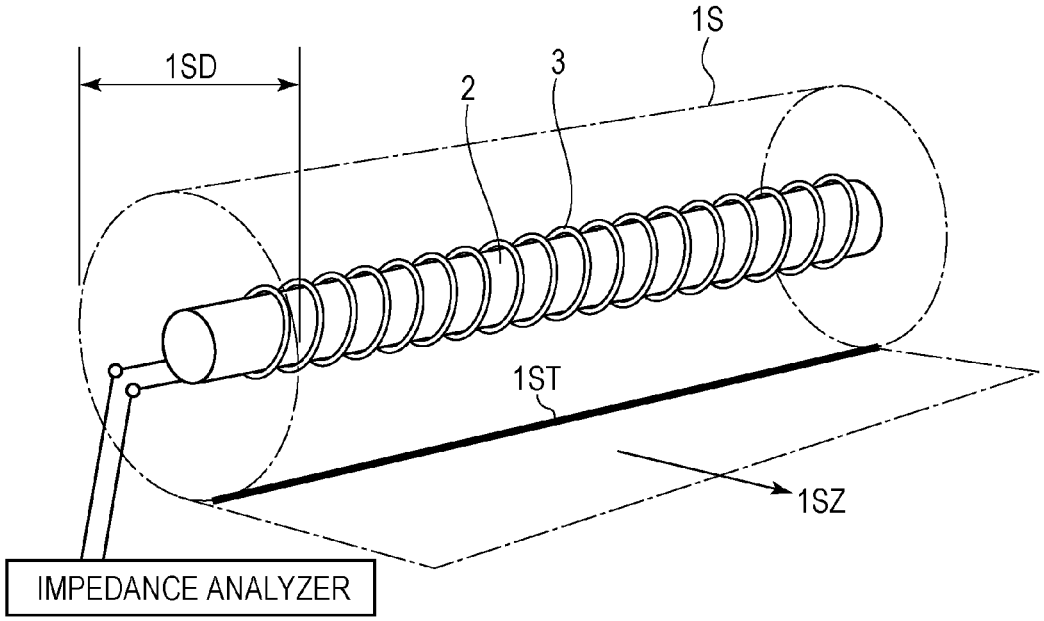
FIG. 16 is a diagram of an experimental device to be used for measurement experiments of efficiency of power conversion.

FIG. 16 is a diagram of an experimental apparatus to be used for measurement experiments of efficiency of power conversion. A metal sheet 1S is an aluminum sheet wherein the area is 230 mm×600 mm, and the thickness is 20 μm, which forms the same electroconductive path as with the cylindrical rotary member by being rounded in a cylindrical shape so as to surround the magnetic core 2 and exciting coil 3 and being electrically conducted at a thick line 1ST portion. The magnetic core 2 is ferrite wherein the relative permeability is 1800, and the saturation magnetic flux density is 500 mT, and has a cylinder shape wherein the cross-sectional area is 26 $mm^2$, and the length B is 230 mm. The magnetic core 2 is disposed substantially in the center of the cylinder of the aluminum sheet 1S using a fixing unit which is not illustrated, a magnetic path is formed within the cylinder by penetrating the hollow portion of the cylinder with the length B=230 mm. The exciting coil 3 is formed by winding the magnetic core 2 with 250 turns in a spiral shape at the hollow portion of the cylinder.

Here, when the end portion of the metal sheet 1S is withdrawn in an arrow 1SZ direction, the diameter 1SD of the cylinder can be reduced. Efficiency of power conversion has been measured using this experimental apparatus while changing the diameter 1SD of the cylinder from 191 mm to 18 mm. Note that calculation results of a ratio of magnetic force lines outside the cylinder body at the time of 1SD=191 mm are illustrated in the following Table 2, and calculation results of a ratio of magnetic force lines outside the cylinder body at the time of 1SD=18 mm are illustrated in the following Table 3.

TABLE 2

Ratio of Magnetic Force lines Outside the Cylinder Body When Cylinder diameter 1SD Is 191 nm

| ITEM | UNIT | MAGNETIC CORE C | AIR INSIDE CYLINDER BODY a_in | CYLINDER BODY cy | AIR OUTSIDE CYLINDER BODY a_out |
|---|---|---|---|---|---|
| CROSS-SECTIONAL AREA | m^2 | 2.6E−05 | 2.9E−02 | 1.2E−05 | |
| RELATIVE PERMEABILITY | | 1800 | 1 | 1 | |
| PERMEABILITY | H/m | 2.3E−03 | 1.3E−6 | 1.3E−6 | |
| PERMEANCE PER UNIT LENGTH | H · m | 5.9E−08 | 3.6E−08 | 1.5E−11 | 2.2E−08 |
| MAGNETIC RESISTANCE PER UNIT LENGTH | 1/(H · m) | 1.7E+07 | 2.7E+07 | 6.6E+10 | 4.5E+07 |
| RATIO OF MAGNETIC FLUX | % | 100.0% | 62.0% | 0.0% | 38.0% |

TABLE 3

Ratio of Magnetic Force lines Outside Cylinder Body When Cylinder diameter 1SD Is 18 nm

| ITEM | UNIT | MAGNETIC CORE C | AIR INSIDE CYLINDER BODY a_in | CYLINDER BODY Cy | AIR OUTSIDE CYLINDER BODY a_out |
|---|---|---|---|---|---|
| CROSS-SECTIONAL AREA | m^2 | 2.6E−05 | 2.2E−02 | 1.1E−05 | |
| RELATIVE PERMEABILITY | | 1800 | 1 | 1 | |
| PERMEABILITY | H/m | 2.3E−3 | 1.3E−6 | 1.3E−6 | |
| PERMEANCE PER UNIT LENGTH | H · m | 5.9E−08 | 2.8E−10 | 1.4E−12 | 5.9E−08 |
| MAGNETIC RESISTANCE PER UNIT LENGTH | 1/(H · m) | 1.7E+07 | 3.6E+09 | 7.2E+11 | 1.7E+07 |
| RATIO OF MAGNETIC FLUX | % | 1 | 0.5% | 0.0% | 99.5% |

Figure 17:
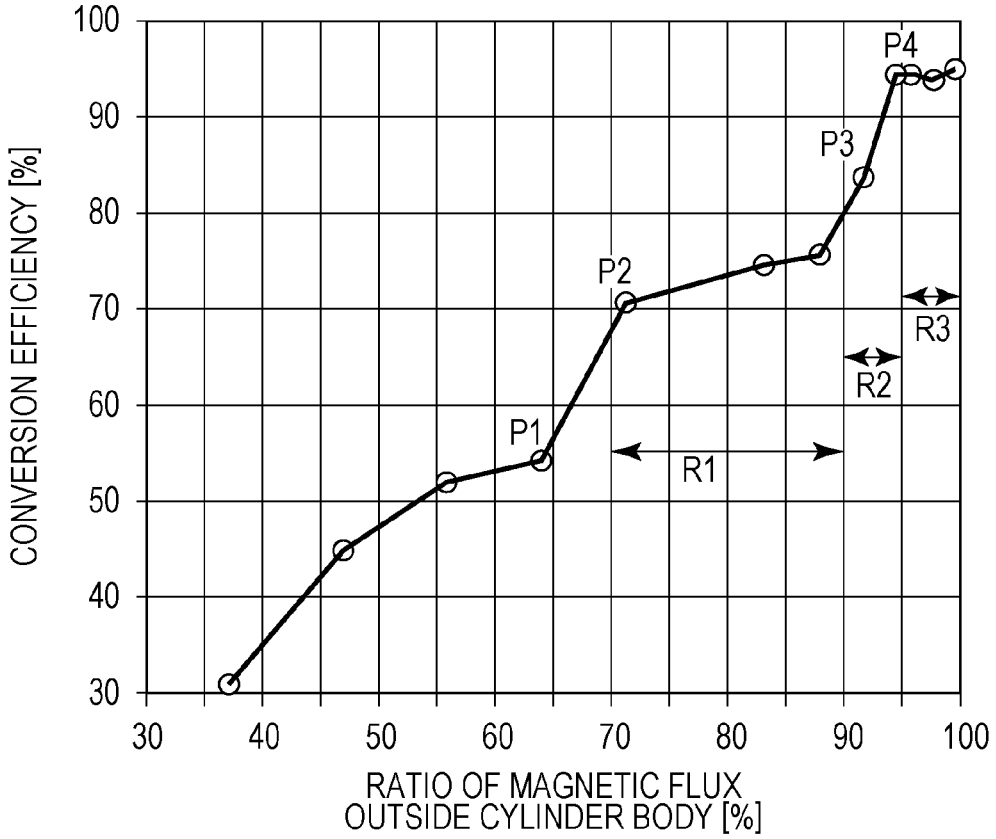
FIG. 17 is a diagram illustrating a relation between a ratio of magnetic force lines outside a cylindrical rotary member and conversion efficiency.

With measurement of efficiency of power conversion, first, the resistance $R_1$ from both ends of a winding wire is measured in a state in which there is no cylindrical rotary member. Next, the resistance $R_x$ from both ends of a winding wire is measured in a state in which the magnetic core is inserted into the hollow portion of the cylindrical rotary member, and efficiency of power conversion is measured in accordance with Expression (27). In FIG. 17, a ratio (%) of magnetic force lines outside the cylinder body corresponding to the diameter of the cylinder is taken as the lateral axis, and efficiency of power conversion in a frequency of 21 kHz is taken as the vertical axis. With a plot, efficiency of power conversion sharply rises at P1 and thereafter within the graph and exceeds 70%, and efficiency of power conversion is maintained in 70% or more in a range of a region R1 illustrated with an arrow. Efficiency of power conversion sharply rises again at around P3, and reaches 80% or more in a region R2. Efficiency of power conversion maintains a high value of 94% or more in a region R3 at P4 and thereafter. It depends on a circumference direction current beginning to effectively flow into the cylinder body that this efficiency of power conversion begins to sharply rise.

This efficiency of power conversion is an extremely important parameter for designing an electromagnetic induction heating system fixing device. For example, in the event that efficiency of power conversion has been 80%, remaining 20% power is generated as thermal energy in a location other than the cylindrical rotary member. With regard to a location to generate the power, in the event that a member such as a magnetic material or the like is disposed in the inside of the cylindrical rotary member, the power is generated on the member thereof. That is to say, when efficiency of power conversion is low, there have to be taken measures for heat to be generated at the exciting coil and magnetic core. The degree of measures thereof greatly changes with 70% and 80% of efficiency of power conversion as boundaries according to study by the inventor and others. Accordingly, with the configuration of regions R1, R2, and R3, the configuration serving as the fixing device greatly differs. Description will be made regarding three types of design conditions R1, R2, and R3, and the configuration of the fixing device not belonging to any thereof. Hereinafter, efficiency of power conversion suitable for designing a fixing device will be described in detail.

The following Table 4 is results wherein configurations corresponding to P1 to P4 in FIG. 17 actually designed as fixing devices and evaluated.

TABLE 4

Evaluation Results of Fixing Devices P1 to P4

| No. | REGION | DIAMETER OF CYLINDER mm | RATIO OF MAGNETIC FORCE LINES OUTSIDE CYLINDER BODY % | CONVERSION EFFICIENCY % | EVALUATION RESULTS (WHEN FIXING DEVICE HAS HIGH SPECIFICATIONS) |
|---|---|---|---|---|---|
| P1 | — | 143.2 | 64.0 | 54.4 | POWER MAY BE INSUFFICIENT |
| P2 | R1 | 127.3 | 71.2 | 70.8 | PROVIDING OF COOLING UNIT IS DESIRABLE |
| P3 | R2 | 63.7 | 91.7 | 83.9 | OPTIMIZATION OF HEAT-RESISTANT DESIGN IS DESIRABLE |
| P4 | R3 | 47.7 | 94.7 | 94.7 | OPTIMAL CONFIGURATION FOR FLEXIBLE FILM |

Fixing Device P1

The present configuration is a case where the cross-section area of the magnetic core is 5.75 mm×4.5 mm, and the diameter of the cylinder body (electroconductive layer) is 143.2 mm. Efficiency of power conversion obtained by the impedance analyzer at this time was 54.4%. Efficiency of power conversion is, of power to be supplied to the fixing device, a parameter indicating contribution to heating of the cylinder (electroconductive layer). Accordingly, even in the event of having designed as a fixing device which can output the maximum 1000 W, around 450 W becomes loss, and the loss thereof becomes heating at the coil and magnetic core. In the event of the present configuration, even when supplying 1000 W for several seconds at the time of start-up, coil temperature may exceed 200 degrees Centigrade. When considering that heat-resistant temperature at a coil insulator is in the upper 200 degrees Centigrade, and the Curie point of the magnetic core of ferrite is usually around 200 to 250 degrees Centigrade, it is difficult with 45% loss to maintain members such as the exciting coil and so forth equal to or less than heat-resistant temperature. Also, when the temperature of the magnetic core exceeds the Curie point, the inductance of the coil suddenly deteriorates, and results in load fluctuation.

Around 45% of power supplied to the fixing device is wasted, and accordingly, in order to supply power of 900 W to the cylinder body (estimating 90% of 1000 W), power of around 1636 W has to be supplied thereto. This means that the power supply is consumed 16.36 A at the time of input of 100 V. In the event there is a limitation that an allowable current that can be supplied from an attachment plug for commercial AC is 15 A, a current to be supplied may exceed the allowable current. Accordingly, with the fixing device P1 wherein the ratio of the magnetic force lines outside the cylinder body is 64%, and efficiency of power conversion is 54.4%, power to be supplied to the fixing device may be insufficient.

Fixing Device P2

The present configuration is a case where the cross-section area of the magnetic core is 5.75 mm×4.5 mm, and the diameter of the cylinder body is 127.3 mm. Efficiency of power conversion obtained by the impedance analyzer at this time was 70.8%. At this time, depending on printing operation of the fixing device, steady large amount of heat is generated at the exciting coil and so forth, and temperature rising of an exciting coil unit, in particular, of the magnetic core may cause a problem. When employing a high-spec device whereby printing operation of 60 sheets per minute can be performed, as the fixing device according to the present embodiment, the rotational speed of the cylindrical rotary member becomes 330 mm/sec. Accordingly, there may be a case where the surface temperature of the cylindrical rotary member is kept in 180 degrees Centigrade. In such a case, it can be conceived that temperature of the magnetic core may exceed 240 degrees Centigrade for 20 seconds, and exceed temperature of the cylinder body (electroconductive layer). Curie temperature of ferrite to be used as the magnetic core is usually 200 to 250 degrees Centigrade, and in the event that the ferrite exceeds the Curie temperature, permeability suddenly decreases. When permeability suddenly decreases, this prevents a magnetic path from being formed within the magnetic core. When a magnetic path is prevented from being formed, with the present embodiment, there may be a case where a circumference direction current is induced to make it difficult to generate heat.

Accordingly, when employing the above-mentioned high-spec device as the fixing device according to the design condition R1, in order to decrease the temperature of the ferrite core, it is desirable to provide a cooling unit. As a cooling unit, there may be employed an air cooling fan, water cooling, a heat sink, a radiation fin, a heat pipe, Bell Choi element, or the like. It goes without saying that a cooling unit does not have to be provided in the event that high-spec is not demanded in the present configuration.

Fixing Device P3

The present configuration is a case where the cross-section area of the magnetic core is 5.75 mm×4.5 mm, and the diameter of the cylinder body is 63.7 mm. Efficiency of power conversion obtained by the impedance analyzer at this time was 83.9%. At this time, the steady amount of heat generated at the exciting coil and so forth, but did not exceeded the amount of heat that can be heated by heat transfer and natural cooling. When employing a high-spec device whereby printing operation of 60 sheets per minute can be performed, as the fixing device according to the present configuration, the rotational speed of the cylinder body becomes 330 mm/sec. Accordingly, even with a case where the surface temperature of the cylinder body is maintained in 180 degrees Centigrade, the temperature of the magnetic core of the ferrite did not rise equal to or higher than 220 degrees Centigrade. Therefore, with the present configuration, in the event of employing a high-spec fixing device, it is desirable to employ ferrite of which the Curie temperature is equal to or higher than 220 degrees Centigrade. In the event of employing the fixing device according to the design condition R2 as a high-spec fixing device, it is desirable to optimize heat-resistant design such as ferrite and so forth. With the present configuration, in the event that the above high-spec is not demanded, heat-resistant design in such a level does not have to be performed.

Fixing Device P4

The present configuration is a case where the cross-section area of the magnetic core is 5.75 mm×4.5 mm, and the diameter of the cylinder body is 47.7 mm. Efficiency of power conversion obtained by the impedance analyzer at this time was 94.7%. When employing a high-spec device whereby printing operation of 60 sheets per minute can be performed, as the fixing device according to the present configuration, the rotational speed of the cylinder body become 330 mm/sec, and in a case where the surface temperature of the cylinder body is maintained in 180 degrees Centigrade, the exciting coil and so forth did not rise equal to or higher than 180 degrees Centigrade. This indicates that the exciting coil hardly generates heat. In the event that the ratio of the magnetic force lines outside the cylinder body is 94.7%, and efficiency of power conversion is 94.7% (design condition R3), efficiency of power conversion is sufficiently high, and accordingly, even when employing the fixing device P4 as a further high-spec fixing device, a cooling unit does not have to be provided.

Also, with this region where efficiency of power conversion is stabilized with a high value, even when a positional relation between the cylindrical rotary member and the magnetic core fluctuates, efficiency of power conversion does not fluctuate. In the event that efficiency of power conversion does not fluctuate, the stable amount of heat can be supplied from the cylindrical rotary member. Accordingly, with a fixing device using a fixing film having flexibility, employing this region R3 where efficiency of power conversion does not fluctuate provides a great advantage.

As described above, with a fixing device configured to have the cylindrical rotary member generate a magnetic field in the axial direction thereof, and to have the cylindrical rotary member perform electromagnetic induction heating, design conditions obtained with a ratio of magnetic force lines outside the cylinder body may be classified into regions with allows R1, R2, and R3 in FIG. 17.

R1: the ratio of magnetic force lines outside the cylinder body is equal to or greater than 70% but less than 90%

R2: the ratio of magnetic force lines outside the cylinder body is equal to or greater than 90% but less than 94%

R3: the ratio of magnetic force lines outside the cylinder body is equal to or greater than 94%

3-7. Features of Heating According to "Circumference Direction Current"

Figure 18A:
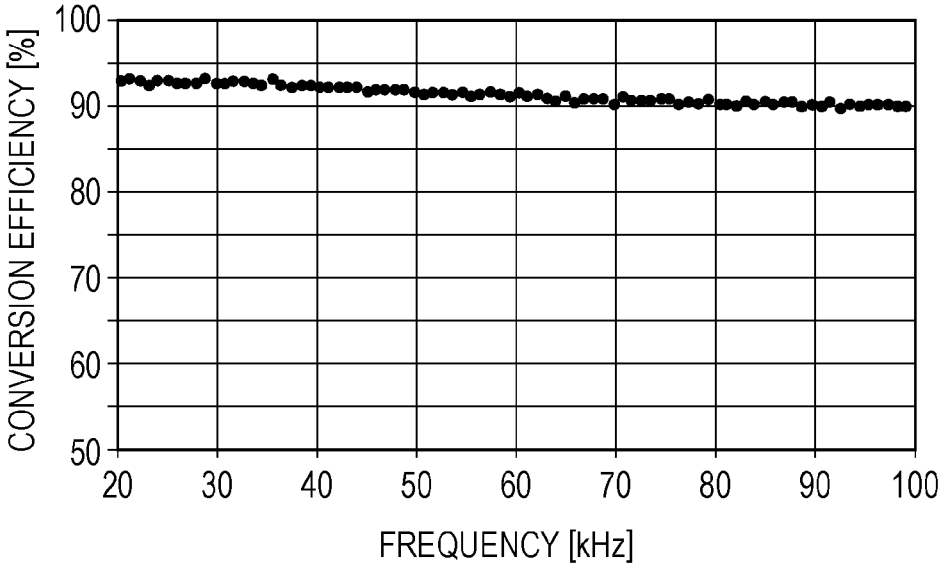
FIG. 18A is a diagram illustrating a relation between conversion efficiency and a frequency with the configuration of the first embodiment.
Figure 18B:
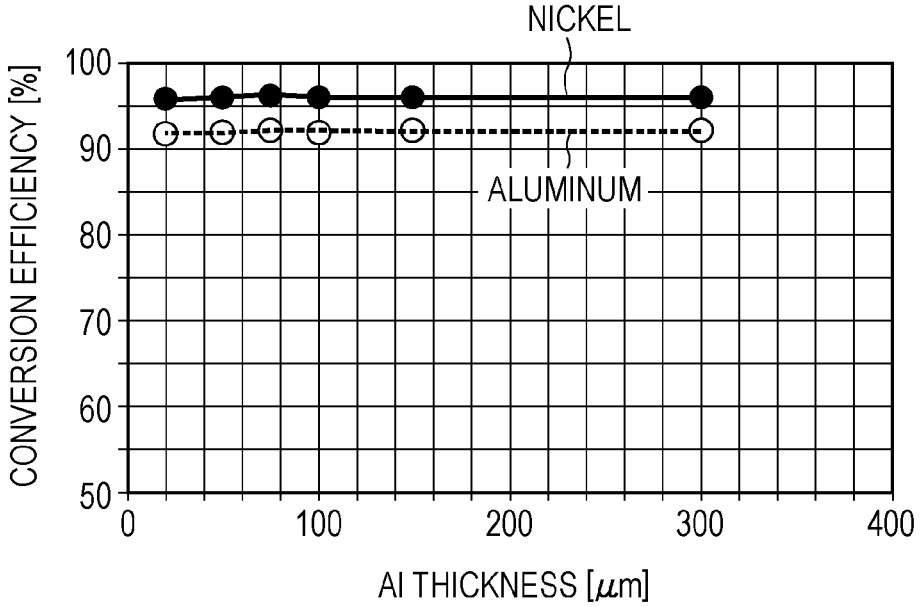
FIG. 18B is a diagram illustrating a relation between conversion efficiency and thickness with the configuration of the first embodiment.

"Circumference direction current" described in 3-4 is caused due to induced electromotive force generated within the circuit S in FIG. 6. Therefore, the circumference direction current depends on magnetic force lines housed in the circuit S, and the resistance value of the circuit S. Unlike later-described "eddy current E//", the circumference direction current has no relation with the magnetic flux density within the material. Therefore, even a cylindrical rotary member made of a thin magnetic metal not serving as a thin magnetic path, or even a cylindrical rotary member made of nonmagnetic metal, can generate heat with high efficiency. Also, with a range where a resistance value is not greatly changed, the circumference direction current does not depend on the thickness of the material either. FIG. 18A illustrates frequency dependency of efficiency of power conversion in a cylindrical rotary member of aluminum with thickness of 20 μm. With a frequency band of 20 to 100 kHz, efficiency of power conversion maintains equal to or higher than 90%. As with the first embodiment, in the case of using a frequency band of 21 to 40 kHz for heating, high efficiency of power conversion is maintained. Next, FIG. 18B illustrates, with a cylindrical rotary member having the same shape, thickness dependency of efficiency of power conversion at a frequency of 21 kHz. A black circle with a solid line indicates experimental results of nickel, a while circle with a dotted line indicates experimental results of aluminum. Both maintains, with a region of 20 to 300-μm thickness, equal to or higher than 90% in efficiency of power conversion, and both do not depend on thickness, and may be employed as a heating material for a fixing device.

Accordingly, with "heating by a circumference direction current", as compared to heating by eddy current loss according to the related art, design flexibility for the material and thickness of the cylindrical rotary member and the frequency of an alternating current can be extended.

Note that it is a feature of the fixing device of the R1 according to the present embodiment that of magnetic force lines output from one end in the longitudinal direction of the magnetic core, a ratio of magnetic force lines to pass over the outside of the cylindrical rotary member and to return to the other end of the magnetic core is equal to or higher than 70%. That of magnetic force lines output from one end in the longitudinal direction of the magnetic core, a ratio of magnetic force lines to pass over the outside of the cylindrical rotary member and to return to the other end of the magnetic core, is equivalent to or higher than 70% is equivalent to that sum of permeance of the cylinder body and permeance of the inside of the cylinder body is equal to or lower than 30% of permeance of the cylinder body. Accordingly, one of the characteristic configurations of the present embodiment is a configuration wherein, if we say that the permeance of the magnetic core is Pc, the permeance of the inside of the cylinder body is Pa, and the permeance of the cylinder body is Ps, a relation of $0.30 \times Pc \geq Ps + Pa$ is satisfied.

Also, in the event of expressing the permeance relational expression by replacing this with a magnetic resistance, the permeance relational expression is as follows.

$$0.30 \times Pc \geq Ps + Pa$$

$$0.30 \times \frac{1}{Rc} \geq \frac{1}{R_s} \geq \frac{1}{R_a}$$

$$0.30 \times \frac{1}{Rc} \geq \frac{1}{R_{sa}}$$

$$0.30 \times Rsa \geq Rc$$

wherein combined magnetic resistance Rsa of Rs and Ra is calculated as follows.

$$\frac{1}{R_{sa}} = \frac{1}{R_s} + \frac{1}{R_a}$$

$$\frac{1}{R_{sa}} = \frac{R_a \times R_s}{R_a + R_s}$$

Rc: magnetic resistance of magnetic core

Rs: magnetic resistance of electroconductive layer

Ra: magnetic resistance of region between electroconductive layer and magnetic core Rsa: combined magnetic resistance of Rs and Ra It is desirable that the above relational expression is satisfied in a cross section in a direction orthogonal to the generatrix direction of the cylindrical rotary member at the entire maximum conveyance region of a recording material of the fixing device.

Similarly, the fixing device of R2 of the present embodiment satisfies the following expressions.

$$0.10 \times Pc \geq Ps + Pa$$

$$0.10 \times Rsa \geq Rc$$

The fixing device of R3 of the present embodiment satisfies the following expressions.

$$0.06 \times Pc \geq Ps + Pa$$

$$0.06 \times Rsa \geq Rc$$

3-8. Advantage Over Closed Magnetic Path

Figure 35:
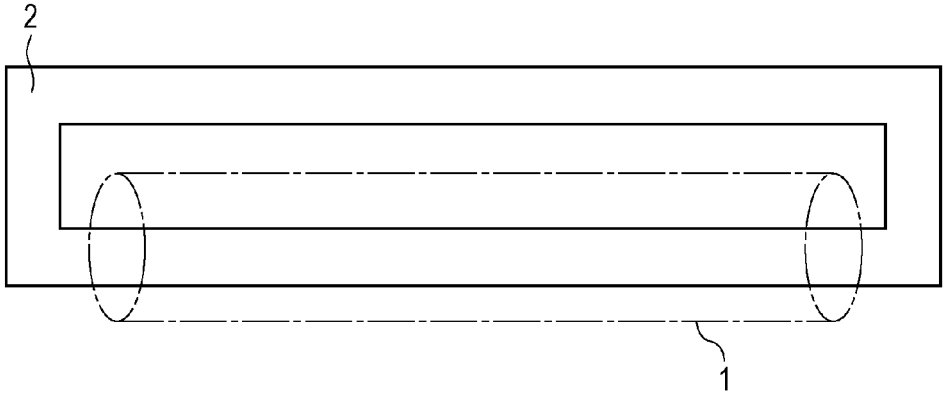
FIG. 35 is a diagram illustrating a magnetic core in the event of forming a closed magnetic path.

Here, in order to design so that magnetic force lines pass over the outside of the cylindrical rotary member, there is also a method for forming a closed magnetic path. The closed magnetic path mentioned here is, as illustrated in FIG. 35, the magnetic core 2 forms a loop outside the cylindrical rotary member, and has a shape the fixing film 1 is covered on a portion of the loop. However, when forming a loop using the magnetic core 2*c*, this causes a problem to lead to increase in size of the device. On the other hand, with the present embodiment, design can be performed with the configuration of an opened magnetic path wherein the magnetic core does not form a loop outside the cylindrical rotary member, and accordingly, reduction in size of the device may be realized.

Further, in the event of employing a 21 to 100 kHz band as the frequency of an alternating current, the configuration of the opened magnetic path wherein the magnetic core does not form a loop outside the cylindrical rotary member as with the present embodiment has an advantage other than reduction in size of the device. Hereinafter, this advantage will be described.

With the configuration of the closed magnetic path wherein the magnetic core does not form a loop outside the cylindrical rotary member, a low frequency of a 50 to 60 Hz band is employed as the frequency of the alternating current. This is because when increasing the frequency of the magnetic field, design of the fixing device becomes difficult according to the following reasons. In order to have the cylindrical rotary member generate heat with high efficiency, in the event of employing a high frequency of a 21 to 100 kHz band as the frequency of the alternating current, when employing a magnetic core made of metal such as silicon steel plate as the magnetic core, core loss increases. Accordingly, baking ferrite which is low loss in a high frequency is suitable as the material of the magnetic core. However, baking ferrite is an sintering material, and accordingly, this is a weak material. When forming a magnetic core (closed magnetic path) having at least four L-letter configurations made up of this weak baking ferrite, the size of the device is increased to deteriorate assembly properties, and also to increase risk for the device being damaged in the event of impact externally being applied to the device due to fall of the device or the like. In the event that the magnetic core has been damaged, and even a part thereof has been interrupted, capability to guide magnetic force lines is significantly deteriorated, and a function to have the cylindrical rotary member 1 generate heat is lost. This is physically equivalent to that with a transformer of the closed magnetic path, when a part of the magnetic path is interrupted, the original performance is not maintained. Further, in the event of a closed magnetic path where the magnetic core is looped outside the cylindrical rotary member, there may be a case where in order to improve assembly properties and convertibility, the magnetic core has to be divided into multiple portions. Though description has been made wherein it is desirable to suppress a gap interval between the divided magnetic cores to 50 μm or less, when the magnetic core is divided, a problem on design such as gap management or the like is caused. Also, risk is included wherein a foreign object such as dust or the like is sandwiched in a joint portion between the divided magnetic cores, and performance is deteriorated.

On the other hand, in the event of employing a high frequency of a 21 to 100 kHz band as the frequency of the alternating current, that the fixing device is configured of an opened magnetic path where the magnetic core does not form a loop outside the cylindrical rotary member provides the following advantages.

1. The shape of the magnetic core can be configured of a rod shape, and accordingly, impact resistance performance is readily improved. In particular, this is advantageous at the time of using baking ferrite.

2. The magnetic core does not necessarily have to include an L-letter configuration or division configuration, and accordingly, gap management is facilitated.

3. The cross-sectional area of the core can be reduced by changing a magnetic field to a high frequency, and accordingly, the entire device can be reduced in size.

(4) Results of Comparative Experiments

Hereinafter, description will be made regarding results of comparative experiments between an image forming apparatus having the configuration of the present embodiment, and an image forming apparatus according to the related art.

COMPARATIVE EXAMPLE 1

The present comparative example has, against the first embodiment, a configuration wherein the permeance of the magnetic core is reduced (magnetic resistance is increased) by dividing the magnetic core into two or more magnetic cores in the longitudinal direction, and providing a gap between the divided magnetic cores.

Figure 19:
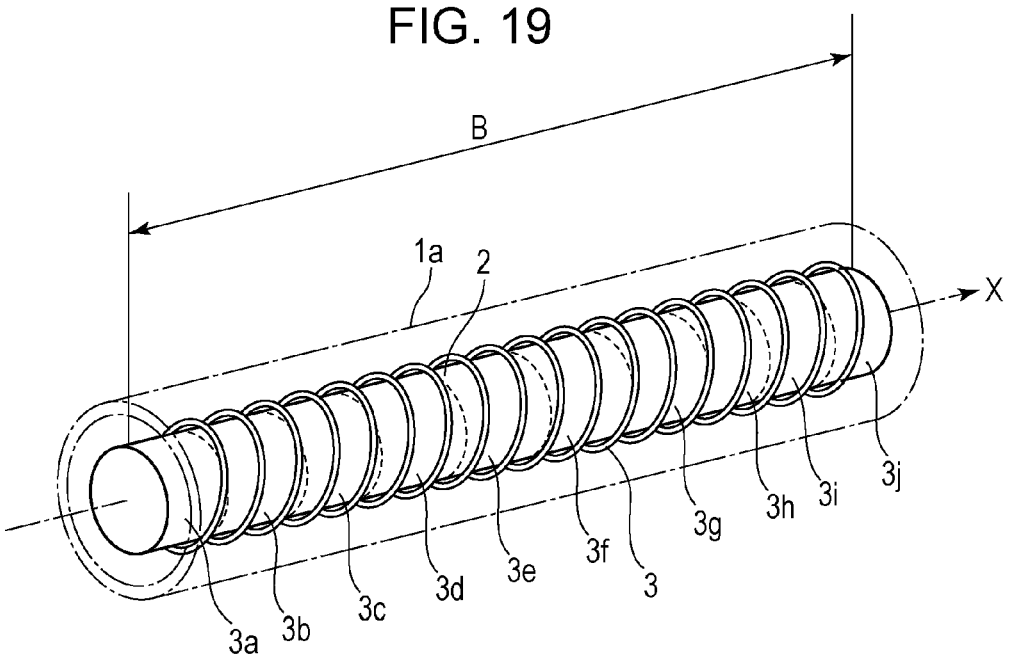
FIG. 19 is a schematic diagram of a fixing device at the time of a magnetic core being divided.

FIG. 19 is a perspective view of the magnetic core and coil in the comparative example 1. A magnetic core 13 is ferrite wherein the relative permeability is 1800, and the saturated magnetic flux density is 500 mT, and has a cylindrical shape wherein the diameter is 5.75 $mm^2$, the cross-sectional area is 26 $mm^2$, and the length is 22 mm. Ten magnetic cores 13 are disposed with equal intervals sandwiching a mylar sheet having thickness G=0.7 mm therebetween in dotted portions in FIG. 19, and the entire length thereof B is 226.3 mm. With regard to the cylindrical rotary member (electroconductive layer), aluminum having relative permeability of 1.0 was employed as with the first embodiment. With the cylindrical rotary member, the thickness was 20 μm, and the diameter was 24 mm. Permeance per unit length of the magnetic core was calculated by substituting the parameters indicated in Table 5 for Expressions (15) to (21).

Also, when calculating a ratio of magnetic force lines passing through each region assuming that permeance per unit length of the magnetic core is $1.1\times10^{-9}$ H·m according to the above calculation, results thereof are as the following Table 6.

TABLE 5

Magnetic Permeance in Comparative Example 1

| COMPARATIVE EXAMPLE 1 | SYMBOL | NUMERIC VALUE | UNIT |
|---|---|---|---|
| LENGTH OF DIVIDED MAGNETIC CORE | Lc | 0.022 | m |
| PERMEABILITY OF MAGNETIC CORE | μc | 2.3E−03 | H/m |
| CROSS-SECTIONAL AREA OF MAGNETIC CORE | SC | 2.6E−05 | m^2 |
| MAGNETIC RESISTANCE OF MAGNETIC CORE | Rm_c | 374082 | 1/H |
| LENGTH OF GAP | Lg | 0.0007 | m |
| PERMEABILITY OF GAP | μg | 1.3E−06 | H/m |
| CROSS-SECTIONAL AREA OF GAP | Sg | 2.6E−05 | m^2 |
| MAGNETIC RESISTANCE OF GAP | Rm_g | 2.1E+07 | 1/H |
| MAGNETIC RESISTANCE OF ENTIRE MAGNETIC CORE | Rm_all | 2.2E+08 | 1/H |
| Rm_all PER UNIT LENGTH | Rm | 8.8E+08 | 1/(H · m) |
| Pm PER UNIT LENGTH | Pm | 1.1E−09 | H · m |

Figure 20:
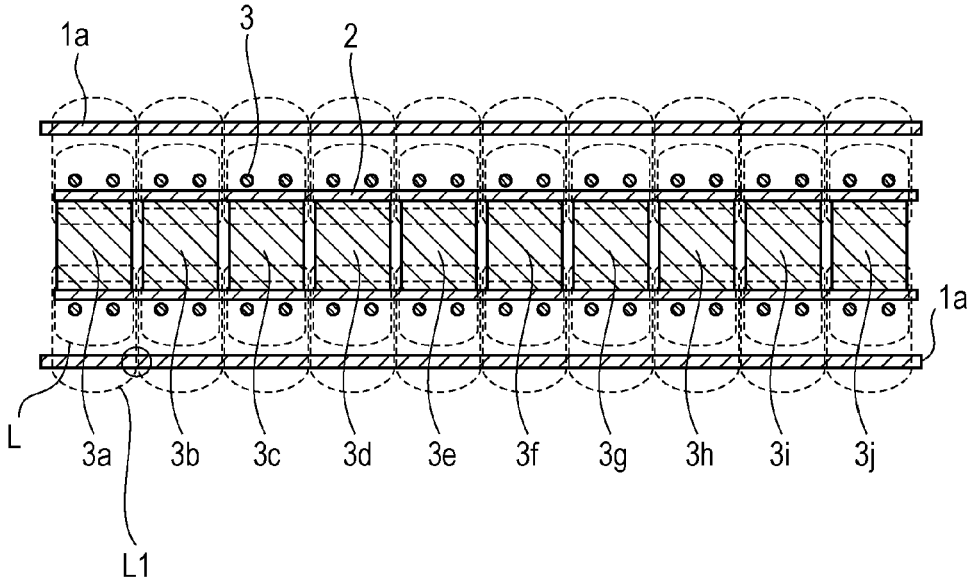
FIG. 20 is a schematic diagram of magnetic force lines at the time of a magnetic core being divided.

Many gaps are provided between the divided cores, and accordingly, the permeance of the magnetic core is smaller as compared to the first embodiment. Therefore, the ratio of magnetic force lines outside the cylinder body is 63.8%, and this is a configuration not satisfying a design requirement of "R1: the ratio of magnetic force lines outside the cylinder body is equal to or greater than 70%". With the shapes of magnetic force lines, magnetic poles are formed for each of the magnetic cores of 3*a* to 3*j* as illustrated in a dotted line in FIG. 20, a part thereof returns to the air inside the cylinder body as with a magnetic force line L, and also, with a part thereof, a magnetic flux vertically penetrates the material of a fixing roller at a black circle portion as with the L1.

Also, permeance of each component of the fixing device according to the comparative example 1 is as follows.

The permeance Pc of the magnetic core=$1.1\times10^{-9}$ H·m

The permeance Pa within the cylinder body=$1.3\times10^{-10}+4.0\times10^{-10}$ H·m The permeance Ps of the cylinder body=$1.9\times10^{-12}$ H·m Accordingly, the comparative example 1 does not satisfy the following permeance relational expression.

$$Ps+Pa\leq0.30\times Pc$$

When replacing this with magnetic resistance, the magnetic resistance Rc of the magnetic core=$9.1\times10^{8}$ 1/(H·m) holds.

The magnetic resistance within the cylinder body is combined reluctance of the film guide Rf and air within the cylinder body Rair, and accordingly, when calculating this using the following expression, $$Ra=1.9\times10^{9}\ 1/(\mathrm{H\cdot m})$$

holds.

$$\frac{1}{R_a}=\frac{1}{R_f}+\frac{1}{R_{air}}$$

$$R_a=\frac{R_{air}\times R_f}{R_{air}+R_f}$$

TABLE 6

Magnetic Permeance in Comparative Example 1

| ITEM | UNIT | MAGNETIC CORE C | FILM GUIDE | AIR INSIDE CYLINDER BODY a_in | CYLINDER BODY cy | AIR OUTSIDE CYLINDER BODY a_out |
|---|---|---|---|---|---|---|
| CROSS-SECTIONAL AREA | m^2 | 1.5E−04 | 1.0E−04 | 3.2E−04 | 1.5E−06 | |
| RELATIVE PERMEABILITY | | 1800 | 1 | 1 | 1 | |
| PERMEABILITY | H/m | 2.3E−3 | 1.3E−6 | 1.3E−6 | 1.3E−6 | |
| PERMEANCE PER UNIT LENGTH | H · m | 1.1E−09 | 1.3E−10 | 4.0E−10 | 1.9E−12 | 7.0E−10 |
| MAGNETIC RESISTANCE PER UNIT LENGTH | 1/(H · m) | 9.1E+08 | 8.0E+09 | 2.5E+09 | 5.3E+11 | 1.4E+09 |
| RATIO OF MAGNETIC FLUX | % | 100.0% | 11.4% | 36.0% | 0.2% | 63.8% |

The magnetic resistance Rs of the cylinder body=$5.3\times10^{11}$ 1/(H·m), and accordingly, combined magnetic resistance Rsa of the Rs and Ra is obtained as follows, $$\frac{1}{R_{sa}} = \frac{1}{R_s} + \frac{1}{R_a}$$

$$R_{sa} = \frac{R_a \times R_s}{R_a + R_s}$$

$$Rsa = 1.9\times10^{9}1/(H\cdot m)$$

holds.

Accordingly, the fixing device according to the comparative example 1 does not satisfy the following magnetic resistance expression.

$$0.30\times Rsa \geq Rc$$

Figure 32:
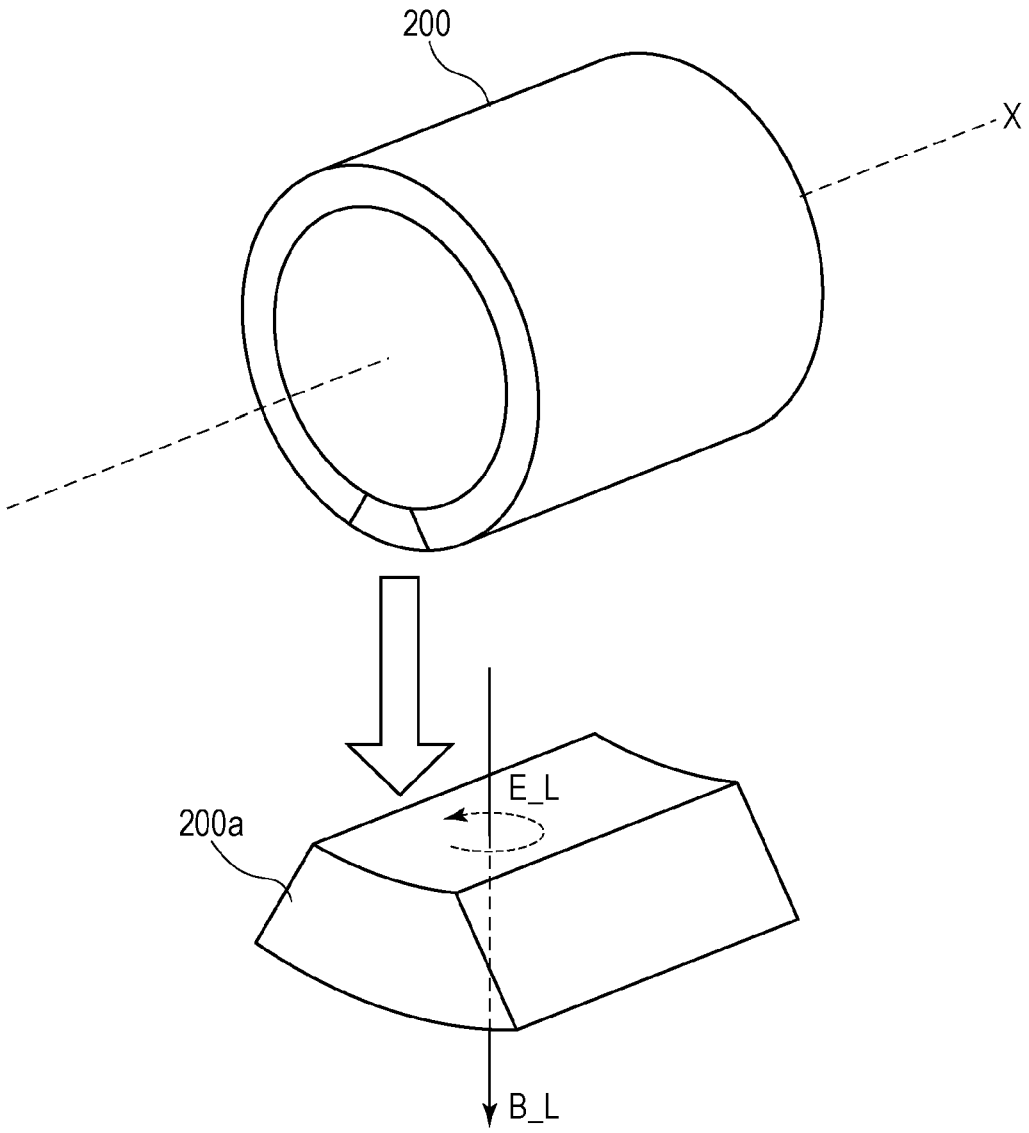
FIG. 32 is an explanatory diagram of an eddy current E⊥.

In this case, it can be conceived that a circumference direction current and an eddy current E⊥ in a direction illustrated in FIG. 32 partially flow into the cylindrical rotary member made of aluminum, and both contribute to heating. This eddy current E⊥ will be described. The eddy current E⊥ has a feature wherein the closer to the surface of the material, the greater the E⊥, and the closer to the inside of the material, the smaller the E⊥ becomes exponentially. Depth thereof will be referred to as penetration depth δ, and is represented with the following expression.

$$\delta=503\times(\rho/f\mu)^{1/2} \quad (28)$$

δ: penetration depth m
f: frequency of exciting circuit Hz
μ: permeability H/m
ρ: reluctivity Ωm The penetration depth δ indicates the depth of absorption of electromagnetic waves, and the intensity of electromagnetic waves becomes equal to or lower than 1/e in a place deeper than this. The depth thereof depends on a frequency, permeability, and reluctivity.

Results of Comparative Experiment

Figure 21:
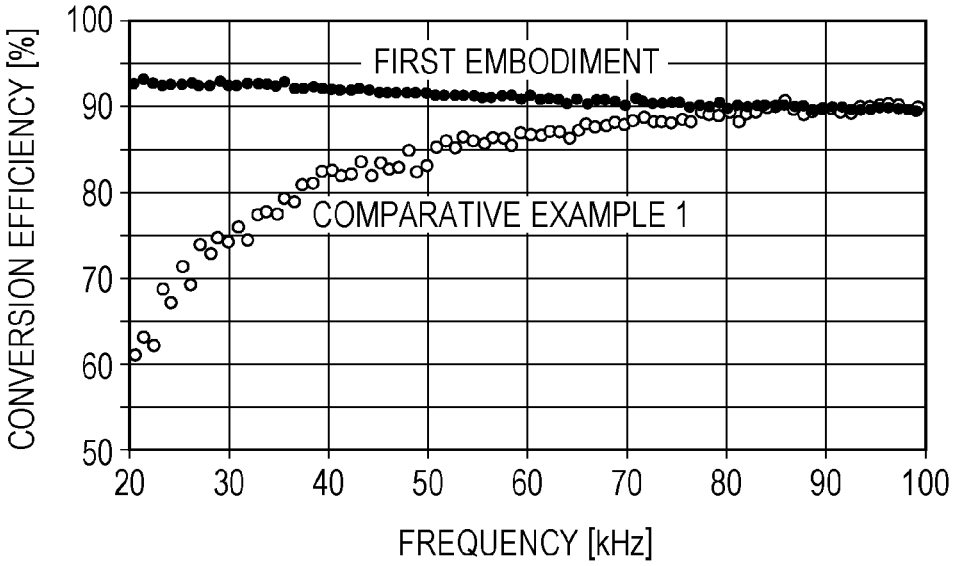
FIG. 21 is a diagram illustrating measured results of efficiency of power conversion with the configurations of the first embodiment and a comparative example 1.

FIG. 21 illustrates frequency dependency of efficiency of power conversion in an aluminum cylindrical rotary member with thickness of 20 μm. Black circles indicate a frequency and a result of efficiency of power conversion in the first embodiment, and white circles indicate a frequency and a result of efficiency of power conversion in the comparative example 1. The first embodiment maintains, with a frequency band of a 20 to 100 kHz, efficiency of power conversion equal to or higher than 90%. The comparative example 1 is the same as with the first embodiment at 90 kHz or higher, 85% at 50 kHz, 75% at 30 kHz, 60% at 20 kHz, in this manner, the lower the frequency, the lower efficiency of power conversion.

A cause thereof will be described below. With the configuration of the comparative example 1, it can be conceived that a circumference direction current and an eddy current E⊥ in a direction illustrated in FIG. 32 partially flow thereinto, and both contribute to heating.

This eddy current E⊥ has frequency dependency as illustrated in Expression (28). That is to say, the higher the frequency, the more electromagnetic waves are readily absorbed in the aluminum, and consequently, efficiency of power conversion increases.

With the first embodiment, in the event of employing a 21-kHz to 40-kHz frequency as well, the amount of heat generated at the exciting coil is sufficiently small as compared to the amount of heat that can be radiated by heat transfer and natural cooling. In this case, the temperature of the exciting coil is lower temperature than that of the cylindrical rotary member, and accordingly, heat-resistant design does not have to be performed regarding the coil and magnetic core.

On the other hand, with the comparative example 1, a frequency band of 25 kHz or lower of which the efficiency of power conversion is equal to or lower than 70% is unavailable. In this case, measures for temperature rising of the coil have to be taken, or a location where efficiency of power conversion is around 90% has to be employed by upgrading the power source to increase the frequency band to 90 kHz or higher.

As described above, according to the configuration of the first embodiment, even when employing aluminum which is nonmagnetic metal as the material of the electroconductive layer, the electroconductive layer can be heated with high efficiency without increasing the thickness of the electroconductive layer. Also, even in the event of employing a frequency of a 21 to 100 kHz band, heat can be generated with low loss, the magnetic core does not have to be formed as a closed magnetic path, and accordingly, design of the magnetic core is facilitated. Accordingly, even when output is high, the entire device can be designed in a compactible manner.

Now, let us consider a fixing device which satisfies the following two conditions.

Condition 1. All of the material of the cylindrical rotary member, and the material of a member in a region between the magnetic core and cylindrical rotary member are nonmagnetic materials having the same relative permeability as with the air.

Condition 2. Configuration is made wherein 94% or higher of magnetic force lines output from one end of the magnetic core return to the other end of the magnetic core passing over the outside of the cylindrical rotary member (fixing device of R3).

If we say that the magnetic resistance of the magnetic core is Rc, and combined magnetic resistance of the magnetic resistance of the cylindrical rotary member, and the magnetic resistance of a region between the cylindrical rotary member and the magnetic core is Rsa, a condition can be represented as follows wherein 94.7% or higher of magnetic force lines output from one end of the magnetic core return to the other end of the magnetic core passing over the outside of the cylindrical rotary member.

$$0.06\times Rsa \geq Rc$$

The magnetic resistance Rc of the magnetic core is represented as follows.

$$Rc = \frac{1}{\mu_c S_c}$$

μc: permeability of core
Sc: cross-sectional area of core

The combined magnetic resistance Rsa of the magnetic resistance of the cylindrical rotary member, and the magnetic resistance of a region between the magnetic core and the cylindrical rotary member is represented as follows.

$$R_{sa} = \frac{1}{\mu_{sa} S_{sa}}$$

μsa: permeability of cylindrical rotary member and a region between magnetic core and cylindrical rotary member Ssa: cross-sectional area of cylindrical rotary member and a region between magnetic core and cylindrical rotary member According to the above, there is expressed as follows an expression satisfying the condition that 94% or higher of magnetic force lines output from one end of the magnetic core return to the other end of the magnetic core passing over the outside of the cylindrical rotary member.

$$0.06 \times \frac{1}{\mu_{sa} S_{sa}} \geq \frac{1}{\mu_c S_c}$$

$$0.06 \times \mu c Sc \geq \mu sa Ssa$$

Now, let us say that vacuum permeability is $\mu\mu_0$, and the relative permeability of the magnetic core is $\mu c_0$, the permeability of air is 1.0, and accordingly, from Condition 1, $\mu sa=1.0\times\mu_0$, and $\mu c=\mu c_0\times\mu_0$, and accordingly, an expression satisfying Condition 2 is as follows.

$$0.06\times 100\times \mu c_0 Sc \geq Ssa$$

$$0.06\times \mu c_0 \times Sc \geq Ssa$$

According to the above, it is found that, with regard to the fixing device which satisfies Condition 1 and Condition 2, sum of the cross-sectional area of the cylindrical rotary member and the cross-sectional area of a region between the magnetic core and the cylindrical rotary member is equal to or lower than ($0.06\times\mu c_0$) times as large as the cross-sectional area of the core. Note that Condition 1 does not have to be the same as the relative permeability 1.0 of the air. In the event that the permeability is smaller than 1.1, the above-mentioned relational expressions can be applied.

Note that, even with the configuration of a closed magnetic path having a shape where the magnetic core forms a loop outside the cylindrical rotary member (electroconductive layer) as illustrated in FIG. 35, when the permeability of the magnetic core is small, the present embodiment has effect. That is to say, there may be a case where the permeability of the magnetic core is too low to induce magnetic force lines to the outside of the cylindrical rotary member. In such a case, when the magnetic resistance of the magnetic core satisfies a condition that is 30% or lower of the combined magnetic resistance of the magnetic resistance of the cylindrical rotary member and the magnetic resistance of a region between the cylindrical rotary member and the core, 70% or higher of the magnetic force lines output from one end of the magnetic core return to the other end of the magnetic core passing over the outside of the cylindrical rotary member.

Similarly, when the magnetic resistance of the magnetic core satisfies a condition that is 10% or lower of the combined magnetic resistance of the magnetic resistance of the cylindrical rotary member and the magnetic resistance of a region between the cylindrical rotary member and the core, 90% or higher of the magnetic force lines output from one end of the magnetic core return to the other end of the magnetic core passing over the outside of the cylindrical rotary member. Similarly, when the magnetic resistance of the magnetic core satisfies a condition that is 6% or lower of the combined magnetic resistance of the magnetic resistance of the cylindrical rotary member and the magnetic resistance of a region between the cylindrical rotary member and the core, 94% or higher of the magnetic force lines output from one end of the magnetic core return to the other end of the magnetic core passing over the outside of the cylindrical rotary member.

Second Embodiment

The present embodiment is another example regarding the first embodiment described above, and differs from the first embodiment in that austenitic stainless steel (SUS304) is employed as the cylindrical rotary member (electroconductive layer). The following is, as a reference, results of by summarizing resistivity and relative permeability in various types of metal, and calculating penetration depth δ at 21 kHz, 40 kHz, and 100 kHz in accordance with Expression (28).

TABLE 7

Penetration Depth of Cylindrical Rotary Member

| | ρ: RESISTIVITY Ω · m | RELATIVE PERME-ABILITY μ | δ (21 kHZ) μm | δ (40 kHz) μm | δ (100 kHz) μm |
|---|---|---|---|---|---|
| Ag (SILVER) | 1.59E−08 | 1 | 438 | 317 | 201 |
| Cu (COPPER) | 1.67E−08 | 1 | 449 | 325 | 206 |
| Al (ALUMINUM) | 2.75E−08 | 1 | 576 | 417 | 264 |
| Ni (NICKEL) | 6.84E−08 | 600 | 37 | 27 | 17 |
| Fe (IRON) | 9.71E−08 | 500 | 48 | 35 | 22 |
| SUS304 | 7.20E−07 | 1.02 | 2916 | 2113 | 1336 |

According to Table 7, SUS304 is high in resistivity, and low in relative permeability, and accordingly, penetration depth δ is great. That is to say, SUS304 readily penetrates electromagnetic waves, and accordingly, SUS304 is hardly employed as a heating element of induction heating. Accordingly, with an electromagnetic induction heating system fixing device according to the related art, it has been difficult to realize high efficiency of power conversion. However, Table 7 indicates, with the present embodiment, that it is possible to realize high efficiency of power conversion.

Note that the configuration of the second embodiment is the same as the configuration of the first embodiment except that SUS304 is employed as the material of the cylindrical rotary member. The lateral cross-sectional shape of the fixing device is also the same as with the first embodiment. With regard to the heating layer, SUS304 of which the relative permeability is 1.0 is employed, and the film thickness is 30 μm, and the diameter is 24 mm. The elastic layer and surface layer are the same as with the first embodiment. The magnetic core, exciting coil, temperature detecting member, and temperature control are the same as with the first embodiment.

Permeance and magnetic resistance of each component of the fixing device according to the present embodiment will be illustrated in the following Table 8.

TABLE 8

| Magnetic Permeance in Second Embodiment | | | | | | |
|---|---|---|---|---|---|---|
| ITEM | UNIT | MAGNETIC CORE C | FILM GUIDE | AIR INSIDE CYLINDER BODY a_in | CYLINDER BODY cy | AIR OUTSIDE CYLINDER BODY a_out |
| CROSS-SECTIONAL AREA | m^2 | 2.6E−05 | 1.0E−04 | 3.2E−04 | 2.3E−06 | |
| RELATIVE PERMEABILITY | | 1800 | 1 | 1 | 1 | |
| PERMEABILITY | H/m | 2.3E−3 | 1.3E−6 | 1.3E−6 | 1.3E−6 | |
| PERMEANCE PER UNIT LENGTH | H · m | 5.9E−08 | 1.3E−10 | 4.0E−10 | 2.9E−12 | 5.8E−08 |
| MAGNETIC RESISTANCE PER UNIT LENGTH | 1/(H · m) | 1.7E+07 | 8.0E+09 | 2.5E+09 | 3.5E+11 | 1.7E+07 |
| RATIO OF MAGNETIC FLUX | % | 100.0% | 0.2% | 0.7% | 0.0% | 99.3% |

With the present configuration, the ratio of magnetic flux outside the cylinder body is 99.3%, and satisfies the condition of "R3: the ratio of magnetic force lines outside the cylinder body is equal to or greater than 94%".

Also, permeance of each component of the second embodiment is as follows from Table 8.

The permeance Pc of the core=$5.9\times10^{-8}$ H·m

The permeance Pa within the cylinder body=$1.3\times10^{-10}+4.0\times10^{-10}$ H·m The permeance Ps of the cylinder body=$2.9\times10^{-12}$ H·m Accordingly, the second embodiment satisfies the following permeance relational expression.

$$Ps+Pa\leq0.30\times Pc$$

When replacing this with magnetic resistance, the magnetic resistance Rc of the magnetic core=$1.7\times10^{7}$ 1/(H·m) holds.

The magnetic resistance within the cylinder body is a combined reluctance of magnetic resistance of the film guide Rf and air within the cylinder body Rair, and accordingly, when calculating this using the following expression, $$Ra=1.9\times10^{9}1/(\text{H}\cdot\text{m})$$

holds.

$$\frac{1}{R_a}=\frac{1}{R_f}+\frac{1}{R_{air}}$$

$$R_a=\frac{R_{air}\times R_f}{R_{air}+R_f}$$

The magnetic resistance Rs of the cylinder body=$3.5\times10^{11}$ 1/(H·m), and accordingly, combined magnetic resistance Rsa of the Rs and Ra is obtained as follows, $$\frac{1}{R_{sa}}=\frac{1}{R_s}+\frac{1}{R_a}$$

-continued $$R_{sa}=\frac{R_a\times R_s}{R_a+R_s}$$

$$Rsa=1.9\times10^{9}\ 1/(H\cdot m)$$

holds.

Accordingly, the fixing device according to the second embodiment satisfies the following magnetic resistance relational expression.

$$0.30\times Rsa\geq Rc$$

According to the above, the fixing device according to the second embodiment satisfies the permeance (magnetic resistance) relational expression, and accordingly may be employed as the fixing device.

COMPARATIVE EXAMPLE 2

A comparative example 2 has, against the second embodiment, a configuration wherein the permeance of the magnetic core is reduced by dividing the magnetic core into two or more magnetic cores in the longitudinal direction, and providing many gaps between the divided magnetic cores. The magnetic core is, in the same way as with the comparative example 1, ferrite having a cylindrical shape wherein the diameter is 5.4 mm, the cross-sectional area 23 $mm^2$, and the length B is 22 mm, and ten magnetic cores are disposed with an equal interval sandwiching a mylar sheet having thickness G=0.7 mm therebetween. With regard to the cylindrical rotary member (electroconductive layer) of the fixing film, in the same way as with the second embodiment, SUS304 of which the relative permeability is 1.02 was employed, and the film thickness was 30 μm, and the diameter was 24 mm. Permeance per unit length of the magnetic core can be calculated in the same way as with the comparative example 1, permeance per unit length is $1.1\times10^{-9}$ H·m. A ratio of magnetic force lines passing through each region is as with the following table.

TABLE 9

Magnetic Permeance in Comparative Example 2

| ITEM | UNIT | MAGNETIC CORE C | FILM GUIDE | AIR INSIDE CYLINDER BODY a_in | CYLINDER BODY cy | AIR OUTSIDE CYLINDER BODY a_out |
|---|---|---|---|---|---|---|
| CROSS-SECTIONAL AREA | m^2 | 2.6E−05 | 1.0E−04 | 3.2E−04 | 2.3E−06 | |
| RELATIVE PERMEABILITY | | | 1 | 1 | 1 | |
| PERMEABILITY | H/m | | 1.3E−6 | 1.3E−6 | 1.3E−6 | |
| PERMEANCE PER UNIT LENGTH | H · m | 1.1E−09 | 1.3E−10 | 4.0E−10 | 2.9E−12 | 6.9E−10 |
| MAGNETIC RESISTANCE PER UNIT LENGTH | 1/(H · m) | 9.1E+08 | 8.0E+09 | 2.5E+09 | 3.5E+11 | 1.4E+09 |
| RATIO OF MAGNETIC FLUX | % | 100.0% | 11.4% | 36.6% | 0.3% | 63.2% |

The permeance of the magnetic core is smaller as compared to the second embodiment, and accordingly, the ratio of magnetic force lines outside the cylinder body is 64.1%, and this does not satisfy the condition of "R1: the ratio of magnetic force lines outside the cylinder body is equal to or greater than 70%".

Also, permeance of each component of the comparative example is as follows.

The permeance Pc of the magnetic core=$1.1\times10^{-9}$ H·m

The permeance Pa within the cylinder body=$1.3\times10^{-10}+4.0\times10^{-10}$ H·m The permeance Ps of the cylinder body=$2.9\times10^{-12}$ H·m Accordingly, the fixing device according to the comparative example 2 does not satisfy the following permeance relational expression.

$$Ps+Pa\leq0.30\times Pc$$

When replacing this with magnetic resistance, the magnetic resistance Rc of the magnetic core=$9.1\times10^{8}$ 1/(H·m)

The magnetic resistance within the cylinder body (region between the cylinder body and magnetic core):

$$Ra=1.9\times10^{9}\ 1/(\mathrm{H\cdot m})$$

The magnetic resistance of the cylinder body:

$$Rs=3.5\times10^{11}\ 1/(\mathrm{H\cdot m})$$

The combined magnetic resistance Rsa of the Rs and Ra:

$$Rsa=1.9\times10^{9}\ 1/(\mathrm{H\cdot m})$$

Accordingly, the comparative example 2 does not satisfy the following magnetic resistance relational expression.

$$0.30\times Rsa\geq Rc$$

In this case, it can be conceived that a circumference direction current and an eddy current E⊥ in a direction illustrated in FIG. 32 partially flow into the cylindrical rotary member made of SUS304, and both contribute to heating.

Results of Comparative Experiment

Figure 22:
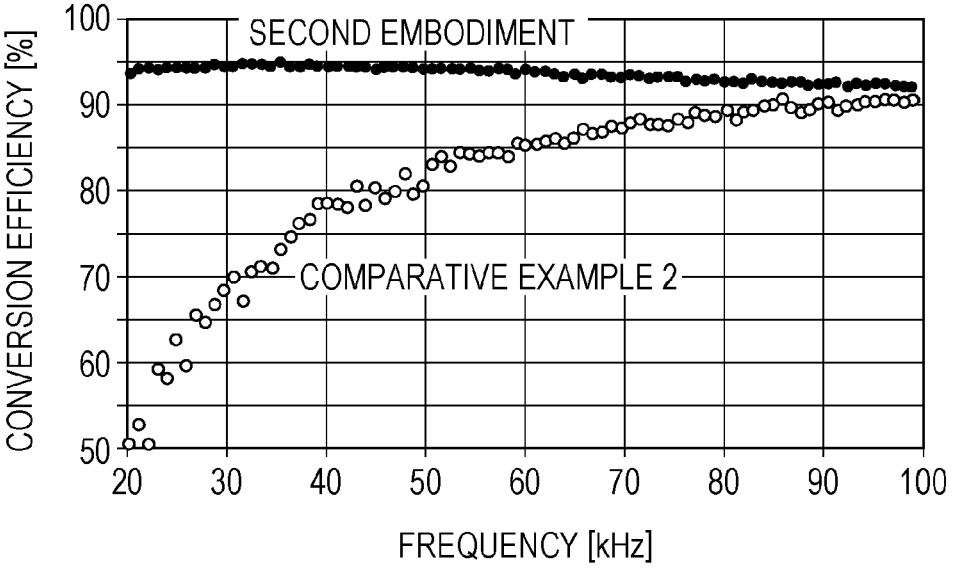
FIG. 22 is a diagram illustrating measured results of efficiency of power conversion with the configurations of a second embodiment and a comparative example 2.

FIG. 22 illustrates frequency dependency of efficiency of power conversion in the cylindrical rotary member of SUS304 with thickness of 30 μm. Black circles indicate a frequency and a result of efficiency of power conversion in the second embodiment, and white circles indicate a frequency and a result of efficiency of power conversion in the comparative example 2. The second embodiment maintains, with a frequency band of a 20 to 100 kHz, efficiency of power conversion equal to or higher than 90%. The comparative example 2 is the same as with the second embodiment at 100 kHz or higher, 80% at 50 kHz, 70% at 30 kHz, 50% at 20 kHz, in this manner, the lower the frequency, the lower efficiency of power conversion.

With the second embodiment, in the event of employing a 21-kHz to 40-kHz frequency, efficiency of power conversion is as high as 94%, and accordingly, the amount of heat generated at the exciting coil is sufficiently smaller as compared to the amount of heat that can be radiated by heat transfer and natural cooling. In this case, the temperature of the exciting coil was constantly lower temperature than that of the cylindrical rotary member, and accordingly, heat-resistant design did not have to be performed regarding the coil and magnetic core.

On the other hand, with the comparative example 2, a frequency band of 35 kHz or lower of which the efficiency of power conversion is equal to or lower than 70% is unavailable. In this case, measures for temperature rising of the coil had to be taken, or a location where efficiency of power conversion is around 90% had to be employed by upgrading the power source to increase the frequency band to 90 kHz or higher.

As described above, according to the configuration of the second embodiment, there can be provided the fixing device wherein even when employing SUS304 which is low in relative permeability as the material of the electroconductive layer, the electroconductive layer can be heated with high efficiency without increasing the thickness of the electroconductive layer.

Third Embodiment

With the present embodiment, description will be made regarding a configuration employing metal having high relative permeability as the cylindrical rotary member.

As with the present embodiment, with a configuration wherein the cylindrical rotary member is caused to generate heat principally by a circumference direction current, metal having low relative permeability does not necessarily have to be employed as the cylindrical rotary member, and even metal having high relative permeability can be employed.

With an electromagnetic induction heating system fixing device according to the related art, there has been a problem in that even when employing nickel having high relative permeability or the like as the cylindrical rotary member, in the event of reducing the thickness of the cylindrical rotary member, efficiency of power conversion is reduced. Therefore, the present embodiment illustrates that even in the event that the thickness of nickel is thin, the cylindrical rotary member can be caused to generate heat with high efficiency. Thinning the thickness of the cylindrical rotary member provides advantages such as improvement in durability against repetitive bending, and improvement in quick start properties due to reduction in thermal capacity, and so forth.

The configuration of the image forming apparatus is the same as with the first embodiment except that nickel is employed as the cylindrical rotary member. With the third embodiment, nickel of which the relative permeability is 600 as the cylindrical rotary member. With the cylindrical rotary member, the thickness was 75 μm, and the diameter was 24 mm. The elastic layer and surface layer are the same as with the first embodiment, and accordingly, description thereof will be omitted. Also, the exciting coil, temperature detecting member, and temperature control are the same as with the first embodiment. This magnetic core 2 is ferrite wherein the relative permeability is 1800, the saturated magnetic flux density is 500 mT, the diameter is 14 mm, and the length B is 230 mm.

The ratio of permeance of each component of the fixing device according to the present embodiment will be illustrated in the following Table 10.

TABLE 10

Magnetic Permeance in Third Embodiment

| ITEM | UNIT | MAGNETIC CORE C | FILM GUIDE | AIR INSIDE CYLINDER BODY a_in | CYLINDER BODY cy | AIR OUTSIDE CYLINDER BODY a_out |
|---|---|---|---|---|---|---|
| CROSS-SECTIONAL AREA | m^2 | 1.5E−04 | 1.0E−04 | 1.9E−04 | 5.6E−06 | |
| RELATIVE PERMEABILITY | | 1800 | 1 | 1 | 1 | |
| PERMEABILITY | H/m | 2.3E−9 | 1.3E−6 | 1.3E−6 | 754.0E−6 | |
| PERMEANCE PER UNIT LENGTH | H · m | 3.5E−07 | 1.3E−10 | 2.4E−10 | 4.2E−09 | 3.4E−07 |
| MAGNETIC RESISTANCE PER UNIT LENGTH | 1/(H · m) | 2.9E+06 | 8.0E+09 | 4.2E+09 | 2.4E+08 | 2.9E+06 |
| RATIO OF MAGNETIC FLUX | % | 100.0% | 0.0% | 0.1% | 1.2% | 98.7% |

With the present embodiment, the ratio of magnetic force lines outside the cylinder body is 98.7%, and satisfies the condition of "R3: the ratio of magnetic force lines outside the cylinder body is equal to or greater than 90%". Nickel partially serves as the magnetic path, and accordingly, the ratio of magnetic flux outside the cylinder body is reduced around 1%, but sufficiently high heat efficiency is obtained. Also, permeance of each component of the third embodiment is as follows from Table 10.

The permeance of the magnetic core: $Pc=3.5\times10^{-7}$ H·m

The permeance within the cylinder body: $Pa=1.3\times10^{-10}+2.4\times10^{-10}$ H·m The permeance of the cylinder body: $Ps=4.2\times10^{-9}$ H·m Accordingly, the fixing device according to the third embodiment satisfies the following permeance relational expression.

$$Ps+Pa\leq0.30\times Pc$$

Now, when replacing the above-mentioned permeance relational expressions with magnetic resistance relational expressions, the following expressions are obtained.

The magnetic resistance of the magnetic core: $Rc=2.9\times10^{6}$ 1/(H·m)

The magnetic resistance of a region between the cylinder body and magnetic core: $Ra=2.7\times10^{8}$ 1/(H·m)

The magnetic resistance of the cylinder body: $Rs=2.4\times10^{8}$ 1/(H·m)

The combined magnetic resistance of the Rs and Ra: $Rsa=2.2\times10^{8}$ 1/(H·m)

Accordingly, the third embodiment satisfies the following magnetic resistance relational expression.

$$0.30\times Rsa\geq Rc$$

According to the above, the fixing device according to the third embodiment satisfies the permeance relational expressions (magnetic resistance relational expressions), and accordingly can be employed as the fixing device.

COMPARATIVE EXAMPLE 3

Figure 23:
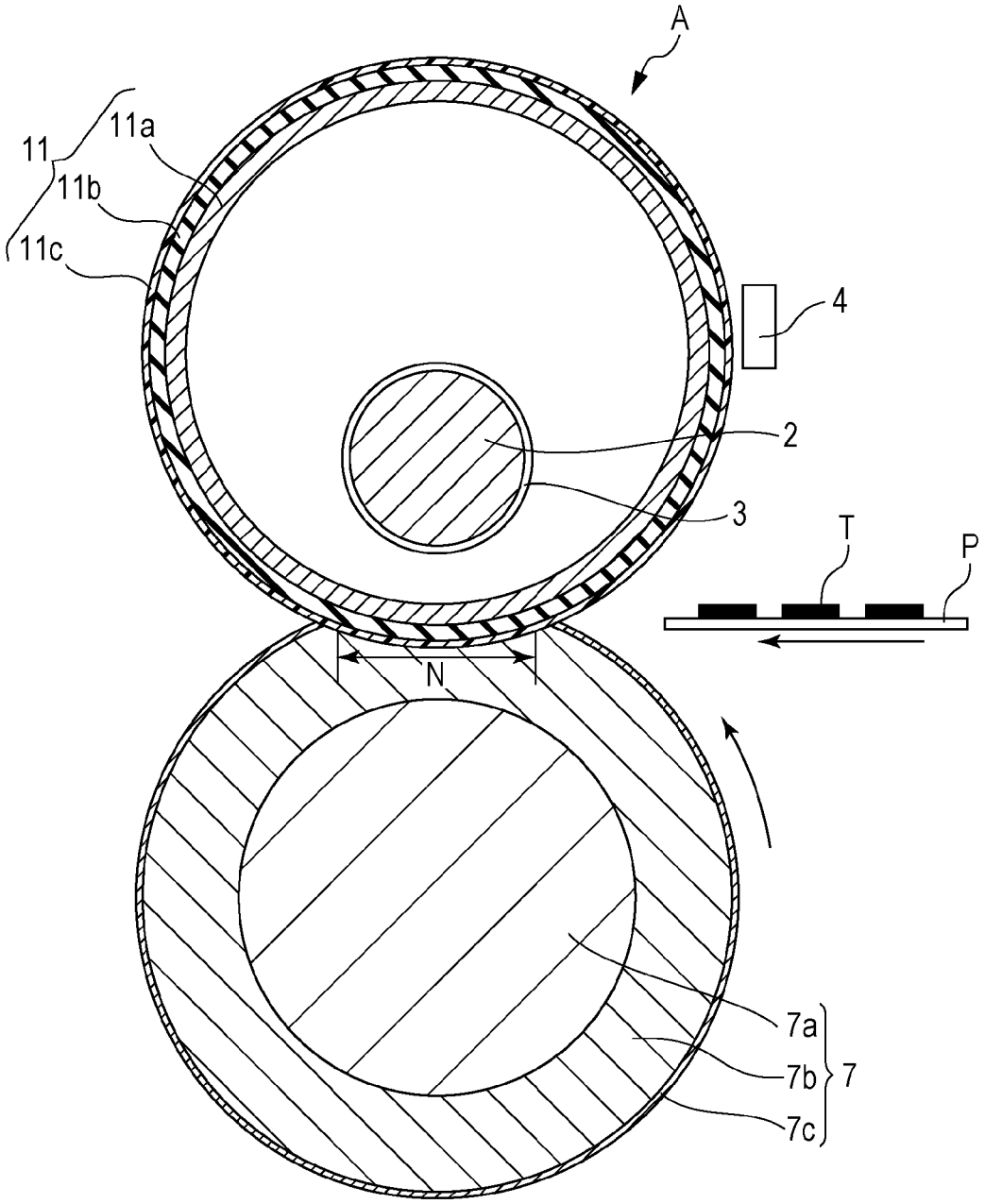
FIG. 23 is a diagram illustrating a configuration of an induction heating system fixing device serving as the comparative example 2.

As a comparative example 3, a configuration will be described wherein the cross-sectional areas of the magnetic core 2 and cylindrical rotary member differ from those of the fixing device according to the third embodiment, which does not satisfy "to set the ratio of magnetic flux outside the cylinder body equal to or higher than 90%". In particular, description will be made regarding a configuration wherein the cylindrical rotary member serves as the main magnetic path. FIG. 23 is a cross-sectional view of the fixing device according to the comparative example 3, a fixing roller 11 is employed as an electromagnetic induction heating rotary member instead of the fixing film. This is a configuration wherein nip N is formed by pressing force of the fixing roller 11 and pressing roller 7, an image carrier P and a toner image T are nipped to rotate in an arrow direction.

As a cylinder body (cylindrical rotary member) 11*a* of the fixing roller 11, there is employed nickel (Ni) wherein the relative permeability is 600, the thickness is 0.5 mm, and the diameter is 60 mm. Note that the material of the cylinder body is not restricted to nickel, and may be magnetic metal having high relative permeability such as iron (Fe), cobalt (Co), or the like.

The magnetic core 2 has a cylindrical shape made up of an integrated component which is not divided. The magnetic core 2 is disposed within the fixing roller 11 using an unillustrated fixing unit, and serves as a member configured to induce magnetic force lines (magnetic force lines) according to an alternating magnetic field generated by the exciting coil 3 into the fixing roller 11 to form a path (magnetic path) for magnetic force lines. This magnetic core 2 is ferrite wherein the relative permeability is 1800, the saturated magnetic flux density is 500 mT, the diameter is 6 mm, and the length B is 230 mm. Calculation results of permeance of each component of the fixing device according to the comparative example 3 will be summarized in Table 11.

TABLE 11

Magnetic Permeance in Comparative Example 3

| ITEM | UNIT | MAGNETIC CORE C | FILM GUIDE | AIR INSIDE CYLINDER BODY A_in | CYLINDER BODY cy |
|---|---|---|---|---|---|
| CROSS-SECTIONAL AREA | m^2 | 2.0E−05 | 1.0E−04 | 2.6E−03 | 9.3E−05 |
| RELATIVE PERMEABILITY | | 1800 | 1 | 1 | 600 |
| PERMEABILITY | H/m | 2.3E−3 | 1.3E−6 | 1.3E−6 | 754.0E−6 |
| PERMEANCE PER UNIT LENGTH | H · m | 4.4E−08 | 1.3E−10 | 3.3E−09 | 7.0E−08 |
| MAGNETIC RESISTANCE PER UNIT LENGTH | 1/(H · m) | 2.3E+07 | 8.0E+09 | 3.0E+08 | 1.4E+07 |

Permeance of each component of the compatible example 3 is as follows from Table 11.

The permeance of the magnetic core: $Pc=4.4\times10^{-8}$ H·m

The permeance within the cylinder body (region between the cylinder body and magnetic core): $Pa=1.3\times10^{-10}+3.3\times10^{-9}$ H·m The permeance of the cylinder body: $Ps=7.0\times10^{-8}$ H·m Accordingly, the following permeance relational expression is not satisfied.

$$Ps+Pa\leq0.30\times Pc$$

When replacing the above-mentioned expressions with magnetic resistance, the following expressions are obtained.

The magnetic resistance of the magnetic core: $Rc=2.3\times10^{7}$ 1/(H·m)

The magnetic resistance within the cylinder body (a region between the cylinder body and magnetic core):

$$Ra=2.9\times10^{8}\ 1/(\mathrm{H\cdot m})$$

The magnetic resistance of the cylinder body:

$$Rs=1.4\times10^{7}\ 1/(\mathrm{H\cdot m})$$

The combined magnetic resistance of the Rs and Ra:

$$Rsa=1.4\times10^{7}\ 1/(\mathrm{H\cdot m})$$

Accordingly, the comparative example 3 does not satisfy the following magnetic resistance relational expression.

$$0.30\times Rsa\geq Rc$$

Figure 24:
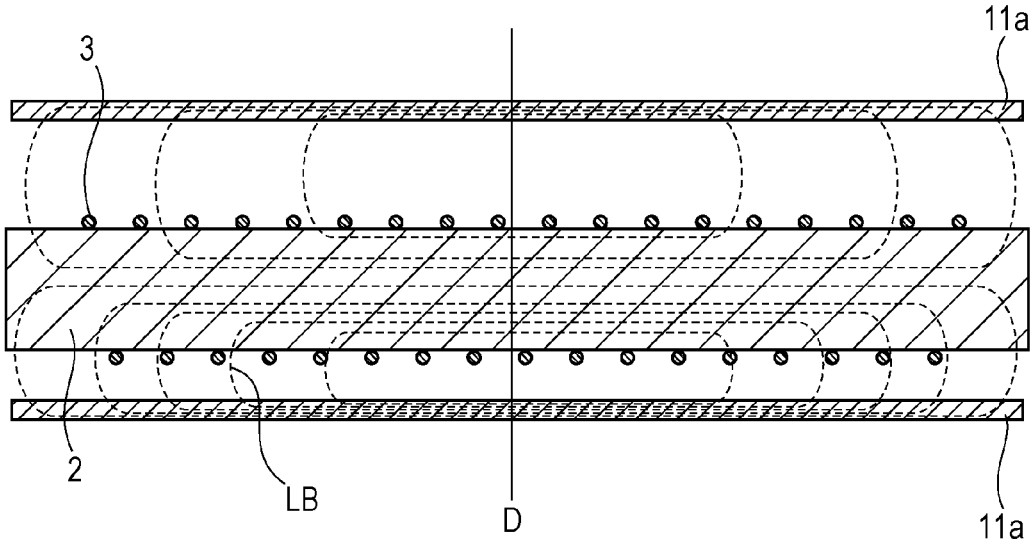
FIG. 24 is a schematic view of a magnetic field in an induction heating system fixing device serving as the comparative example 2.
Figure 25A:
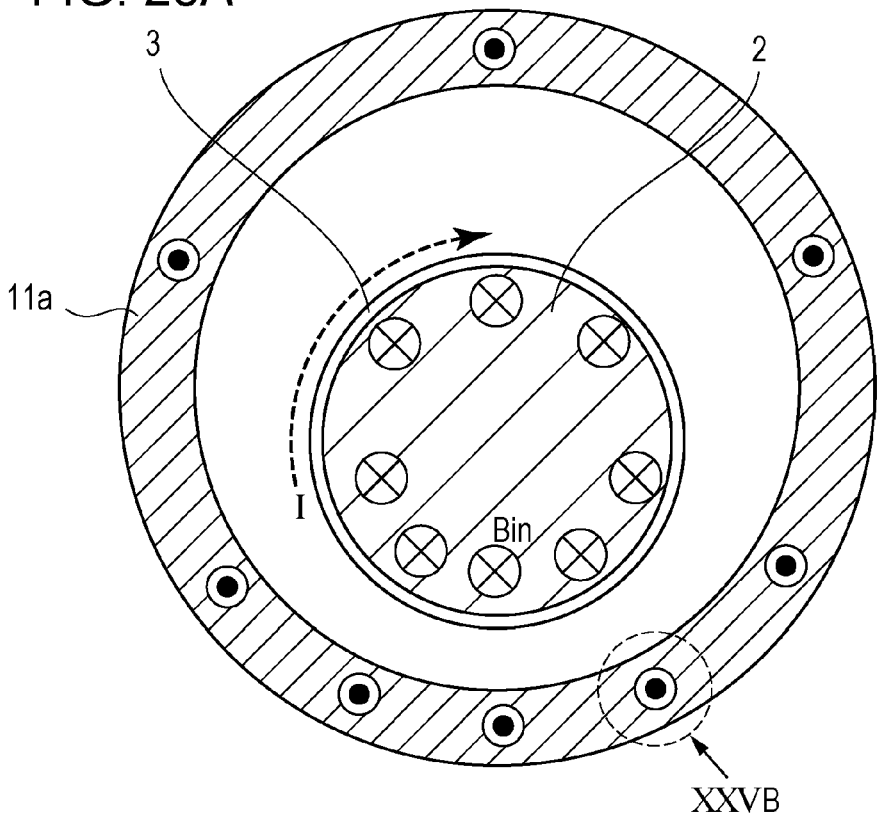
FIG. 25A is a schematic cross-sectional view of a magnetic field in the induction heating system fixing device serving as the comparative example 3.

The fixing device according to the comparative example 3 has a configuration wherein the permeance of the cylinder body is greater than the permeance of the magnetic core by 1.5 times. Accordingly, the outside of the cylinder body does not serve as the magnetic path, and the ratio of the magnetic force lines outside the cylinder body is 0%. Accordingly, when generating magnetic filed lines using the configuration of the comparative example 3, the main magnetic path is the cylinder body (cylindrical rotary member) 11*a*, and the magnetic path is not formed outside the cylinder body. With regard to the magnetic force line shapes in this case, as illustrated in dotted lines in FIG. 24, magnetic force lines generated from the magnetic core 2 enter the cylindrical rotary member 11*a* itself, and return to the magnetic core 2. Also, leakage magnetic fields LB are generated in some gaps of the coil 3, and enter the cylindrical rotary member 11*a* itself. A cross-sectional view at the center position D will be illustrated in FIG. 25A. This is a schematic view of magnetic force lines at a moment when the current of the coil 3 increases in arrow I direction.

Figure 25B:
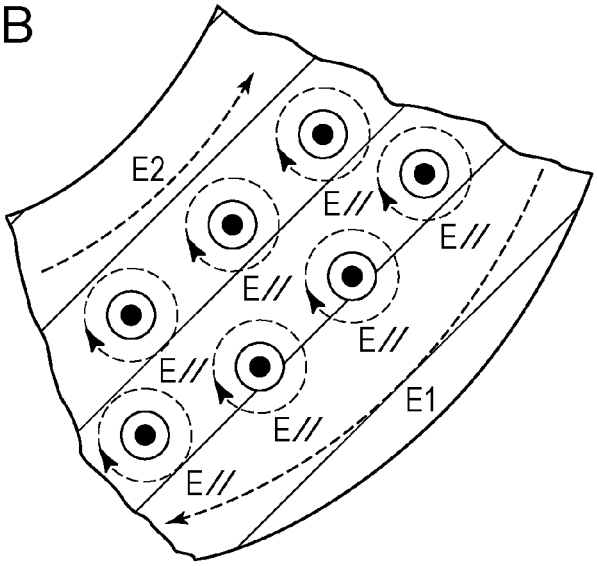
FIG. 25B is an enlarged schematic cross-sectional view of a magnetic field in the induction heating system fixing device serving as the comparative example 3.

Magnetic force lines Bin passing through the magnetic path will be illustrated with arrows (eight x-marks surrounded with a circle) toward the depth direction in space in the drawing. Arrows (eight black circles) toward the front side in space in the drawing represent magnetic force lines Bout to return to the inside of the cylindrical rotary member 11*a*. Within the cylindrical rotary member 11*a*, and particularly, a portion indicted with XXVB, as illustrated in FIG. 25B, a large number of eddy currents E// occur so as to form a magnetic field for preventing change in a magnetic field indicated with a black circle. With the eddy current E//, in a precise sense, there are portions which are mutually cancelled out and portions which are mutually enhanced, and finally, sum E1 and E2 of eddy currents indicated by a dotted-line arrow become dominant. Here, hereinafter, the E1 and E2 will be referred to as skin currents. When the skin currents E1 and E2 occur in the circumference direction, Joule's heat is generated in proportion to skin resistance of the fixing roller heating layer 11*a*. Such a current also repeats generation/elimination and direction changing in sync with a high-frequency current. Also, hysteresis loss at the time of generation/elimination of a magnetic field also contributes to heat generation.

Heat generation according to the eddy current E//, or heat generation according to the skin currents E1 and E2 is physically equivalent to that illustrated in FIG. 31, and heat generation according to the eddy current E// in this direction will substantially be referred to as excitation loss, and is a physics phenomenon equivalent to that represented with the following expression.

Now, "excitation loss" will be described. "Excitation loss" is a case where the direction of a magnetic field B// within the material 200*a* of an electromagnetic induction heat generation rotary member 200 illustrated in FIG. 31 is parallel with the axis X of the rotary member, while magnetic force lines in the arrow B// direction is increasing, an eddy current is generated a direction cancelling out increase thereof. This eddy current will be called E//. On the other hand, in a case where the direction of the magnetic field B// within the material 200*a* of the electromagnetic induction heat generation rotary member 200 illustrated in FIG. 32 is in perpendicular to the axis X of the rotary member, while magnetic flux in arrow B⊥ direction is increasing, an eddy current is generated in a direction cancelling out increase thereof. This eddy current will be called E⊥.

As with the comparative example 3, with a configuration wherein the majority of magnetic force lines output from one end of the magnetic core 2 passes through the inside of the material of the cylindrical rotary member and returns to the other end of the magnetic core, heat is generated at the cylindrical rotary member principally by Joule's heat according to the eddy current E//. Heat generation according to this eddy current E// is substantially called "excitation loss", and the amount of generated heat Pe generated by the eddy current is represented by the following expression.

$$P_e = k_e \frac{(tfB_m)^2}{\rho}$$

Pe: the amount of generated heat caused due to eddy current loss
t: fixing roller thickness
f: frequency
Bm: maximum magnetic flux density
ρ: resistivity
Ke: proportional constant As illustrated in the above expression, the amount of generated heat Pe is proportional to square of "Bm: maximum magnetic flux density within the material", and accordingly, it is desirable to select a ferromagnetic material such as iron, cobalt, nickel, or alloy thereof, as a constituent. Conversely, when employing a weak magnetic material or nonmagnetic material, heat efficiency is deteriorated. The amount of generated heat Pe is proportional to square of thickness t, and accordingly, when thinning the thickness equal to or thinner than 200 μm, this causes a problem in that heat efficiency is deteriorated, and a material having high resistivity is also disadvantageous. That is to say, the fixing device according to the comparative example 3 is high in thickness dependency of the cylindrical rotary member.

COMPARATIVE EXPERIMENT

Description will be made regarding results of a comparative experiment being performed regarding thickness dependency of the cylindrical rotary member of the comparative example 3 and third embodiment. As a cylindrical rotary member made of nickel for comparative experiment, a member wherein the diameter is 60 mm, and the length is 230 mm was employed, and three types of thickness (75 μm, 100 μm, 150 μm, and 200 μm) were prepared. As the magnetic core, with the third embodiment, a material with the diameter of 14 mm, and with the comparative example 3, a material with the diameter of 6 mm, were employed. A reason why the diameters of the magnetic cores differ between the third embodiment and the comparative example 3 is for differentiation wherein the comparative example 3 has a configuration not satisfying "R1: the ratio of magnetic force lines outside the cylinder body is equal to or greater than 70%", and the third embodiment has a configuration satisfying "R2: the ratio of magnetic force lines outside the cylinder body is equal to or greater than 90%". The following Table 12 illustrates "ratio of magnetic force lines outside the cylinder body" for each thickness of the cylindrical rotary members according to the third embodiment and comparative example 3. It is found from Table 12 that the ratio of magnetic force lines outside the cylinder body of the cylindrical rotary member of the comparative example 3 is highly sensitive to the thickness of the cylindrical rotary member and is high in thickness dependency, and the third embodiment is insensitive to the thickness of the cylindrical rotary member and is low in thickness dependency.

TABLE 12

Thickness Dependency of Cylindrical Rotary Member

| | THIRD EMBODIMENT | COMPARATIVE EXAMPLE 3 |
|---|---|---|
| CORE DIAMETER | 14 | 6 |
| Ni 75 μm | 98.7% | 50.6% |
| Ni 100 μm | 98.3% | 38.2% |
| Ni 150 μm | 97.5% | 13.3% |
| Ni 200 μm | 96.7% | 0.0% |

Figure 26:
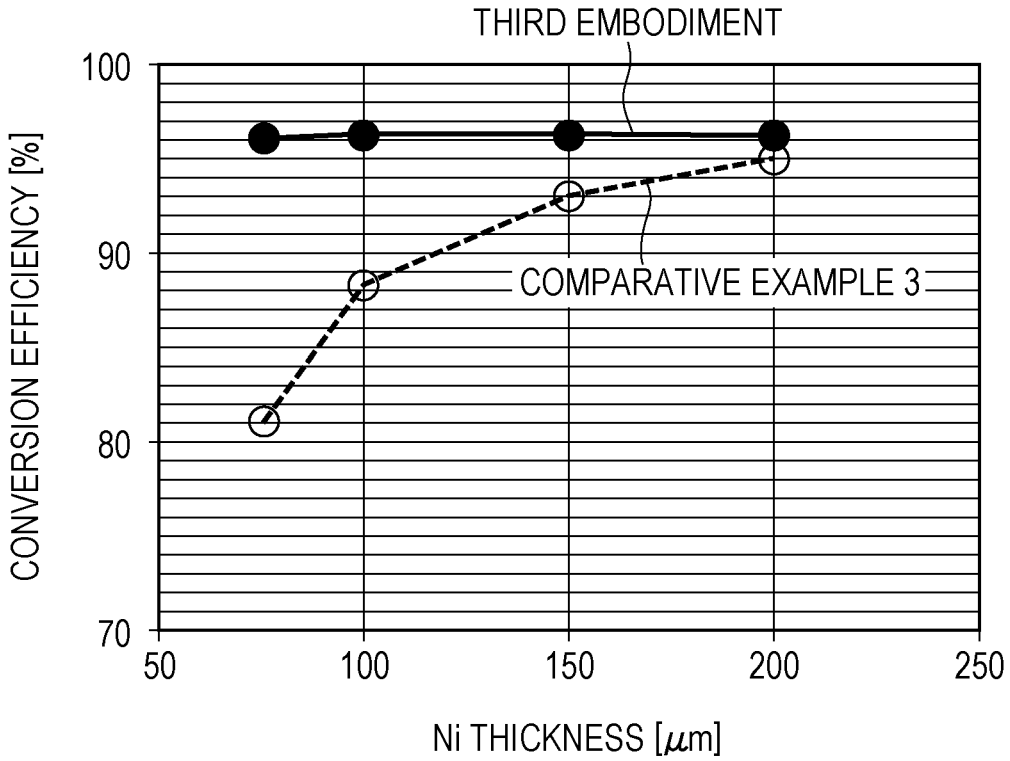
FIG. 26 is a diagram illustrating measured results of efficiency of power conversion with the configurations of a third embodiment and a comparative example 3.

Next, description will be made regarding results wherein the magnetic core was disposed within the cylinder body, and efficiency of power conversion at a frequency of 21 kHz was measured. First, there are measured the resistance $R_1$ and equivalent inductance $L_1$ from both ends of a winding wire in a state in which there is no cylinder body. Next, there are measured the resistance Rx and Lx from both ends of a winding wire in a state in which the magnetic core has been inserted in the cylinder body. Next, efficiency of power conversion is measured in accordance with Expression (27), and measured results are illustrated in FIG. 26.

$$\text{Efficiency}=(R_x-R_1)/R_x \quad (27)$$

According to this, with the comparative example 3, decrease in efficiency of power conversion was started when the thickness of the cylindrical rotary member reached equal to or thinner than 150 μm, and efficiency of power conversion reached 81% at 75 μm. As compared to a case where a nonmagnetic metal has been employed as the cylindrical rotary member, efficiency of power conversion is apt to increase particularly when the thickness of the cylindrical rotary member is greater. This is attributed to that "excitation loss" is effectively caused which is a heat generation phenomenon illustrated with the above-mentioned expression of the amount of generated heat Pe. However, "excitation loss" is apt to decrease in proportional to square of thickness, and accordingly, efficiency of power conversion decreased to 81% at 75 μm. In general, in order to provide flexibility to the cylinder body in the fixing device, the thickness of the cylindrical rotary member (electroconductive layer) is preferably equal to or thinner than 50 μm. When exceeding this thickness, the cylindrical rotary member may have poor durability against repetitive bending, or may impair quick start properties due to increase in thermal capacity.

With the configuration of the comparative example 3, when reducing the thickness of the cylindrical rotary member to equal to or thinner than 50 μm, efficiency of power conversion of electromagnetic induction heating becomes equal to or lower than 80%. Accordingly, as described in 3-6, the exciting coil and so forth generate heat, and extremely exceed the amount of heat that can be radiated by heat transfer and natural cooling. In this case, the temperature of the exciting coil becomes extremely high temperature as compared to the cylindrical rotary member, and accordingly, heat-resistant design of the exciting coil, and cooling measures such as air cooling, water cooling, or the like are necessary. Also, in the event of employing baking ferrite as the magnetic core, getting the Curie point at around 240 degrees Centigrade may prevent a magnetic path from being formed, and accordingly, a material having further high heat resistance has to be selected. This leads to increase in costs and increase in size regarding components. When the exciting coil unit increases in size, the rotary member into which this unit is inserted also increases in size, heat capacity increases, and quick start properties may be impaired.

On the other hand, with the configuration of the third embodiment, efficiency of power conversion exceeds 95%, and accordingly, heat generation will be performed with high efficiency. Further, the cylindrical rotary member can be configured equal to or thinner than 50 μm, and accordingly, this may be employed as a fixing film having flexibility. With the cylindrical rotary member according to the third embodiment, heat capacity can be reduced, heat-resistant design and radiation design do not have to be performed on the exciting coil, and accordingly, the entire fixing device can be reduced in size, and also excels in quick start properties.

As described above, according to the configuration of the third embodiment, even when forming the electroconductive layer with a material having high relative permeability such as nickel, heat generation can be performed on the electroconductive layer with high efficiency without increasing the thickness of the electroconductive layer.

Fourth Embodiment

The present embodiment is a modification of the third embodiment, and differs from the configuration of the third embodiment only in that the magnetic core is divided into two or more cores in the longitudinal direction, and a gap is provided between the divided cores. Dividing the magnetic core has an advantage in that the divided magnetic cores less readily damaged due to external impact as compared to the magnetic core being configured of an integrated component without dividing the magnetic core.

For example, when impact is given to the magnetic core in a direction orthogonal to the longitudinal direction of the magnetic core, the magnetic core configured of an integrated component is readily broken, but the divide magnetic cores are not readily broken. Other configurations are the same as with the third embodiment, and accordingly, description will be omitted.

Of the configuration of the fixing device according to the fourth embodiment, a configuration wherein the cylindrical rotary member 1*a*, magnetic core 3, and coil 2 are provided, and the magnetic core 3 has been divided into 10 cores is the same configuration as the configuration of the comparative example 1 illustrated in FIG. 19. A great different point between the magnetic core 3 according to the fourth embodiment and the magnetic core according to the comparative example 1 is the length of a gap between the divided cores. While the length of a gap in the comparative example 1 is 700 μm, the length of a gap is 20 μm in the fourth embodiment. With the fourth embodiment, an insulating sheet wherein the relative permeability is 1, and the thickness G is 20 μm, such as polyimide or the like is nipped in gaps. In this manner, a thin insulting sheet is nipped between the magnetic cores thereof, whereby the gaps of the divided magnetic cores can be assured. With the fourth embodiment, in order to suppress increase in magnetic resistance of the entire magnetic core as much as possible, a gap between the divided cores was designed as small as possible. With the configuration of the fourth embodiment, when obtaining permeance per unit length of the magnetic core 3 in the same method as with the comparative example 1, results thereof are as with the following Table 13.

Further, calculated values of permeance per unit length and magnetic resistance of each component will be illustrated in Table 14.

TABLE 13

Magnetic Permeance in Fourth Embodiment

| FOURTH EMBODIMENT | SYMBOL | NUMERIC VALUE | UNIT |
|---|---|---|---|
| LENGTH OF DIVIDED MAGNETIC CORE | Lc | 0.020 | m |
| PERMEABILITY OF MAGNETIC CORE | μc | 2.3E−03 | H/m |
| CROSS-SECTIONAL AREA OF MAGNETIC CORE | Sc | 2.0E−04 | m^2 |
| MAGNETIC RESISTANCE OF MAGNETIC CORE | Rm_c | 4.4E+04 | 1/H |
| LENGTH OF GAP | Lg | 0.00002 | m |
| PERMEABILITY OF GAP | μg | 1.3E−06 | H/m |
| CROSS-SECTIONAL AREA OF GAP | Sg | 2.0E−04 | m^2 |
| MAGNETIC RESISTANCE OF GAP | Rm_g | 7.9E+04 | 1/H |
| MAGNETIC RESISTANCE OF ENTIRE MAGNETIC CORE | Rm_all | 1.2E+06 | 1/H |
| Rm_all PER UNIT LENGTH | Rm | 5232410 | 1/(H · m) |
| Pm PER UNIT LENGTH | Pm | 1.9E−07 | H · m |

TABLE 14

Magnetic Permeance in Fourth Embodiment

| ITEM | UNIT | MAGNETIC CORE C | FILM GUIDE | AIR INSIDE CYLINDER BODY a_in | CYLINDER BODY cy | AIR OUTSIDE CYLINDER BODY a_out |
|---|---|---|---|---|---|---|
| CROSS-SECTIONAL AREA | m^2 | 2.0E−04 | 1.0E−04 | 1.5E−04 | 5.6E−06 | |
| RELATIVE PERMEABILITY | | | 1 | 1 | 600 | |
| PERMEABILITY | H/m | | 1.3E−6 | 1.3E−6 | 754.0E−6 | |

TABLE 14-continued

| Magnetic Permeance in Fourth Embodiment | | | | | | |
|---|---|---|---|---|---|---|
| ITEM | UNIT | MAGNETIC CORE C | FILM GUIDE | AIR INSIDE CYLINDER BODY a_in | CYLINDER BODY cy | AIR OUTSIDE CYLINDER BODY a_out |
| PERMEANCE PER UNIT LENGTH | H · m | 1.9E−07 | 1.3E−10 | 1.8E−10 | 4.3E−09 | 1.9E−07 |
| MAGNETIC RESISTANCE PER UNIT LENGTH | 1/(H · m) | 5.2E+06 | 8.0E+09 | 5.5E+09 | 2.4E+08 | 5.4E+06 |
| RATIO OF MAGNETIC FLUX | % | 100.0% | 0.1% | 0.1% | 2.2% | 97.7% |

With the configuration of the fourth embodiment, the ratio of magnetic force lines outside the cylinder body is 97.7%, and satisfies the condition of "R2: the ratio of magnetic force lines outside the cylinder body is equal to or greater than 90%".

Also, permeance of each component of the fourth embodiment is as follows from Table 14.

The permeance of the magnetic core: $Pc=1.9\times10^{-7}$ H·m

The permeance within the cylinder body: $Pa=1.3\times10^{-10}+1.8\times10^{-10}$ H·m The permeance of the cylinder body: $Ps=4.3\times10^{-9}$ H·m Accordingly, the fourth embodiment satisfies the following permeance relational expression.

$$Ps+Pa\leq0.30\times Pc$$

When replacing the above-mentioned expressions with magnetic resistance, the following expressions are obtained.

The magnetic resistance of the magnetic core: $Rc=5.2\times10^{6}$ 1/(H·m)

The magnetic resistance within the cylinder body: $Ra=3.2\times10^{9}$ 1/(H·m)

The magnetic resistance of the cylinder body: $Rs=2.4\times10^{8}$ 1/(H·m)

The combined magnetic resistance of the Rs and Ra: $Rsa=2.2\times10^{8}$ 1/(H·m)

Accordingly, the fourth embodiment satisfies the following magnetic resistance relational expression.

$$0.30\times Rsa\geq Rc$$

According to the above, the fixing device according to the fourth embodiment satisfies the permeance relational expressions (magnetic resistance relational expressions), and accordingly can be employed as the fixing device.

COMPARATIVE EXAMPLE 4

Figure 27:
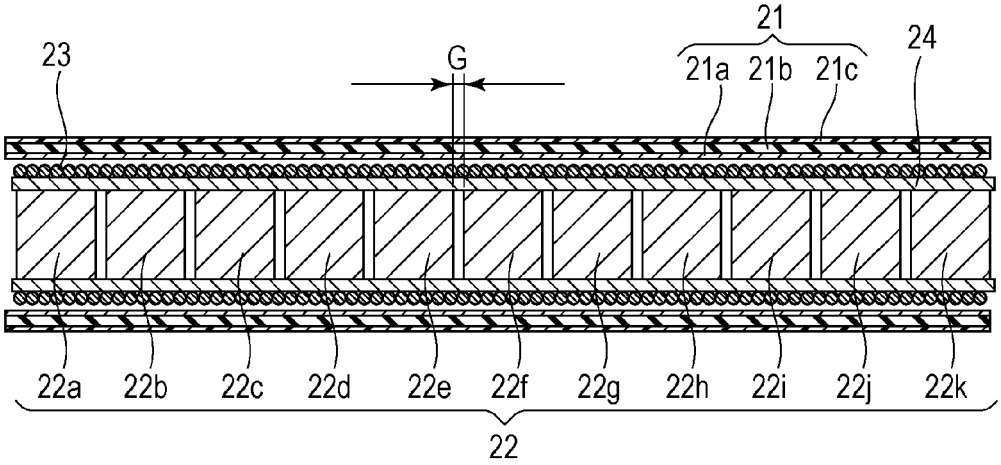
FIG. 27 is a cross-sectional view in the longitudinal direction of a magnetic core and a coil of a comparative example 4.

The present comparative example differs from the fourth embodiment regarding the length of a gap between the divided cores and the cylinder body. With the comparative example 4, a fixing roller serving as the cylinder body is employed (FIG. 27). Divided magnetic cores 22*a* to 22*k* are ferrite wherein the relative permeability is 1800, and the saturated magnetic flux density is 500 mT, and has a cylindrical shape wherein the diameter is 11 mm, and the lengths of the divided cores are 22 mm, and these eleven cores are disposed with an equal interval of G=0.5 mm. With the fixing roller serving as the cylinder body, as a heat generating layer 21*a*, a layer formed of nickel (relative permeability is 600) wherein the diameter is 40 mm, and the thickness is 0.5 mm is employed. Permeance and magnetic resistance per unit length of the magnetic core 33 can be calculated in the same way as with the fourth embodiment, and calculation results are as the following Table 15.

Also, the magnetic resistance of each gap has a value several times as large as the magnetic resistance of the magnetic core. Also, Table 16 illustrates results of calculated permeance and magnetic resistance per unit length of each component of the fixing device.

TABLE 15

| Magnetic Permeance in Comparative Example 4 | | | |
|---|---|---|---|
| COMPARATIVE EXAMPLE 4 | SYMBOL | NUMERIC VALUE | UNIT |
| LENGTH OF DIVIDED MAGNETIC CORE | Lc | 0.022 | m |
| PERMEABILITY OF MAGNETIC CORE | μc | 2.3E−03 | H/m |
| CROSS−SECTIONAL AREA OF MAGNETIC CORE | Sc | 9.5E−05 | m^2 |
| MAGNETIC RESISTANCE OF MAGNETIC CORE | Rm_c | 1.0E+05 | 1/H |
| LENGTH OF GAP | Lg | 0.0005 | m |
| PERMEABILITY OF GAP | μg | 1.3E−06 | H/m |
| CROSS-SECTIONAL AREA OF GAP | Sg | 9.5E−05 | m^2 |
| MAGNETIC RESISTANCE OF GAP | Rm_g | 4.2E+06 | 1/H |
| MAGNETIC RESISTANCE OF ENTIRE MAGNETIC CORE | Rm_all | 4.3E+07 | 1/H |
| Rm_all PER UNIT LENGTH | Rm | 1.7E+08 | 1/(H · m) |
| Pm PER UNIT LENGTH | Pm | 5.8E−09 | H · m |

TABLE 16

Magnetic Permeance in Comparative Example 4

| ITEM | UNIT | MAGNETIC CORE C | FILM GUIDE | AIR INSIDE CYLINDER BODY a_in | CYLINDER BODY cy | AIR OUTSIDE CYLINDER BODY a_out |
|---|---|---|---|---|---|---|
| CROSS-SECTIONAL AREA | m^2 | 9.5E−05 | 1.0E−04 | 1.0E−03 | 6.2E−05 | |
| RELATIVE PERMEABILITY | | | 1 | 1 | 600 | |
| PERMEABILITY | H/m | | 1.3E−6 | 1.3E−6 | 754.0E−6 | |
| PERMEANCE PER UNIT LENGTH | H · m | 5.8E−09 | 1.3E−10 | 1.3E−9 | 4.7E−08 | −4.2E−08 |
| MAGNETIC RESISTANCE PER UNIT LENGTH | 1/(H · m) | 1.7E+08 | 8.0E+09 | 8.0E+08 | 2.1E+07 | −2.4E+07 |
| RATIO OF MAGNETIC FLUX | % | 100.0% | 2.2% | 21.6% | 803.9% | −725.4% |

With permeance ratios in the fixing device according to the fourth embodiment, the permeance of the cylinder body is eight times as large as the permeance of the magnetic core. Accordingly, the outside of the cylinder body does not serve as the magnetic path, and the ratio of magnetic force lines outside the cylinder body is 0%. Accordingly, the magnetic force lines do not pass over the outside of the cylinder body, and are induced to the cylinder body itself. Also, magnetic resistance at a gap portion is great, and accordingly, as with a magnetic force line shape illustrated in FIG. 28, a magnetic pole occurs at each gap portion.

Permeance of each component of the comparative example 4 is as follows from Table 16.

The permeance per unit length of the magnetic core: $Pc=5.8\times10^{-9}$ H·m

The permeance per unit length within the cylinder body (region between the cylinder body and magnetic core): $Pa=1.3\times10^{-10}+1.3\times10^{-9}$ H·m The permeance per unit length of the cylinder body: $Ps=4.7\times10^{-8}$ H·m Accordingly, the comparative example 4 does not satisfy the following permeance relational expression.

$$Ps+Pa\leq0.30\times Pc$$

When replacing the above-mentioned expressions with magnetic resistance, the following expressions are obtained.

The magnetic resistance per unit length of the magnetic core: $Rc=1.7\times10^{8}$ 1/(H·m)

The magnetic resistance per unit length within the cylinder body (region between the cylinder body and magnetic core): $Ra=7.2\times10^{8}$ 1/(H·m)

The magnetic resistance per unit length of the cylinder body: $Rs=2.1\times10^{7}$ 1/(H·m)

The combined magnetic resistance of the Rs and Ra: $Rsa=2.1\times10^{7}$ 1/(H·m)

Accordingly, the comparative example 4 does not satisfy the following magnetic resistance relational expression.

$$0.30\times Rsa\geq Rc$$

The heat generation principle of the configuration of the comparative example 4 will be described. First, with a gap portion D1 of the magnetic core 22 illustrated in FIG. 28, an eddy current E⊥ is generated in the same way as with the comparative example 1 by a magnetic field affects on the cylinder body. FIG. 29A illustrates a cross-sectional view at around the D1. This is a magnetic filed line schematic view at a moment when the current of the coil 23 increases in arrow I direction. Magnetic force lines Bni passing through the magnetic path of the magnetic core will be illustrated with arrows (eight black circles) toward the front direction in the drawing. Arrows (eight x-marks) toward the depth direction in the drawing represent magnetic force lines Bni to return to the inside of the cylindrical rotary member 21*a*. Within the material of the cylindrical rotary member 21*a*, and particularly, a portion indicted with XXIXB, as illustrated in FIG. 29B, a large number of eddy currents E// occur so as to form a magnetic field for preventing change in the magnetic field Bni indicated with an x-mark within a white circle. With the eddy current E//, in a precise sense, there are portions which are mutually cancelled out and portions which are mutually enhanced, and finally, sum E1 (solid line) and E2 (dotted line) of eddy currents become dominant. When indicating this using a perspective view, this becomes FIG. 29C, an eddy current (skin current) occurs for cancelling out a magnetic force line in an arrow direction of the magnetic force line Bni affected on the inside of the material of the cylindrical rotary member, a current E1 flows into the outside surface, and a current E2 flows into the inner side. When the skin currents E1 and E2 occur in the circumference direction, with the heat generating layer 21*a* of the fixing roller, the current flows into a skin portion in a concentrated manner, and accordingly, Joule's heat is generated in proportional to skin resistance. Such a current also repeats generation/elimination and direction changing in sync with a high-frequency current. Also, hysteresis loss at the time of generation/elimination of a magnetic field also contributes to heat generation. Heat generation according to the eddy current E//, or heat generation according to the skin currents E1 and E2 are represented by Expression (1) in the same way as with the comparative example 3, and decreases with square of the thickness t.

Figure 28:
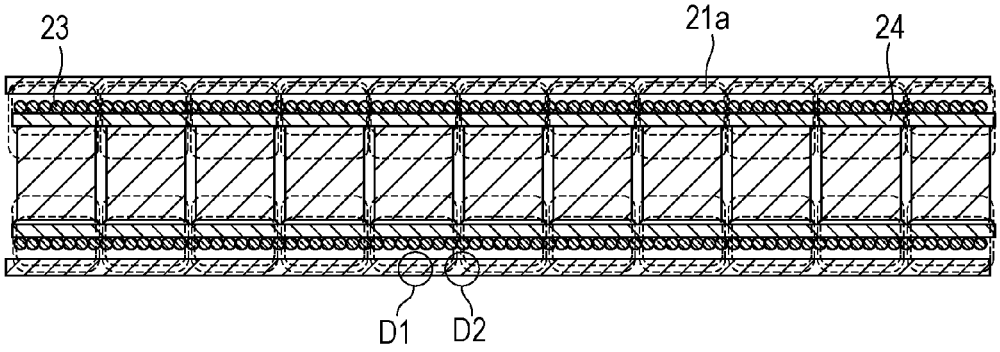
FIG. 28 is a schematic diagram of a magnetic field in an induction heating system fixing device serving as a comparative example 4.
Figure 29A:
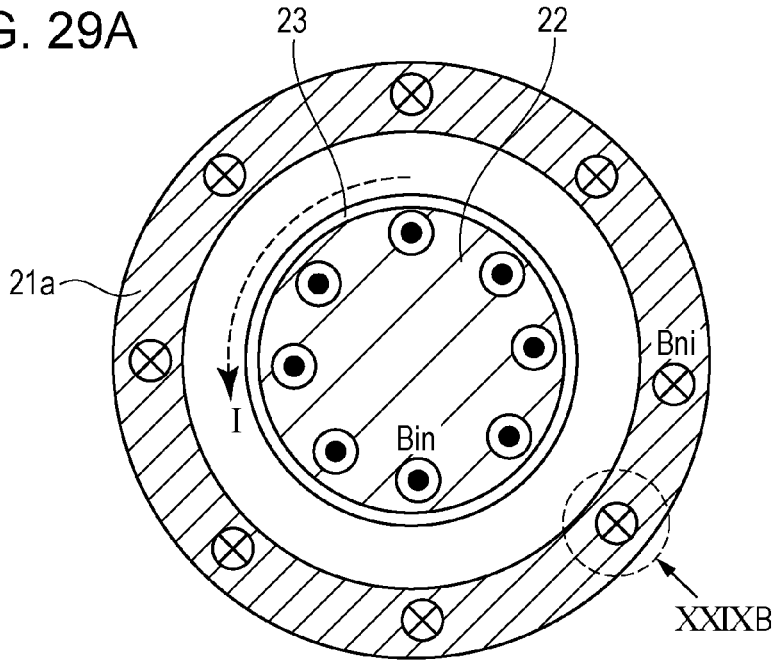
FIG. 29A is an explanatory diagram of a direction of an eddy current in the induction heating system fixing device serving as the comparative example 4.
Figure 29B:
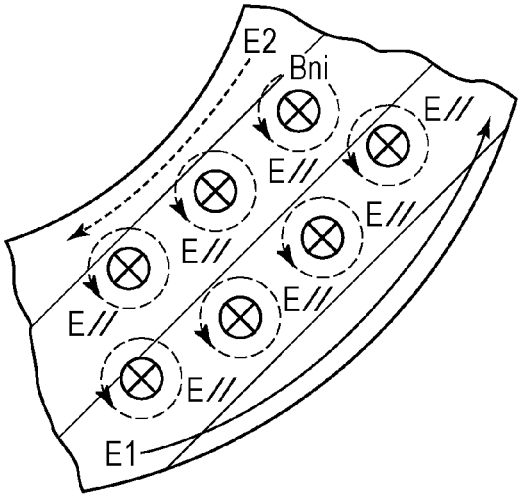
FIG. 29B is an explanatory diagram of a direction of an eddy current in the induction heating system fixing device serving as the comparative example 4.
Figure 29C:
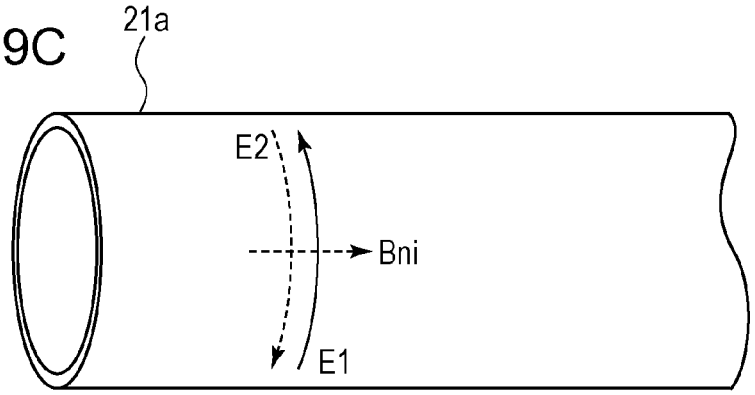
FIG. 29C is an explanatory diagram of a direction of an eddy current in the induction heating system fixing device serving as the comparative example 4.

Next, in D2 in FIG. 28, a magnetic flux vertically penetrates the material of the fixing roller. An eddy current in this case occurs in a direction of E⊥ illustrated in FIG. 32. With the comparative example 4, it can be conceived that occurrence of an eddy current in this direction also contributes to heat generation.

The eddy current E⊥ has a feature wherein the closer to the surface of the material, the greater the E⊥, and the closer to the inside of the material, the smaller the E⊥ becomes exponentially. Depth thereof will be referred to as penetration depth δ, and is represented with the following expression.

$$\delta=503\times(\rho/f\mu)^{\wedge}½ \quad (28)$$

penetration depth δ m
frequency of exciting circuit f Hz
permeability μ H/m
reluctivity ρ Ωm The penetration depth δ indicates the depth of absorption of electromagnetic waves, and the intensity of electromagnetic waves becomes equal to or lower than 1/e in a place deeper than this. Conversely, most of energy is absorbed until this depth. The depth thereof depends on a frequency, permeability, and reluctivity. The reluctivity ρ (Ω·m) and relative permeability μ, and penetration depth δ m at each frequency of nickel are illustrated as the following Table.

TABLE 17

Penetration Depth of Nickel

| | ρ: RELUCTIVITY Ω · m | RELATIVE PERME-ABILITY μ | δ (21 kHz) μm | δ (40 kHz) μm | δ (100 kHz) μm |
|---|---|---|---|---|---|
| Ni (NICKEL) | 6.84E−08 | 600 | 37 | 27 | 17 |

With nickel, penetration depth is 37 μm at a frequency of 21 kHz, and when the thickness of nickel is less than this thickness, electromagnetic waves penetrate nickel, and the amount of generated heat according to an eddy current extremely decreases. That is to say, even when an eddy current E⊥ occurs, heat generation efficiency is influenced with material thickness of around 40 μm. Accordingly, in the event of employing magnetic metal as a heat generating layer, it is desirable that the thickness thereof is greater than the penetration depth.

COMPARATIVE EXPERIMENT

Description will be made regarding experiment results of comparison of thickness dependency of the cylindrical rotary member between the fourth embodiment and comparative example 4. As a cylindrical rotary member made of nickel according to the comparative example 4, a member wherein the diameter is 60 mm, and the length is 230 mm was employed, and four types of thickness (75 μm, 100 μm, 150 μm, and 200 μm) were prepared. The fourth embodiment has a configuration wherein the magnetic core is divided in the longitudinal direction, in order to assure a gap between the divided magnetic cores, a polyimide sheet which thickness G=20 μm is nipped in a gap between the divided magnetic cores. The following Table 18 illustrates, with the fixing devices according to the fourth embodiment and comparative example 4, a relation between the thickness of the cylindrical rotary member and the ratio of magnetic force lines outside the cylinder body. The fourth embodiment satisfies the condition of "R2: the ratio of magnetic force lines outside the cylinder body is equal to or greater than 90%" regardless of the thickness of the cylindrical rotary member. The comparative example 4 is, "the ratio of magnetic force lines outside the cylinder body" in the event of employing the same cylindrical rotary member on the core with a gap of 0.5 mm according to the fourth embodiment, and does not satisfy "R1: the ratio of magnetic force lines outside the cylinder body is equal to or greater than 70%" in all situations.

TABLE 18

Ratio of Magnetic Force lines Outside Cylinder Body

| | FOURTH EMBODIMENT | COMPARATIVE EXAMPLE 4 |
|---|---|---|
| CORE DIAMETER | 16 | 4 |
| Ni 75 μm | 97.7% | 0.0% |
| Ni 100 μm | 96.9% | 0.0% |
| Ni 150 μm | 95.5% | 0.0% |
| Ni 200 μm | 94.0% | 0.0% |

Figure 30:
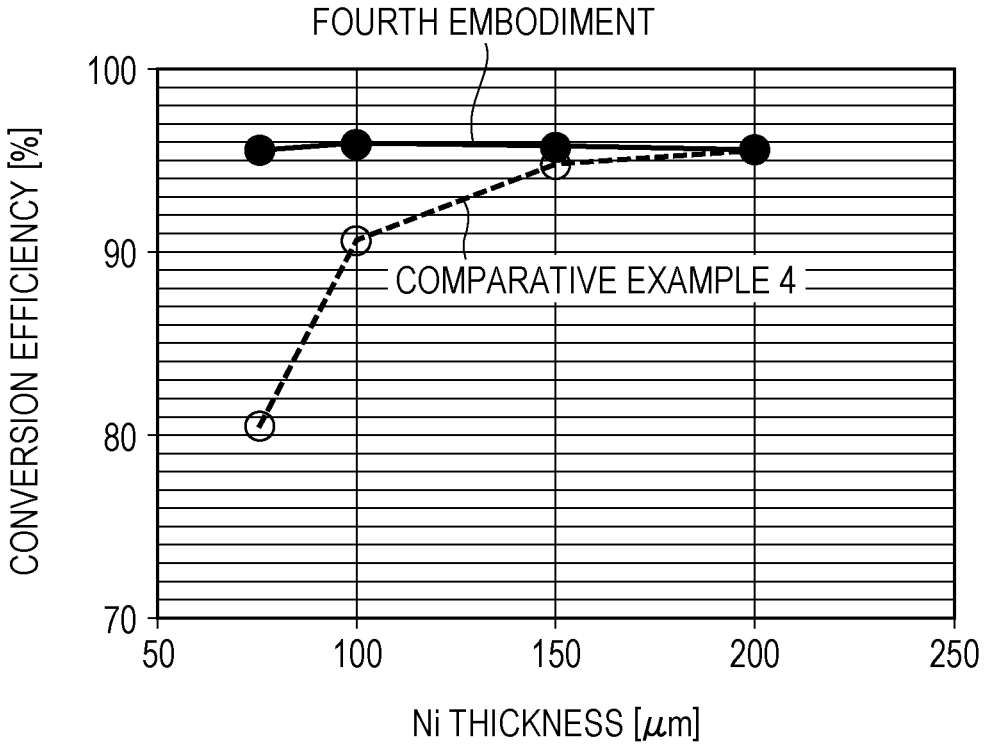
FIG. 30 is a diagram illustrating measured results of efficiency of power conversion with the configurations of a fourth embodiment and the comparative example 4.

"The ratio of magnetic force lines outside the cylinder body" of the comparative example 4 are 0% in all situations. Accordingly, magnetic force lines do not readily pass over the outside of the cylinder body, and principally pass through the roller. FIG. 30 is results wherein the magnetic core was disposed in the hollow portion of the cylindrical rotary member, and efficiency of power conversion at a frequency of 21 kHz was measured.

According to this, with the fixing device according to the comparative example 4, decrease in efficiency of power conversion started from 150-μm thickness of nickel, and reached 80% at 75 μm, and exhibited the same tendency as with the comparative example 3. With the configuration of the comparative example 4, in the event that the thickness of the cylindrical rotary member was set to 75 μm or thinner, the efficiency of power conversion of electromagnetic induction heating decreased to 80% or less, and has a configuration disadvantageous for quick start properties as with the comparative example 3. On the other hand, with the configuration of the fourth embodiment, efficiency of power conversion exceeded 95%, and accordingly, the fourth embodiment is advantageous for quick start properties according to the same reason as with the third embodiment.

As described above, according to the configuration of the fourth embodiment, with the cylinder body formed of nickel having high relative permeability, even when thinning the thickness thereof, heat generation can effectively be performed on the cylinder body, and the fixing device which excels in quick start properties can be provided.

Figure 33A:
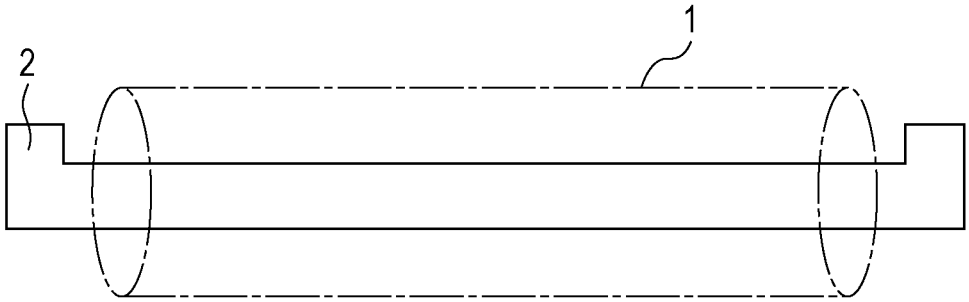
FIG. 33A is a diagram illustrating a shape of a magnetic core according to another embodiment.
Figure 33B:
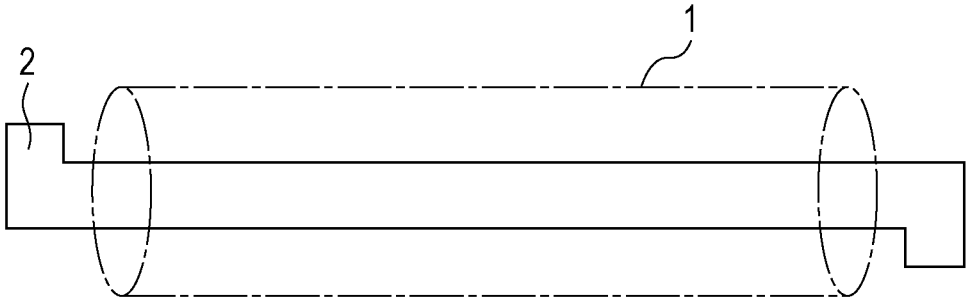
FIG. 33B is a diagram illustrating a shape of a magnetic core according to another embodiment.

Note that, as illustrated in FIGS. 33A and 33B, in the event that a portion protruding from an end face of the cylindrical rotary member of the magnetic core 2 is configured so as not to protrude to a region on the outside from a virtual face extended from the inner circumferential face of the cylindrical rotary member, in the radial direction of the cylindrical rotary member, this contributes to improvement in assembly properties.

Fifth Embodiment

With the item of "3-3. Magnetic Circuit and Permeance" in the first embodiment, description has been made such that when iron or the like has to be provided within the cylinder body, the ratio of magnetic force lines passing over the outside of the cylinder body have to be controlled. Now, description will be made regarding a specific example to control the ratio of magnetic force lines passing over the outside of the cylinder body.

The present embodiment is a modification of the second embodiment, and differs from the configuration of the second embodiment only in that an iron reinforcing stay was disposed as a reinforcing member. An iron stay configured with the minimum cross-sectional area is disposed, and accordingly, the fixing film and pressing roller can be suppressed with higher pressure, and has an advantage wherein fixing capability can be improved. The cross-sectional area mentioned here is a cross section in a direction perpendicular to the generatrix direction of the cylindrical rotary member.

Figure 36:
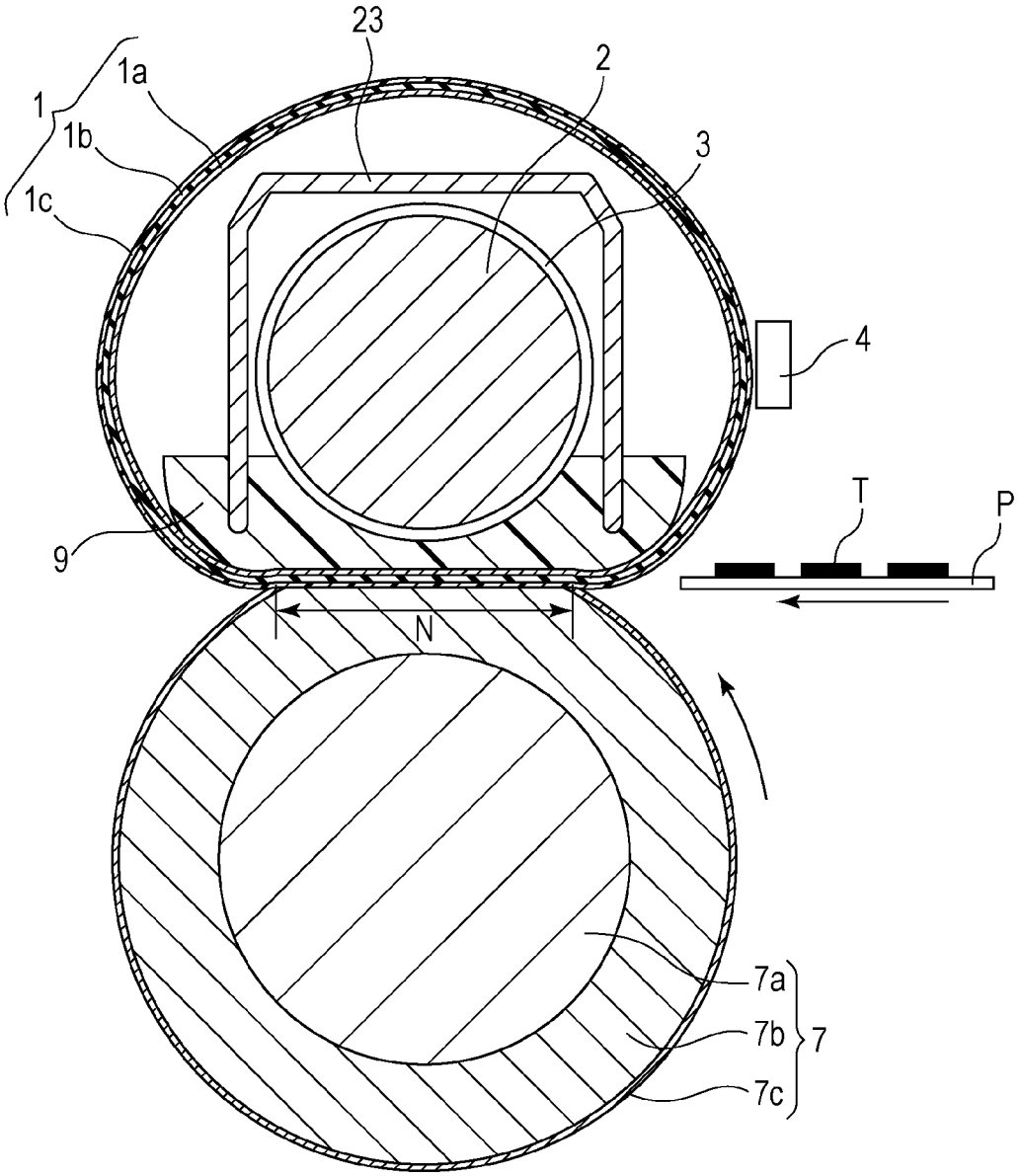
FIG. 36 is a cross-sectional configuration diagram of a fixing device according to a fifth embodiment.

FIG. 36 is a schematic cross-sectional view of the fixing device according to the fifth embodiment. A fixing device A includes a fixing film 1 serving a cylindrical heating rotary member, a film guide 9 serving as a nip portion forming member which is in contact with the inner face of the fixing film 1, a metal stay 23 configured to suppress the nip portion forming member, and a pressure roller 7 serving as a pressure member. The metal stay 23 is iron with relative permeability of 500, and a cross-sectional area thereof is 1 mm×30 mm=30 $mm^2$. The pressure roller 7 forms a nip portion N along with the film guide 9 via the fixing film 1. While conveying a recording material P which carries a toner image T using the nip portion N, the recording material P is heated to fix the toner image T on the recording material P. The pressure roller 7 is pressed against the film guide 9 by pressing force in total pressure of around 10 N to 300 N (around 10 to 30 kgf) using an unillustrated bearing unit and pressing unit. The pressure roller 7 is driven by rotation in an arrow direction using an unillustrated driving source, torque works on the fixing film 1 by frictional force at the nip portion N, and the fixing film 1 is driven and rotated. The film guide 9 also has a function serving as a film guide configured to guide the inner face of the fixing film 1, and is configured of polyphenylene sulfide (PPS) which is a heat-resistant resin or the like. The materials and cross-sectional areas of the magnetic core and cylinder body are the same as with the second embodiment, and accordingly, when calculating a ratio of magnetic force lines passing through each region, results are obtained as with the following Table 19.

The permeance of the cylinder body: Ps=$1.4\times10^{-12}$ H·m

Accordingly, the fifth embodiment satisfies the following permeance relational expression.

$$Ps+Pa\leq0.30\times Pc$$

When replacing the above-mentioned expressions with magnetic resistance, the following expressions are obtained. The magnetic resistance of the magnetic core: Rc=$2.2\times10^{6}$ 1/(H·m)

The magnetic resistance within the cylinder body is combined reluctance Ra of the magnetic resistance of the iron stay Rt, film guide Rf, and air within the cylinder body Rair, and when using the following expression, $$\frac{1}{R_a}=\frac{1}{R_t}+\frac{1}{R_f}+\frac{1}{R_{air}}$$

$$Ra=2.3\times10^{9}\ 1/(H\cdot m)$$

holds.

The magnetic resistance of the cylinder body Rs is Rs=$3.2\times10^{9}$ 1/(H·m), and accordingly, combined magnetic resistance Rsa of the Rs and Ra is Rsa=$2.3\times10^{9}$ 1/(H·m) holds.

Accordingly, the configuration of the fifth embodiment satisfies the following magnetic resistance relational expression.

$$0.30\times Rsa\geq Rc$$

According to the above, the fixing device according to the fifth embodiment satisfies the permeance (magnetic resistance) relational expressions, and accordingly can be employed as the fixing device.

TABLE 19

Ratio of Magnetic Force lines in Fifth Embodiment

| ITEM | UNIT | MAGNETIC CORE C | IRON STAY a_in | FILM GUIDE | AIR INSIDE CYLINDER BODY a_in | CYLINDER BODY cy | AIR OUTSIDE CYLINDER BODY a_out |
|---|---|---|---|---|---|---|---|
| CROSS-SECTIONAL AREA | m^2 | 2.0E−04 | 6.0E−05 | 1.0E−04 | 2.5E−04 | 1.1E−06 | |
| RELATIVE PERMEABILITY | | 1800 | 500 | 1 | 1 | 1 | |
| PERMEABILITY | H/m | 2.3E−3 | 628.3E−6 | 1.3E−6 | 1.3E−6 | 1.3E−6 | |
| PERMEANCE PER UNIT LENGTH | H · m | 4.5E−07 | 3.8E−08 | 1.3E−10 | 3.1E−10 | 1.4E−12 | 4.2E−07 |
| MAGNETIC RESISTANCE PER UNIT LENGTH | 1/(H · m) | 2.2E+06 | 2.7E+07 | 8.0E+09 | 3.2E+09 | 7.0E+11 | 2.4E+06 |
| RATIO OF MAGNETIC FLUX | % | 100.0% | 8.3% | 0.0% | 0.1% | 0.0% | 91.6% |

With the configuration of the fifth embodiment, the ratio of magnetic force lines outside the cylinder body is 91.6%, and satisfies the condition of "R1: the ratio of magnetic force lines outside the cylinder body is equal to or greater than 70%".

Permeance of each component of the fifth embodiment is as follows from Table 19.

The permeance of the magnetic core: Pc=$4.5\times10^{-7}$ H·m

Figure 37:
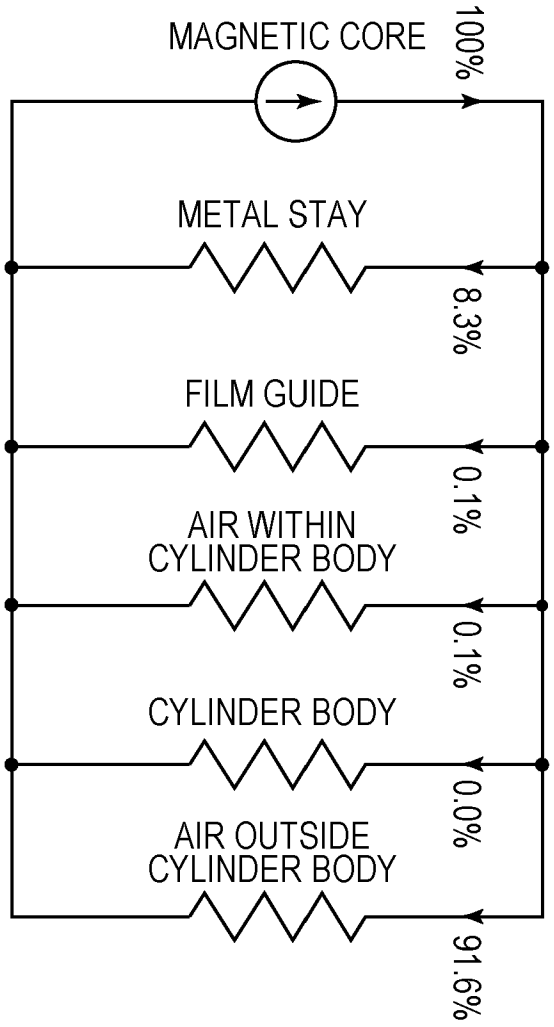
FIG. 37 is an equivalent circuit of a magnetic path of the fixing device according to the fifth embodiment.

The permeance within the cylinder body (region between the cylinder body and magnetic core): Pa=$3.8\times10^{-8}+1.3\times10^{-10}+3.1\times10^{-10}$ H·m FIG. 37 illustrates a magnetic equivalent circuit of space including the magnetic core, coil, cylinder body, and metal stay per unit length. The way of looking is the same as with FIG. 11B, and accordingly, detailed description of the magnetic equivalent circuit will be omitted. When magnetic force lines output from one end in the longitudinal direction of the magnetic core are taken to be 100%, 8.3% thereof pass through the inside of the metal stay and return to the other end of the magnetic core, and accordingly, magnetic force lines passing over the outside of the cylinder body decrease by just that much. This reason will be described using the directions of magnetic force lines and Faraday's law with reference to FIG. 38.

Figure 38:
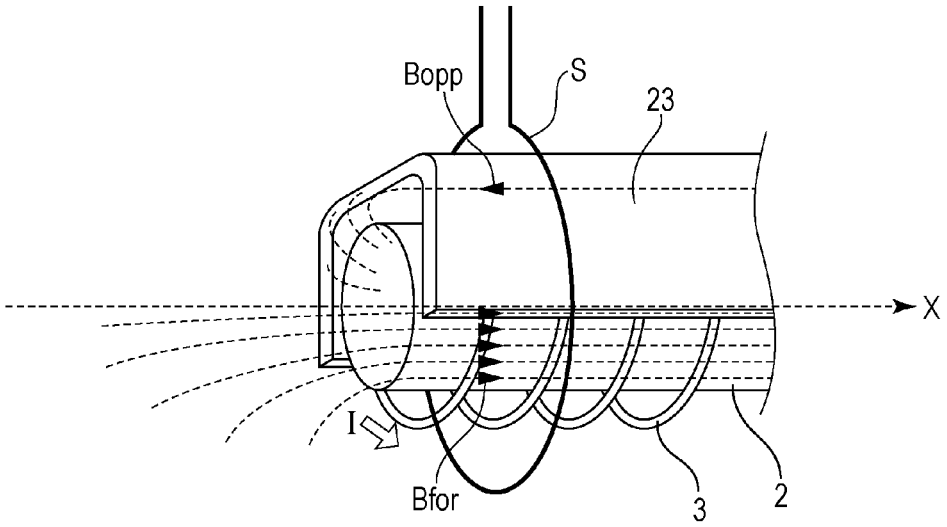
FIG. 38 is a diagram for describing a magnetic force line shape and reduction in heat quantity.

Faraday's law is "When changing a magnetic field within a circuit, induced electromotive force which attempts to apply current to the circuit occurs, and the induced electromotive force is proportional to temporal change of a magnetic flux vertically penetrating the circuit." In the event that the circuit S is disposed near an end portion of the magnetic core 2 of the solenoid coil 3 illustrated in FIG. 38, and a high-frequency alternating current is applied to the coil 3, induced electromotive force generated at the circuit S is, in accordance with Expression (2), proportional to temporal change of magnetic force lines which vertically penetrate the inside of the circuit S according to Faraday's law. That is to say, when many more vertical components Bfor of magnetic force lines pass through the circuit S, induced electromotive force to be generated also increases. However, magnetic force lines passing through the inside of the metal stay become components Bopp of magnetic force lines which the opposite direction of the vertical components B for of magnetic force lines within the magnetic core. When the components Bopp of magnetic force lines of this opposite direction exist, "magnetic force lines vertically penetrating the circuit" becomes difference between the Bfor and Bopp, and accordingly decreases. As a result thereof, there may be a case where electromotive force decreases, and conversion efficiency falls.

Accordingly, in the event of disposing a metal member such as a metal stay in a region between the cylinder body and magnetic core, permeance within the cylinder body is reduced by selecting a material having small relative permeability such as austenitic stainless steel or the like so as to satisfy the following permeance relational expressions. In the event of disposing a member having high relative permeability in a region between the cylinder body and magnetic core of necessity, permeance within the cylinder body is reduced (the magnetic resistance within the cylinder body is increased) by decreasing the cross-sectional area of the member thereof as small as possible so as to satisfy the following permeance relational expressions.

COMPARATIVE EXAMPLE 5

The present comparative example differs from the fifth embodiment described above regarding the cross-sectional area of the metal stay. In the event that the cross-sectional area is greater than that of the fifth embodiment, and is $2.4\times10^{-4}$ $m^2$ which is quadruple as large as that of the fifth embodiment, when calculating the ratio of magnetic force lines passing through each region, calculation results are as the following Table 20.

TABLE 20

Ratio of Magnetic Force lines in Comparative Example 5

| ITEM | UNIT | MAGNETIC CORE C | IRON STAY a_in | FILM GUIDE | AIR INSIDE CYLINDER BODY a_in | CYLINDER BODY cy | AIR OUTSIDE CYLINDER BODY a_out |
|---|---|---|---|---|---|---|---|
| CROSS-SECTIONAL AREA | m^2 | 2.0E−04 | 2.4E−04 | 1.0E−04 | 2.5E−04 | 1.1E−06 | |
| RELATIVE PERMEABILITY | | 1800 | 500 | 1 | 1 | 1 | |
| PERMEABILITY | H/m | 2.3E−3 | 628.3E−6 | 1.3E−6 | 1.3E−6 | 1.3E−6 | |
| PERMEANCE PER UNIT LENGTH | H · m | 4.5E−07 | 3.8E−08 | 1.3E−10 | 3.1E−10 | 1.4E−12 | 4.2E−07 |
| MAGNETIC RESISTANCE PER UNIT LENGTH | 1/(H · m) | 2.2E+06 | 6.6E+06 | 8.0E+09 | 3.2E+09 | 7.0E+11 | 3.3E+06 |
| RATIO OF MAGNETIC FLUX | % | 100.0% | 33.2% | 0.0% | 0.1% | 0.0% | 66.8% |

With the configuration of the comparative example 5, the ratio of magnetic force lines outside the cylinder body is 66.8%, and does not satisfy the condition of "R1: the ratio of magnetic force lines outside the cylinder body is equal to or greater than 70%". At this time, efficiency of power conversion obtained by the impedance analyzer was 60%.

Also, permeance per unit length of each component of the comparative example 5 is as follows from Table 20.

The permeance per unit length of the magnetic core: $Pc=4.5\times10^{-7}$ H·m

The permeance per unit length within the cylinder body (region between the cylinder body and magnetic core): $Pa=1.5\times10^{-7}+1.3\times10^{-10}+3.1\times10^{-10}$ H·m The permeance per unit length of the cylinder body: $Ps=1.4\times10^{-12}$ H·m Accordingly, the comparative example 5 does not satisfy the following permeance relational expression.

$$Ps+Pa\leq0.30\times Pc$$

When replacing the above-mentioned expressions with magnetic resistance, the following expressions are obtained.

The magnetic resistance of the magnetic core: $Rc=2.2\times10^{6}$ 1/(H·m)

The magnetic resistance Ra within the cylinder body (combined reluctance of the magnetic resistance of the iron stay Rt, film guide Rf, and air within the cylinder body Rair) is, when calculating this from the following expression, $Ra=6.6\times10^{6}$ 1/(H·m).

$$\frac{1}{R_a} = \frac{1}{R_t} + \frac{1}{R_f} + \frac{1}{R_{air}}$$

The magnetic resistance Rs of the cylinder body is Rs=7.0×$10^{11}$ 1/(H·m), and accordingly, the combined magnetic resistance Rsa of the Rs and Ra is Rsa=6.6×$10^6$ 1/(H·m).

Figure 40A:
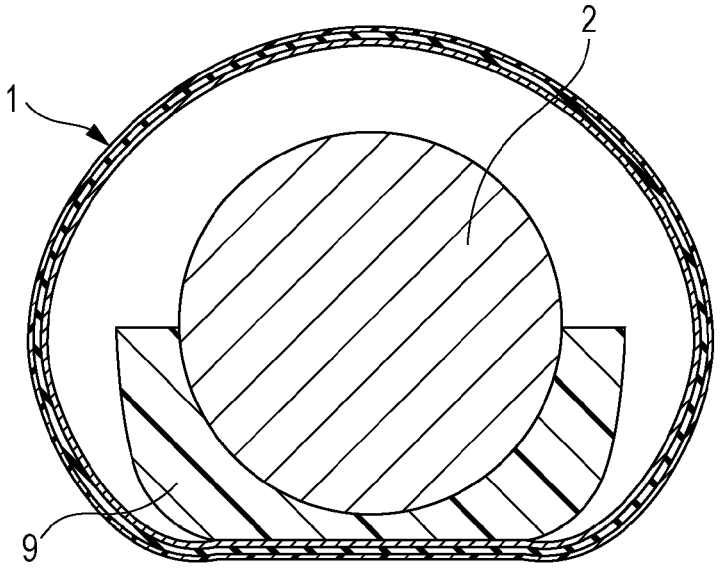
FIG. 40A is a cross-sectional view of the fixing device according to the sixth embodiment.
Figure 40B:
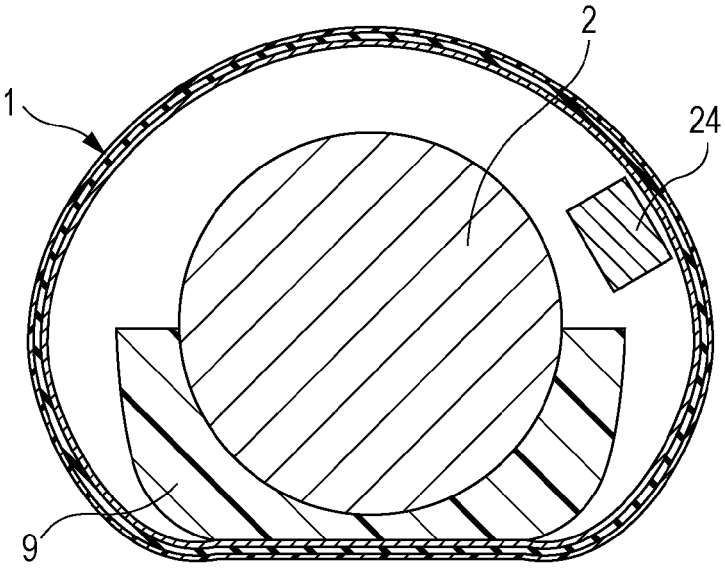
FIG. 40B is a cross-sectional view of the fixing device according to the sixth embodiment.

Accordingly, the comparative example 5 does not satisfy the following magnetic resistance relational expression.

$$0.30 \times Rsa \geq Rc$$

the region 1 is illustrated in FIG. 40A, and the cross-sectional configuration in the region 2 is illustrated in FIG. 40B. As illustrated in FIG. 40B, the temperature detecting member 24 is housed in the fixing film 1, and accordingly becomes an object for magnetic resistance calculation. In order to strictly perform magnetic resistance calculation, "magnetic resistance per unit length" is individually obtained for the region 1, region 2, and region 3, integration calculation is performed according to the length of each region, and combined magnetic resistance is obtained by adding these. First, magnetic resistance per unit length of each component in the region 1 or region 3 is illustrated in the following Table 21.

TABLE 21

Cross-sectional Configuration of Region 1 or 3

| ITEM | UNIT | MAGNETIC CORE C | FILM GUIDE | AIR INSIDE CYLINDER BODY a_in | CYLINDER BODY cy |
|---|---|---|---|---|---|
| CROSS-SECTIONAL AREA | m^2 | 1.5E−04 | 1.0E−04 | 2.0E−04 | 1.5E−06 |
| RELATIVE PERMEABILITY | | 1800 | 1 | 1 | 1 |
| PERMEABILITY | H/m | 2.3E−03 | 1.3E−06 | 1.3E−06 | 1.3E−06 |
| PERMEANCE PER UNIT LENGTH | H · m | 3.5E−07 | 1.3E−10 | 2.5E−10 | 1.9E−12 |
| MAGNETIC RESISTANCE PER UNIT LENGTH | 1/(H · m) | 2.9E+06 | 8.0E+09 | 4.0E+09 | 5.3E+11 |

Sixth Embodiment

Figure 39:
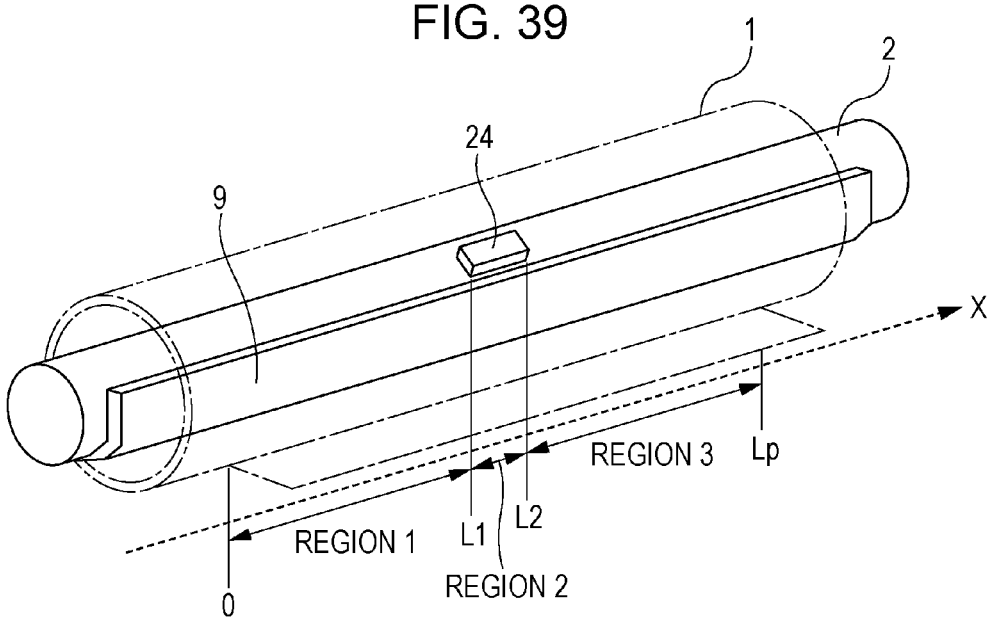
FIG. 39 is a schematic configuration diagram of a fixing device according to a sixth embodiment.

With cases of the first to fifth embodiments, the fixing device has been handled wherein members and so forth within the maximum image region have an even cross-sectional configuration in the generatrix direction of the cylindrical rotary member. With a sixth embodiment, description will be made regarding a fixing device having an uneven cross-sectional configuration in the generatrix direction of a cylindrical rotary member. FIG. 39 is a fixing device described in the sixth embodiment. As a point different from the configurations of the first to fifth embodiments, a temperature detecting member 24 is provided within (region between the magnetic core and cylindrical rotary member) the cylindrical rotary member. Other configurations are the same as with the second embodiment, the fixing device includes a fixing film 1 having an electroconductive layer (cylindrical rotary member), magnetic core 2, and nip portion forming member (film guide) 9.

If we say that the longitudinal direction of the magnetic core 2 is taken as the X axis direction, the maximum image forming region is a range of 0 to Lp on the X axis. For example, in the event of an image forming apparatus wherein the maximum conveyance region of a recording material is taken as LTR size of 215.9 mm, Lp has to be set as Lp=215.9 mm. The temperature detecting member 24 is configured of a nonmagnetic material with relative permeability of 1, the cross-sectional area in a direction perpendicular to the X axis is 5 mm×5 mm, the length in a direction parallel to the X axis is 10 mm. The temperature detecting member 24 is disposed in a position from L1 (102.95 mm) to L2 (112.95 mm) on the X axis. Now, 0 to L1 on the X coordinate will be referred to as region 1, L1 to L2 where the temperature detecting member 24 exists will be referred to as region 2, and L2 to LP will be referred to as region 3. The cross-sectional configuration in Magnetic resistance $r_c$1 per unit length of the magnetic core in the region 1 is as follows.

$$r_c1=2.9\times10^6\ 1/(H\cdot m)$$

Now, magnetic resistance $r_a$ per unit length of a region between the cylinder body and magnetic core is combined magnetic resistance of the magnetic resistance per unit length of the film guide $r_f$, and the magnetic resistance per unit length of air within the cylinder $r_{air}$. Accordingly, this can be calculated using the following expression.

$$\frac{1}{r_a} = \frac{1}{r_f} + \frac{1}{r_{air}}$$

As results of calculation, magnetic resistance $r_a$1 in the region 1, and magnetic resistance $r_s$1 in the region 1 are as follows.

$$r_a1=2.7\times10^9\ 1/(H\cdot m)$$

$$r_s1=5.3\times10^{11}\ 1/(H\cdot m)$$

Also, the region 3 is the same as the region 1, and accordingly, three types of magnetic resistance regarding the region 3 are as follows.

$$r_c3=2.9\times10^6\ 1/(H\cdot m)$$

$$r_a3=2.7\times10^9\ 1/(H\cdot m)$$

$$r_s3=5.3\times10^{11}\ 1/(H\cdot m)$$

Next, magnetic resistance per unit length of each component in the region 2 is illustrated in the following Table 22.

TABLE 22

| Cross-sectional Configuration of Region 2 | | | | | | |
|---|---|---|---|---|---|---|
| ITEM | UNIT | MAGNETIC CORE C | FILM GUIDE | THERMISTOR | AIR INSIDE CYLINDER BODY a_in | CYLINDER BODY cy |
| CROSS-SECTIONAL AREA | m^2 | 1.5E−04 | 1.0E−04 | 2.5E−05 | 1.72E−04 | 1.5E−06 |
| RELATIVE PERMEABILITY | | 1800 | 1 | 1 | 1 | 1 |
| PERMEABILITY | H/m | 2.3E−3 | 1.3E−06 | 1.3E−06 | 1.3E−06 | 1.3R-06 |
| PERMEANCE PER UNIT LENGTH | H · m | 3.5E−07 | 1.3E−10 | 3.1E−11 | 2.2E−10 | 1.9E−12 |
| MAGNETIC RESISTANCE PER UNIT LENGTH | 1/(H · m) | 2.9E+06 | 8.0E+09 | 3.2E+10 | 4.6E+09 | 5.3E+11 |

Magnetic resistance $r_c$2 per unit length of each component in the region 2 is as follows.

$$r_c2=2.9\times10^6\ 1/(\mathrm{H\cdot m})$$

Magnetic resistance $r_a$ per unit length of a region between the cylinder body and magnetic core is combined magnetic resistance of the magnetic resistance per unit length of the film guide $r_f$, the magnetic resistance per unit length of the thermistor $r_t$, and the magnetic resistance per unit length of air within the cylinder $r_{air}$. Accordingly, this can be calculated using the following expression.

$$\frac{1}{r_a}=\frac{1}{r_t}+\frac{1}{r_f}+\frac{1}{r_{air}}$$

As results of calculation, magnetic resistance $r_a$2 per unit length in the region 2, and magnetic resistance $r_c$2 per unit length in the region 2 are as follows.

$$r_a2=2.7\times10^9\ 1/(\mathrm{H\cdot m})$$

$$r_s2=5.3\times10^{11}\ 1/(\mathrm{H\cdot m})$$

The region 3 is completely the same as the region 1. Note that, with the magnetic resistance $r_a$ per unit length of a region between the cylinder body and magnetic core, a reason why $r_a$1=$r_a$2=$r_a$3 will be described. With magnetic resistance calculation in the region 2, the cross-sectional area of the thermistor 24 increases, and the cross-sectional area of the air within the cylinder body decreases. However, with both, relative permeability is 1, and accordingly, magnetic resistance is the same regardless of presence or absence of the thermistor 24. That is to say, in the event that a nonmagnetic material alone is disposed in the region between the cylinder body and magnetic core, even when calculation of magnetic resistance is treated as the same as the air, this is sufficient as the precision on calculation. This is because in the case of a nonmagnetic material, relative permeability becomes a value almost approximate to 1. On the contrary, in the case of a magnetic material (nickel, iron, silicon steel, or the like), it is desirable to calculate a region where there is a magnetic material and other regions separately.

Integration of magnetic resistance R[A/Wb/(1/H)] serving as combined magnetic resistance in the generatrix direction of the cylinder body can be calculated for magnetic resistance r1, r2, and r3 1/(H·m) of each region as follows.

$$R=\int_o^{L_1} r1dl+\int_{L_1}^{L_2} r2dl+\int_{L_2}^{L_p} r3dl=$$
$$r1(L1-0)+r2(L2-L1)+r3(LP-L2)$$

Accordingly, magnetic resistance Rc[H] of the core in a section from one end of the maximum conveyance region of the recording material to the other end can be calculated as follows.

$$R_c=\int_o^{L_1} r_c1dl+\int_{L_1}^{L_2} r_c2dl+\int_{L_2}^{L_p} r_c3dl=$$
$$r_c1(L1-0)+r_c2(L2-L1)+r_c3(LP-L2)$$

Also, combined magnetic resistance Ra[H] of a region between the cylinder body and magnetic core in a section from one end of the maximum conveyance region of the recording material to the other end can be calculated as follows.

$$R_a=\int_o^{L_1} r_a1dl+\int_{L_1}^{L_2} r_a2dl+\int_{L_2}^{L_p} r_a3dl=$$
$$r_a1(L1-0)+r_a2(L2-L1)+r_a3(LP-L2)$$

Combined magnetic resistance Rs[H] of the cylinder body in a section from one end of the maximum conveyance region of the recording material to the other end can be calculated as follows.

$$R_s=\int_o^{L_1} r_s1dl+\int_{L_1}^{L_2} r_s2dl+\int_{L_2}^{L_p} r_s3dl=$$
$$r_s1(L1-0)+r_s2(L2-L1)+r_s3(LP-L2)$$

Results of the above calculations performed on each region will be illustrated in the following Table 23.

TABLE 23

Integration calculation results of permeance in each region

| | REGION 1 | REGION 2 | REGION 3 | COMBINED MAGNETIC RESISTANCE |
|---|---|---|---|---|
| INTEGRATION START POINT mm | 0 | 102.95 | 112.95 | |
| INTEGRATION END POINT mm | 102.95 | 112.95 | 215.9 | |
| DISTANCE mm | 102.95 | 10 | 102.95 | |
| PERMEANCE PER UNIT LENGTH pcH · m | 3.5E−07 | 3.5E−07 | 3.5E−07 | |
| MAGNETIC RESISTANCE PER UNIT LENGTH rc1/(H · m) | 2.9E+06 | 2.9E+06 | 2.9E+06 | |
| INTEGRATION OF MAGNETIC RESISTANCE rc [A/Wb(1/H)] | 3.0E+08 | 2.9E+07 | 3.0E+08 | 6.2E+08 |
| PERMEANCE PER UNIT LENGTH paH · m | 3.7E−10 | 3.7E−10 | 3.7E−10 | |
| MAGNETIC RESISTANCE PER UNIT LENGTH ra1/(H · m) | 2.7E+09 | 2.7E+09 | 2.7E+09 | |
| INTEGRATION OF MAGNETIC RESISTANCE ra [A/Wb(1/H)] | 2.8E+11 | 2.7E+10 | 2.8E+11 | 5.8E+11 |
| PERMEANCE PER UNIT LENGTH psH · m | 1.9E−12 | 1.9E−12 | 1.9E−12 | |
| MAGNETIC RESISTANCE PER UNIT LENGTH rs1/(H · m) | 5.3E+11 | 5.3E+11 | 5.3E+11 | |
| INTEGRATION OF MAGNETIC RESISTANCE rs [A/Wb(1/H)] | 5.4E+13 | 5.3E+12 | 5.4E+13 | 1.1E+14 |

Rc, Ra, and Rs are as follows from the above Table 23.

$$Rc=6.2\times10^{8}\ [1/H]$$

$$Ra=5.8\times10^{11}\ [1/H]$$

$$Rs=1.1\times10^{14}\ [1/H]$$

Combined magnetic resistance Rsa of the Rs and Ra can be calculated with the following expression.

$$\frac{1}{R_{sa}}=\frac{1}{R_s}+\frac{1}{R_a}$$

$$R_{sa}=\frac{R_a\times R_s}{R_a+R_s}$$

According to the above calculations, Rsa=$5.8\times10^{11}$ [1/H] is obtained, and accordingly, the following relational expression is satisfied.

$$0.30\times Rsa\geq Rc$$

In this manner, in the case of the fixing device having an uneven cross-sectional shape in the generatrix direction of the cylindrical rotary member, it is desirable that the magnetic core is divided into multiple regions in the generatrix direction of the cylindrical rotary member, magnetic resistance is calculated for each region thereof, and finally, permeance or magnetic resistance combined from those is calculated. However, in the event that a member to be processed is a nonmagnetic material, permeability is substantially the same as the permeability of air, and accordingly, this may be calculated by regarding this as air. Next, components which have to be calculated will be described. With regard a component disposed within the cylindrical rotary member (electroconductive layer, i.e., a region between the cylindrical rotary member and magnetic core), and at least a part is included in the maximum conveyance regions (0 to Lp) of the recording material, permeance or magnetic resistance has to be calculated. Conversely, with regard to a member disposed outside the cylindrical rotary member, permeance or magnetic resistance does not have to be calculated. This is because as described above, induced electromotive force is proportional to temporal change of magnetic force lines which vertically penetrate the circuit according to Faraday's law, and has no relation with magnetic force lines outside the circuit. Also, a member disposed outside the maximum conveyance region of the recording material in the generatrix direction of the cylindrical rotary member does not affect on heat generation of the cylindrical rotary member (electroconductive layer), does not have to be calculated.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-137892 filed Jun. 19, 2012 and No. 2013-122216 filed Jun. 10, 2013, which are hereby incorporated by reference herein in their entirety.

The invention claimed is:

1. A fixing device configured to fix an image on a recording material by heating the recording material where the image is formed, comprising:

a cylindrical rotary member including an electroconductive layer;

a coil configured to form an alternating magnetic field which subjects the electroconductive layer to electromagnetic induction heating, the coil including a spiral shaped portion which is disposed in the rotary member so that a spiral axis of the spiral shaped portion extends along a generatrix direction of the rotary member; and a core configured to induce magnetic force lines of the alternating magnetic field, the core being disposed in the spiral shaped portion;

wherein magnetic resistance of the core is, with an area from one end to the other end of the maximum passage region of the image on a recording material in the generatrix direction, equal to or smaller than 30% of combined magnetic resistance made up of magnetic resistance of the electroconductive layer and magnetic resistance of a region between the electroconductive layer and the core.

2. The fixing device according to claim 1, wherein the core has a shape which does not form a loop outside the rotary member.

3. The fixing device according to claim 1, wherein, with the area, magnetic resistance of the core is equal to or smaller than 10% of the combined magnetic resistance.

4. The fixing device according to claim 1, wherein, with the area, magnetic resistance of the core is equal to or smaller than 6% of the combined magnetic resistance.

5. The fixing device according to claim 1, wherein the electroconductive layer is formed of at least one of silver, aluminum, austenitic stainless steel, and copper.

6. The fixing device according to claim 1, wherein a material of the core is calcined ferrite.

7. The fixing device according to claim 1, wherein thickness of the electroconductive layer is equal to or thinner than 75 μm.

8. The fixing device according to claim 1, wherein the core protrudes an outer side of the rotary member than an end face of the rotary member in the generatrix direction.

9. The fixing device according to claim 8, wherein a portion of the core protruding an outer side of the rotary member than the end face of the rotary member is, with a radial direction of the rotary member, in an inner side region than a virtual face extending the inner face of the rotary member in the generatrix direction.

10. The fixing device according to claim 1, wherein a frequency of alternating current to flow into the coil is equal to or greater than 21 kHz but equal to or smaller than 100 kHz.

11. The fixing device according to claim 1, wherein the maximum passage region of the image is included in a region where the electroconductive layer and the core are overlapped in the generatrix direction.

12. The fixing device according to claim 1, wherein the rotary member is a cylindrical film; and wherein the fixing device has a counter member configured to form a nip portion, at which a recording material is conveyed, between the film and itself.

13. The fixing device according to claim 12, wherein the fixing device includes a nip portion forming member configured to form the nip portion, which is in contact with the inner face of the film, along with the counter member via the film.

14. The fixing device according to claim 13, wherein the fixing device includes a reinforcing member configured to reinforce the nip portion forming member, which is long in the generatrix direction, within the film, and a material of the reinforcing member is austenitic stainless steel.

15. A fixing device configured to fix an image on a recording material by heating a recording material where an image is formed, comprising:

a cylindrical rotary member including an electroconductive layer;

a coil configured to form an alternating magnetic field which subjects the electroconductive layer to electromagnetic induction heating, the coil including a spiral shaped portion which is disposed in the rotary member so that a spiral axis of the spiral shaped portion extends along a generatrix direction of the rotary member; and a core configured to induce magnetic force lines of the alternating magnetic field, the core having a shape where a loop is not formed outside the rotary member and being disposed in the spiral shaped portion;

wherein 70% or more of magnetic force lines output from one end of the core in the generatrix direction pass over the outside of the electroconductive layer and return to the other end of the core.

16. The fixing device according to claim 15, wherein 90% or more of magnetic force lines output from one end of the core in the generatrix direction pass over the outside of the electroconductive layer and return to the other end of the core.

17. The fixing device according to claim 15, wherein 94% or more of magnetic force lines output from one end of the core in the generatrix direction pass over the outside of the electroconductive layer and return to the other end of the core.

18. The fixing device according to claim 15, wherein the electroconductive layer is formed of at least one of silver, aluminum, austenitic stainless steel, and copper.

19. The fixing device according to claim 15, wherein a material of the core is calcined ferrite.

20. The fixing device according to claim 15, wherein thickness of the electroconductive layer is equal to or thinner than 75 μm.

21. The fixing device according to claim 15, wherein the core protrudes an outer side of the rotary member than an end face of the rotary member in the generatrix direction.

22. The fixing device according to claim 15, wherein a portion of the core protruding an outer side of the rotary member than the end face of the rotary member is, with a radial direction of the rotary member, in an inner side region than a virtual face extending the inner face of the rotary member in the generatrix direction.

23. The fixing device according to claim 15, wherein a frequency of alternating current to flow into the coil is equal to or greater than 21 kHz but equal to or smaller than 100 kHz.

24. The fixing device according to claim 15, wherein the maximum passage region of the image on a recording material is included in a region where the electroconductive layer and the core are overlapped in the generatrix direction.

25. The fixing device according to claim 15, wherein the rotary member is a cylindrical film; and wherein the fixing device has a counter member configured to form a nip portion, at which a recording material is conveyed, between the film and itself.

26. The fixing device according to claim 15, wherein the fixing device includes a nip portion forming member configured to form the nip portion, which is in contact with the inner face of the film, along with the counter member via the film.

27. The fixing device according to claim 15, wherein the fixing device includes a reinforcing member configured to reinforce the nip portion forming member, which is long in the generatrix direction, within the film, and a material of the reinforcing member is austenitic stainless steel.

28. A fixing device configured to fix an image on a recording material by heating the recording material where the image is formed, comprising:

a cylindrical rotary member including an electroconductive layer;

a coil configured to form an alternating magnetic field which subjects the electroconductive layer to electromagnetic induction heating, the coil including a spiral shaped portion which is disposed in the rotary member so that a spiral axis of the spiral shaped portion extends along a generatrix direction of the rotary member; and a core configured to induce magnetic force lines of the alternating magnetic field, the core being disposed in the spiral shaped portion;

wherein relative permeability of the electroconductive layer and relative permeability of a member in a region between the electroconductive layer and the core, in an area from one end to the other end of the maximum passage region of the image on a recording material in the generatrix direction, are smaller than 1.1; and wherein the fixing device satisfies a following relational expression (1) with a cross section perpendicular to the generatrix direction throughout the area:

$$0.06\times\mu c\times Sc\geq Ss+Sa \quad (1)$$

where Ss represents a cross-sectional area of the electroconductive layer, Sa represents a cross-sectional area of a region between the electroconductive layer and the core, Sc represents a cross-sectional area of the core, and μc represents a relative permeability of the core.

29. The fixing device according to claim 28, wherein the core has a shape where a loop is not formed outside the rotary member.

30. The fixing device according to claim 28, wherein the electroconductive layer is formed of at least one of silver, aluminum, austenitic stainless steel, and copper.

31. The fixing device according to claim 28, wherein a material of the core is calcined ferrite.

32. The fixing device according to claim 28, wherein thickness of the electroconductive layer is equal to or thinner than 75 μm.

33. The fixing device according to claim 28, wherein the core protrudes an outer side of the rotary member than an end face of the rotary member in the generatrix direction.

34. The fixing device according to claim 33, wherein a portion of the core protruding an outer side of the rotary member than the end face of the rotary member is, with a radial direction of the rotary member, in an inner side region than a virtual face extending the inner face of the rotary member in the generatrix direction.

35. The fixing device according to claim 28, wherein a frequency of alternating current to flow into the coil is equal to or greater than 21 kHz but equal to or smaller than 100 kHz.

36. The fixing device according to claim 28, wherein the maximum passage region of the image is included in a region where the electroconductive layer and the core are overlapped in the generatrix direction.

37. The fixing device according to claim 28, wherein the rotary member is a cylindrical film; and wherein the fixing device has a counter member configured to form a nip portion, at which a recording material is conveying, between the film and itself.

38. The fixing device according to claim 37, wherein the fixing device includes a nip portion forming member configured to form the nip portion, which is in contact with the inner face of the film, along with the counter member via the film.

39. The fixing device according to claim 38, wherein the fixing device includes a reinforcing member configured to reinforce the nip portion forming member, which is long in the generatrix direction, within the film, and a material of the reinforcing member is austenitic stainless steel.

40. A fixing device configured to fix an image on a recording material by heating the recording material where the image is formed, comprising:

a cylindrical rotary member including an electroconductive layer;

a coil configured to form an alternating magnetic field which subjects the electroconductive layer to electromagnetic induction heating, the coil including a spiral shaped portion which is disposed in the rotary member so that a spiral axis of the spiral shaped portion extends along a generatrix direction of the rotary member; and a core configured to induce magnetic force lines of the alternating magnetic field, the core being disposed in the spiral shaped portion;

wherein the electroconductive layer is formed of a non-magnetic material, and the core has a shape where a loop is not formed outside the rotary member.

41. The fixing device according to claim 40, wherein the non-magnetic material is formed of at least one of silver, aluminum, austenitic stainless steel, and copper.

42. The fixing device according to claim 40, wherein the rotary member is a film.

43. A fixing device configured to fix an image on a recording material by heating the recording material where the image is formed, comprising:

a cylindrical rotary member including an electroconductive layer;

a coil configured to form an alternating magnetic field which subjects the electroconductive layer to electromagnetic induction heating, the coil including a spiral shaped portion which is disposed in the rotary member so that a spiral axis of the spiral shaped portion extends along a generatrix direction of the rotary member; and a core configured to induce magnetic force lines of the alternating magnetic field, which is disposed in the spiral shaped portion;

wherein the electroconductive layer is formed of a non-magnetic material, and thickness of the electroconductive layer is equal to or thinner than 75 μm.

44. The fixing device according to claim 43, wherein the rotary member is a film.

45. The fixing device according to claim 43, wherein the core has a shape where a loop is not formed outside the rotary member.

46. The fixing device according to claim 43, wherein the non-magnetic material is formed of at least one of silver, aluminum, austenitic stainless steel, and copper.

47. A fixing device configured to fix an image on a recording material by heating the recording material where the image is formed, comprising:

a cylindrical rotary member including an electroconductive layer;

a coil configured to form an alternating magnetic field which subjects the electroconductive layer to electromagnetic induction heating, the coil including a spiral shaped portion which is disposed in the rotary member so that a spiral axis of the spiral shaped portion extends along a generatrix direction of the rotary member; and a core configured to induce magnetic force lines of the alternating magnetic field, the coil being disposed in the spiral shaped portion, wherein the core has a shape where a loop is not formed outside the rotary member, and wherein the rotary member is heated mainly by a current induced by the alternating magnetic field circumferentially flowing in the electroconductive layer.

48. The fixing device according to claim 47, wherein the core has a shape with end portions in a longitudinal direction of the core.

49. The fixing device according to claim 47, wherein magnetic resistance of the core is, with an area from one end to the other end of the maximum passage region of the image on a recording material in the generatrix direction, equal to or smaller than 30% of combined magnetic resistance made up of magnetic resistance of the electroconductive layer and magnetic resistance of a region between the electroconductive layer and the core.

50. The fixing device according to claim 47, wherein 70% or more of the magnetic force lines output from one end of the core in the generatrix direction pass over the outside of the electroconductive layer and return to the other end of the core.

51. The fixing device according to claim 47, wherein the rotary member is a film.

52. The fixing device according to claim 47, wherein the electroconductive layer is formed of at least one of silver, aluminum, austenitic stainless steel, and copper.

* * * * *